US010952484B2

(12) United States Patent
Yeung et al.

(10) Patent No.: US 10,952,484 B2
(45) Date of Patent: Mar. 23, 2021

(54) CONFORMAL PROTECTIVE HEAD WEAR

(71) Applicants: Adrienne Yeung, San Jose, CA (US); C. Douglass Thomas, Saratoga, CA (US)

(72) Inventors: Adrienne Yeung, San Jose, CA (US); C. Douglass Thomas, Saratoga, CA (US)

( * ) Notice: Subject to any disclaimer, the term of this patent is extended or adjusted under 35 U.S.C. 154(b) by 276 days.

(21) Appl. No.: 15/693,455

(22) Filed: Aug. 31, 2017

(65) Prior Publication Data

US 2018/0055126 A1 Mar. 1, 2018

Related U.S. Application Data

(60) Provisional application No. 62/382,727, filed on Sep. 1, 2016, provisional application No. 62/540,039, filed on Aug. 1, 2017.

(51) Int. Cl.

| | |
|---|---|
| ***A42B 1/08*** | (2006.01) |
| ***A42B 1/22*** | (2006.01) |
| ***A42B 1/041*** | (2021.01) |
| ***A41D 1/06*** | (2006.01) |
| ***A41D 13/015*** | (2006.01) |
| ***A41D 13/05*** | (2006.01) |
| ***A41D 13/06*** | (2006.01) |
| ***A41D 20/00*** | (2006.01) |

(52) U.S. Cl.

CPC ..... *A42B 1/08* (2013.01); *A41D 1/06* (2013.01); *A41D 13/0158* (2013.01); *A41D 13/0537* (2013.01); *A41D 13/065* (2013.01); *A41D 20/00* (2013.01); *A42B 1/041* (2013.01); *A42B 1/22* (2013.01); *A41D 13/015* (2013.01)

(58) Field of Classification Search

CPC ..... A41D 13/015; A42B 1/08; A42B 3/32; A63B 71/10

USPC ..... 2/411, 425, 414

See application file for complete search history.

(56) References Cited

U.S. PATENT DOCUMENTS

| | | | | |
|---|---|---|---|---|
| 4,136,222 A | | 1/1979 | Jonnes | |
| 4,665,569 A | * | 5/1987 | Santini | A42B 3/32 2/410 |
| 5,271,101 A | | 12/1993 | Speth et al. | |
| 5,365,607 A | | 11/1994 | Benevento et al. | |
| 5,661,854 A | | 9/1997 | March | |
| 5,918,309 A | | 7/1999 | Bachner, Jr. | |
| 5,951,503 A | | 9/1999 | Pomatto | |
| 6,070,905 A | * | 6/2000 | Renault | F16F 1/3605 280/751 |

(Continued)

OTHER PUBLICATIONS

"Portion" The Free Dictionary by Farlex. Web. https://www.thefreedictionary.com/portion.*

(Continued)

*Primary Examiner* — Jillian K Pierorazio

(57) ABSTRACT

A protective clothing device having an article of clothing having an inner layer and/or an outer layer is disclosed. The protective clothing device may have thin force absorbing members coupled to the inner layer or outer layer of the article of clothing. The force absorbing members can have overlapping or interlaced portions for enhanced protection even when the protective clothing device expands. In one embodiment, the protective clothing device may be a protective hat. In another embodiment, the protective clothing device may be a headband.

22 Claims, 34 Drawing Sheets

(56) References Cited

U.S. PATENT DOCUMENTS

| | | | | |
|---|---|---|---|---|
| 6,298,497 | B1 * | 10/2001 | Chartrand | A42B 3/12 2/414 |
| 6,418,564 | B1 * | 7/2002 | Sheridan | A42B 3/0486 2/410 |
| 7,650,648 | B2 | 1/2010 | Roberts | |
| 7,937,778 | B1 | 5/2011 | Norton | |
| 9,743,704 | B2 * | 8/2017 | Woolf | A42B 3/322 |
| 10,165,807 | B2 | 1/2019 | Yeung et al. | |
| 2002/0023290 | A1 * | 2/2002 | Watters | A42B 3/08 2/410 |
| 2003/0046747 | A1 | 3/2003 | Berns | |
| 2008/0040831 | A1 | 2/2008 | Nilforushan et al. | |
| 2008/0307569 | A1 | 12/2008 | Roberts | |
| 2009/0222976 | A1 * | 9/2009 | Loury | A42B 3/322 2/411 |
| 2010/0306904 | A1 * | 12/2010 | Neid | A42B 1/08 2/414 |
| 2012/0167284 | A1 * | 7/2012 | Yeung | A41D 13/0593 2/411 |
| 2012/0216338 | A1 * | 8/2012 | Arrouart | A42B 3/322 2/410 |
| 2013/0000017 | A1 * | 1/2013 | Szalkowski | A42B 3/127 2/414 |
| 2014/0259327 | A1 * | 9/2014 | Demarest | A63B 71/1225 2/455 |
| 2014/0359911 | A1 * | 12/2014 | Strum | F41H 1/04 2/2.5 |
| 2015/0157081 | A1 * | 6/2015 | Hyman | A42C 2/007 2/413 |
| 2018/0055104 | A1 | 3/2018 | Yeung et al. | |
| 2018/0055126 | A1 | 3/2018 | Yeung et al. | |
| 2019/0021415 | A1 | 1/2019 | Yeung et al. | |

OTHER PUBLICATIONS

"Brainwear for Smart People", Yakkay, www.yakkay com, downloaded Dec. 31, 2010, 2 pgs.
Rogers, "Non-Dorky Bicycle Helmets: Brainwear for Smart People", http://earthfirst.com/non-dorky-helmets-brainwear-for-smart-people, downloaded Dec. 31, 2010, 8 pgs.
Doctorow, "Bike Helmets that Look Like Hats", http://boingboing.net/2008/08/14/bick-helments-that-lo.html, downloaded Dec. 31, 2010, 36 pgs.
"Silicone Foam Tube", www.tootoo.com/d-rp23717631-silicone_foam_tube, downloaded Jan. 21, 2010, 4 pgs.
"Polyurethane Foam|Ridge Foam|Closed Cell Foam", http://pleiger.com/foam.html, downloaded Jan. 21, 2010, 4 pgs.
"Bella Reversible Baby Beanie Hats", www.bella.com/baby-beanies.html, downloaded Jan. 18, 2010, 1 pg.
"Baby's 1st Head Gear—Accidental Head Injury in Baby", www.babysfirstheadgear.com/product.htm, downloaded Jan. 18, 2010, 2 pgs.
"Learning to Walk—Product Info", www.thudgard.com/producet-info, downloaded Jan. 18, 2010, 3 pgs.
Restriction requirement for US. Appl. No. 13/342,872, dated Jun. 21, 2013.
"Miguel Caballero Bulletproof Attire", www.miguelcaballerousa.com, downloaded Feb. 14, 2010, 1 pg.
Office action for U.S. Appl. No. 13/342,872, dated Aug. 6, 2013.
Final Office Action for U.S. Appl. No. 13/342,872, dated Nov. 20, 2013.
Advisory Action for U.S. Appl. No. 13/342,872, dated Feb. 14, 2014.
Office action for U.S. Appl. No. 13/342,872, dated Apr. 10, 2014.
Final Office Action for U.S. Appl. No. 13/342,872, dated Jul. 31, 2014.
Advisory Action for U.S. Appl. No. 13/342,872, dated Sep. 12, 2014.
Office Action for U.S. Appl. No. 13/342,872, dated Nov. 5, 2014.
Final Office Action for U.S. Appl. No. 13/342,872, dated Apr. 17, 2015.
Advisory Action for U.S. Appl. No. 13/342,872, dated Apr. 17, 2015.
Office Action for U.S. Appl. No. 13/342,872, dated Sep. 30, 2015.
Final Office Action for U.S. Appl. No. 13/342,872, dated Apr. 29, 2016.
Applicant's appeal Brief for U.S. Appl. No. 13/342,872, dated Nov. 28, 2016.
Examiner's Answer to Appeal Brief for U.S. Appl. No. 13/342,872, dated Dec. 23, 2016.
Patent Board Decision—Examiner Reversed for U.S. Appl. No. 13/342,872, dated Jul. 12, 2018.
Notice of Allowance for U.S. Appl. No. 13/342,872, dated Aug. 1, 2018.
Final Office Action for U.S. Appl. No. 15/693,458, dated Apr. 8, 2020.
"Adjacent" The Free Dictionary by Farlex. Web. https://thefreedictionary.com/adjacent.
"Portion" The Free Dictionary by Farlex. Web. https://thefreedictionary.com/portion.
Final Office Action for U.S. Appl. No. 15/693,455, dated Apr. 29, 2020.

* cited by examiner

CONFORMAL PROTECTIVE HEAD WEAR

CROSS-REFERENCE TO RELATED APPLICATIONS

This application claims priority to U.S. Provisional Patent Application No. 62/540,039, filed Aug. 1, 2017, entitled "CONFORMAL PROTECTIVE HAT," which is herein incorporated by reference.

This application also claims priority to U.S. Provisional Patent Application No. 62/382,727, filed Sep. 1, 2016, entitled "CONFORMAL PROTECTIVE HAT," which is herein incorporated by reference.

BACKGROUND OF THE INVENTION

Description of the Related Art

Clothing generally serves to cover the user's body, protecting their skin from the weather. Additionally, clothing serves to keep the user warm. Clothing is generally made from cotton, polyester, denim, rayon, or some combination of those members. Clothing is generally ranges from light weight for hotter climates to heavy for colder climates. Heavier clothing serves to keep the user warmer in the colder climate. It is heavier due to more layers of cloth, down filling, or insulating thermal member.

Hats are a type of clothing that cover a user's head. They are usually fashionable or aesthetically pleasing to the individual. Hats come in many different varieties depending upon the functionality or intended use. Baseball caps, baby caps, beanies, sun visors, are a few of the different varieties. Generally, hats are meant to either conserve the user's heat by keeping them warm, protecting the user from the sun, or to complete a fashionable outfit.

Helmets are a type of head protection device that are less fashionable and more functional. Helmets usually are obtuse, have a hard coated outside with a large foam inside with additional padding to shape to the user head. Helmets generally are used by the user to protect the head from hard impacts sustained during the use of a motorized vehicle, bicycle, skydiving, or any other dangerous activity that jeopardizes the head. These helmets focus on protection for extreme activities, rather than style or everyday use.

SUMMARY

A body protection device with a clothing component that appears as a regular item of clothing but which further includes one or more protective components is disclosed. As one example, the body protection device can be a protective clothing device that includes force absorbing members coupled thereto. The force absorbing members can have overlapping or interlacing portions for enhanced protection even when the protective clothing device expands. In one embodiment, the protective clothing device may be a protective hat. In another embodiment, the protective clothing device may be a protective headband.

The invention can be implemented in numerous ways, including as a method, device or apparatus. Several embodiments of the invention are discussed below.

As a protective hat, one embodiment can, for example, include at least a fabric covering having at least an exterior surface, and a plurality of force absorbing members provided internal to the fabric covering. The plurality of force absorbing members can include at least a first force absorbing member and a second force absorbing member. The first force absorbing member can have a least a first side with a first set of extensions that extend outward, and the second force absorbing member can have a least a second side with a second set of extensions that extend outward. The first side of the first force absorbing member can be adjacent the second side of the second force absorbing member, and the first set of extensions can be interlaced with the second set of extensions.

In one embodiment, the protective hat has an expanded configuration and an unexpanded configuration. The first set of extensions can be substantially fully interlaced with the second set of extensions when in the unexpanded configuration, and the first set of extensions can be only partially interlaced with the second set of extensions when in the expanded configuration.

As a protective hat, another embodiment can, for example, include at least a fabric covering having at least an exterior surface, and a plurality of force absorbing members provided internal to the fabric covering. The plurality of force absorbing members can include at least a first force absorbing member and a second force absorbing member. The protective hat can have an expanded configuration and an unexpanded configuration. The first force absorbing member has a least a first side, and the second force absorbing member has a least a second side. The first side of the first force absorbing member is adjacent the second side of the second force absorbing member. The first side of the first force absorbing member can be at least partially overlapping with the second side of the second force absorbing member when in the unexpanded configuration.

As a protective hat, another embodiment can, for example, include at least a fabric covering having at least an exterior surface, and a pattern of force absorbing members secured to or within the fabric covering. The pattern can permit expansion in at least one direction, and with expansion in the at least one direction, the force absorbing members can remain at least partially overlapping in at least another direction.

A protective hat can, for example, include at least a fabric covering having at least an exterior surface, and a pattern of force absorbing members secured to the fabric covering. The pattern can permit expansion when being worn by a user, and, while expanded, the force absorbing members remain at least partially interlaced.

As a protective hat, another embodiment can, for example, include at least a fabric covering having at least a plurality of openings provided between layers of material, at least one of the layers of materials providing an exterior surface for the protective hat; and a plurality of force absorbing members provided internal to the openings within the fabric covering, each of the plurality of force absorbing members including a triangle-shaped force absorbing member. Each of the force absorbing members can have a thickness of approximately 1 to 5 mm.

As a protective hat, another embodiment can, for example, include at least: a fabric covering having at least first, second and third openings provided between layers of material, at least one of the layers of materials providing an exterior surface for the protective hat; a first force absorbing member provided internal to the first opening within the fabric covering; a second force absorbing member provided internal to the second opening within the fabric covering; and a third force absorbing member provided internal to the third opening within the fabric covering. Each of the force absorbing members can, for example, comprises polyurethane foam and can haves a thickness of approximately 1 to 5 mm.

As a protective hat, another embodiment can, for example, include at least: a fabric covering having at least first, second and third enclosures formed between layers of material, at least one of the layers of materials providing an exterior surface for the protective hat; a first force absorbing member provided internal to the first enclosure within the fabric covering; a second force absorbing member provided internal to the second enclosure within the fabric covering; and a third force absorbing member provided internal to the third enclosure within the fabric covering. Each of the force absorbing members can, for example, comprise polyurethane foam and has a thickness of approximately 1 to 5 mm.

As a protective hat, another embodiment can, for example, include at least a fabric covering having layers of material at least one of the layers of materials providing an exterior surface for the protective hat; and a plurality of force absorbing materials being positioned at distinct locations about the protective hat and being secured relative to the protective hat where positioned. Each of the force absorbing members can, for example, comprise polyurethane foam and has a thickness of approximately 1 to 5 mm.

As a protective headband, one embodiment can, for example, include at least a fabric covering having layers of material at least one of the layers of materials providing an exterior surface for the protective headband; and a plurality of force absorbing materials being positioned at distinct locations about the protective headband. Each of the force absorbing members can, for example, comprise polyurethane foam and has a thickness of approximately 1 to 5 mm.

As a protective headband, one embodiment can, for example, include at least at least one force absorbing member being positioned about the protective headband; and a fabric covering provided over and covering the at least one force absorbing member. The at least one force absorbing member comprises urethane foam and has a thickness of approximately 1 to 5 mm.

The invention can also be implemented as other articles of clothing designed to form the protective clothing device, as well as other methods of coupling thin protective member(s) to articles of clothing. These and other features will be presented in more detail in the following detailed description of the invention and the associated figures.

Other aspects and advantages of embodiments of the invention will become apparent from the following detailed description taken in conjunction with the accompanying drawings which illustrate, by way of example, the principles of the invention.

BRIEF DESCRIPTION OF THE DRAWINGS

The accompanying drawings, which are incorporated into and constitute a part of this specification, illustrate one or more example embodiments and, together with the description of example embodiments, serve to explain principles and implementations. The drawings are for illustration and are not necessarily drawn to scale.

In the drawings.

DETAILED DESCRIPTION OF EMBODIMENTS OF THE INVENTION

Embodiments of the invention are discussed below with reference to FIGS. 1-18K. However, those skilled in the art will readily appreciate that the detailed description given herein with respect to these figures is for explanatory purposes as the invention extends beyond these limited embodiments.

The invention relates to a body protection device having a clothing component and one or more protective components provided with the clothing component. The protective components provide protection to a wearer of the clothing component.

The body protection device can appear as a regular item of clothing but which further includes one or more protective components. As one example, the body protection device can be a protective clothing device that includes force absorbing members coupled thereto. In one embodiment, the protective clothing device may be a protective hat. In another embodiment, the protective clothing device may be a headband.

In some embodiments, the protective components can be configured to permit expansion while also providing impact protection at expansion regions. The force absorbing members can have overlapping or interlacing portions for enhanced protection even when the protective clothing device expands.

Advantageously, the protective components are substantially hidden so that the clothing component looks to others like a regular item of clothing. In one embodiment, the clothing component is a hat having at least one force absorbing member coupled to the interior surface or the exterior surface of the hat.

The body protection devices are useful to reduce concussive effects. In other words, the body protection devices, namely protective hats or headbands, can be worn by users and can thus serve to reduce concussions or concussion damage. It is known that concussion damage is the result of successive concussive impacts to a user's head. By wearing the body protection devices (namely, the protection hats), users are able to mitigate head trauma due to undesired impact to the users' heads due to falls, accidents, or bumps.

Figure 1:
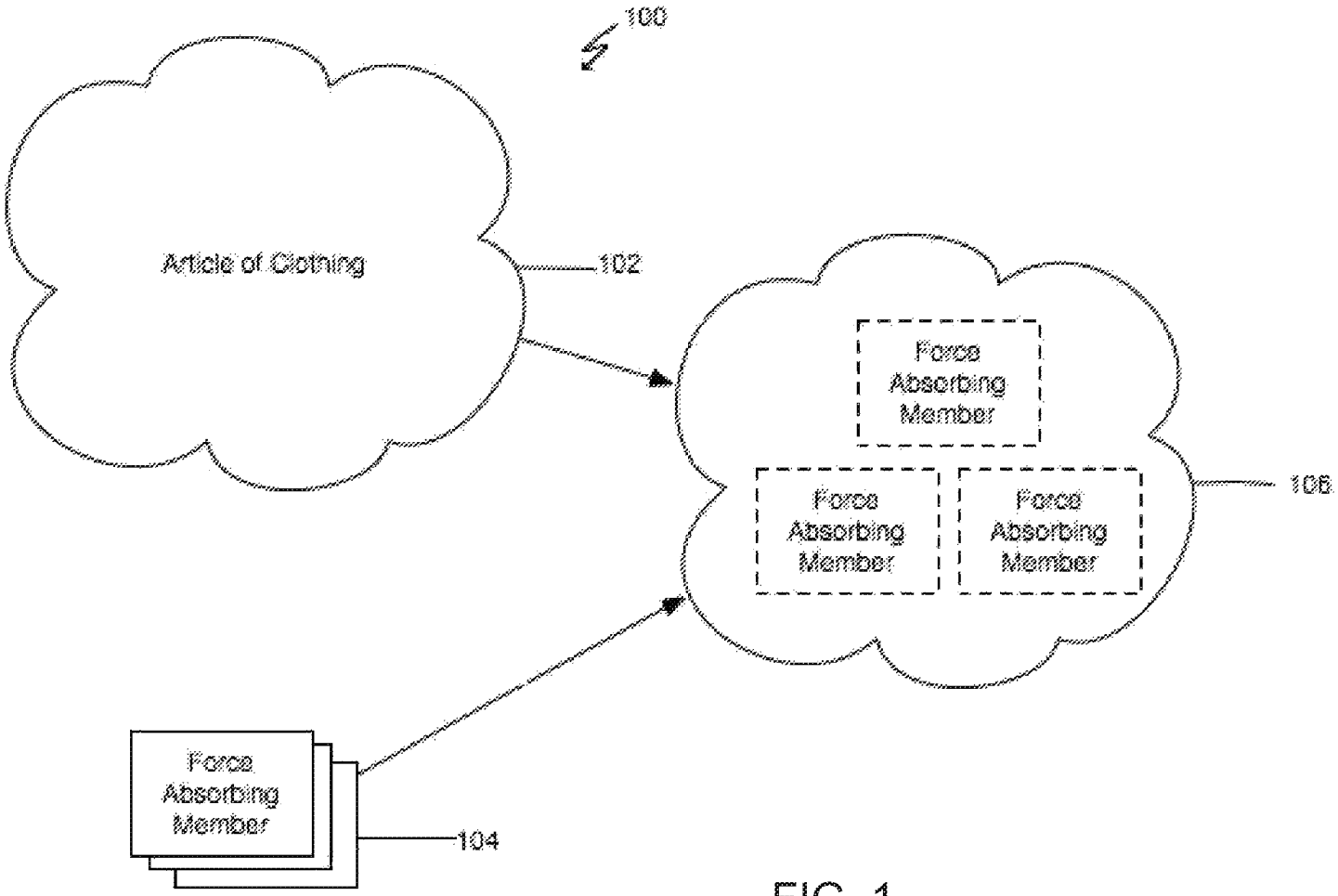
FIG. 1 illustrates a system for providing a body protection device according to one embodiment.

FIG. 1 illustrates a system 100 for providing a body protection device according to one embodiment. The body protection device can be an article of clothing and can thus be referred to as a protective clothing device. As shown in FIG. 1, the system 100 has an article of clothing 102 and one or more force absorbing members 104. The system 100 can then operate to secure the force absorbing members 104 to the article of clothing 102 to form a protective clothing device 106.

The article of clothing 102 may have an inner layer and an outer layer. The article of clothing 102 may be any known article of clothing such as a head gear (e.g., hat, headband), pair of pants, shirt, foot wear (e.g., sock) and the like. The article of clothing 102 may be made from a fabric material. The fabric material may be any woven material made from any material such as polyester, cotton, rayon, wool, spandex, plastic, and the like. The fabric material may be breathable, durable, stretchable, machine washable, and/or water resistant.

The thin force absorbing member 104 may be formed into a predetermined shape. The thin force absorbing material 104 may be formed in a uniform shape, such as a square, triangle, circle, rectangle, oval, star, trapezoid, and the like, or may be formed in an arbitrary or irregular shape. The at least one thin force absorbing material 104 may be selected from a group of high-density and elastic materials, such as elastomer, polyurethane foam, gel, silicone, and the like.

The thin force absorbing member 104 may be secured to the article of clothing 102 in any of a variety of different ways. Typically, for aesthetic reasons, the thin force absorbing material 102 may be coupled to the inner surface of the article of clothing so as to not be outwardly visible to others when the protective clothing device 106 is being worn. In one embodiment, the at least one thin force absorbing material 104 may be coupled between the inner surface and the outer surface of the article of clothing 102. In another embodiment, the protective clothing device 106 may include one or more enclosures that are configured to receive the thin force absorbing member 104. Each of the one or more enclosures may be designed to receive one or more of the at least one thin force absorbing members 104. The at least one thin force absorbing member 104 may be secured to or coupled to or between the inner surface and/or the outer surface of the article of clothing 102 via any known securing method such as sewn, adhesives, snaps, hook and loop fasteners, screws, and the like.

In one embodiment, the body protection device 106 is a protective head gear, such as a hat, headband, etc. For example, in one implementation, the body protective device 106 is a protective hat that includes force absorbing protection to the user of the protective hat.

Figure 2:
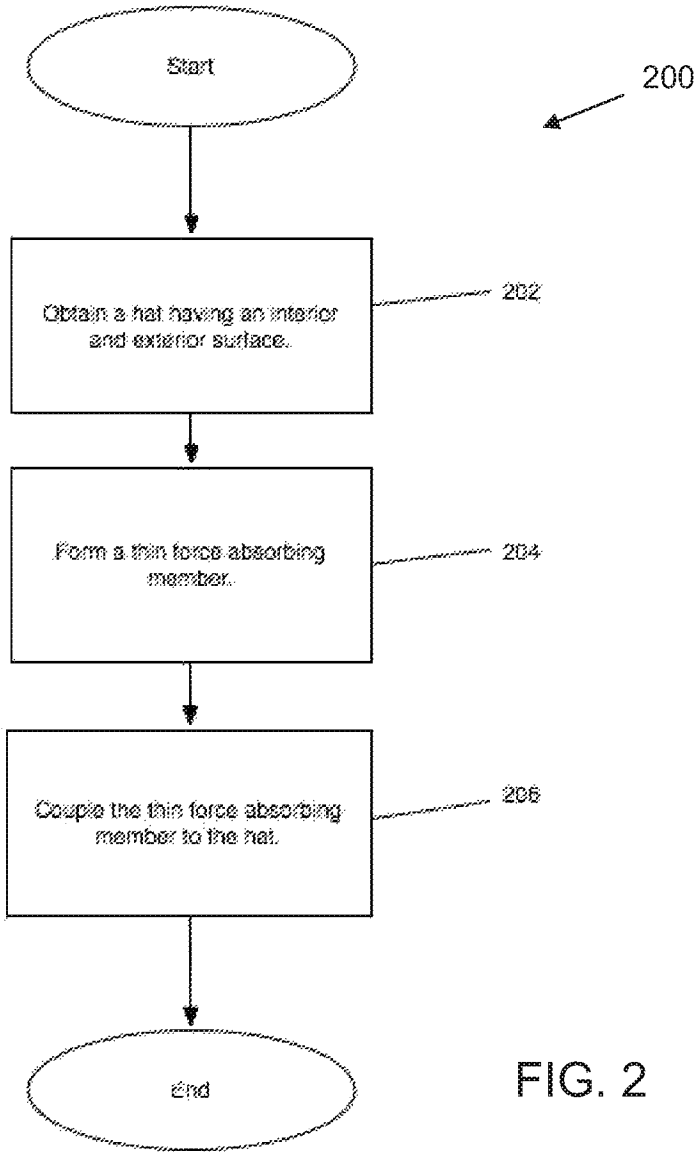
FIG. 2 illustrates one exemplary method for making a body protection device according to one embodiment.

FIG. 2 illustrates one example method 200 for making a protective hat according to one embodiment. The protective hat having an interior surface and an exterior surface is obtained at 202. The hat may be made from a fabric material. The hat may be any known hat such as a beanie, a knitted hat, woven hat, a cap, skullcap, and the like. The fabric material may be any woven material. The woven material may include one or more of polyester, cotton, rayon, wool, spandex, plastic, and the like. The fabric material may be breathable, durable, stretchable, machine washable, and/or water resistant.

A thin force absorbing member may be formed at 204. The thin force absorbing member may be at least one thin force absorbing member to be secured to the hat. The thin force absorbing member may be formed into a predetermined shape. In one embodiment, the thin force absorbing member may be formed in a uniform shape, such as a square, triangle, circle, rectangle, oval, star, trapezoid, etc. Examples of some uniform shapes are illustrated in FIG. 3. In another embodiment, the thin force absorbing member may have an arbitrary or custom shape, such as a mesh, shapes conforming to the configuration of the protective hat, combination of shapes (e.g., FIGS. 4 and 5). The thin force absorbing member can be molded (e.g., injection molded), stamped or cut from a sheet of force absorbing material, and the like. The thin force absorbing member can also be printed using a 3D printer.

The thin force absorbing member may be formed from any known material that has characteristics of elasticity, durability, high-density, flexibility, moldability and the like. In one embodiment, the at least one thin force absorbing member may be high-density and elastic material. In one implementation, the high-density and elastic material can be polyurethane foam which can be thin yet still offer substantial impact protection. In other implementations, other materials can be used so long as they provide sufficient impact protections, such materials can include one or more of elastomer, polyurethane foam, gel, silicone, and the like.

The thin force absorbing member may be coupled to the protective hat at 206. In some cases, there are multiple force absorbing members that are to be coupled to the protective hat. In other cases, there may be a single force absorbing member coupled to the protective hat.

In one embodiment, the thin force absorbing member can be coupled to an inner surface of the protective hat. In one embodiment, the thin force absorbing member may be coupled between the inner surface and the outer surface of the protective hat. The thin force absorbing material may be coupled between the inner surface and the outer surface of the protective hat via any known securing method such as sewn, adhesives, snaps, hook and loop fasteners, screws, and the like.

In another embodiment, the protective hat may have an enclosure between the inner surface and the exterior surface designed to receive the at least one thin force absorbing member. The thin force absorbing member may be inserted into the enclosure and secured within the enclosure by any known means such as the use of zippers, snaps, hook and look fasteners, and the like.

In yet another embodiment, the inner surface of fabric material may form a pocket with the outer surface of fabric material, so that the inner surface and the outer layer are configured to receive and conceal the at least one thin force absorbing material.

In still another embodiment, the at least one thin force absorbing member may be coupled to the outer surface of the protective hat via any known securing method such as by sewing, adhesives, snaps, hook and loop fasteners, screws, and the like.

The thin force absorbing member may have a thickness of approximately between 0.5 to 20 millimeters (mm). The thin force absorbing member can have a thickness that is generally uniform.

When multiple thin force absorbing members are used together, different ones of the thin force absorbing members can have a different thickness and/or different configuration or shape. The thin force absorbing members can also have a non-uniform thickness. As one example, the thin force absorbing members can be tapered at some or all of its edges so that the edges are thinner than other portions of the thin force absorbing members. As another example, the thin force absorbing members can be chamfered at one or more of its edges. As another example, the thin force absorbing members can be rounded at one or more of its edges.

The thin force absorbing members can also be interlacing, overlapping or interlocking. For example, adjacent thin force absorbing members can include overlapping or interlocking portions. In one embodiment, adjacent sides of the thin force absorbing members can include extended portions or features that can be arranged to interlock or overlap. Advantageously, the interlacing, overlapping or interlocking portions permit the protective hat to expand, such as while being worn, yet still offer protection in areas where expansion occurs.

Figure 3B:
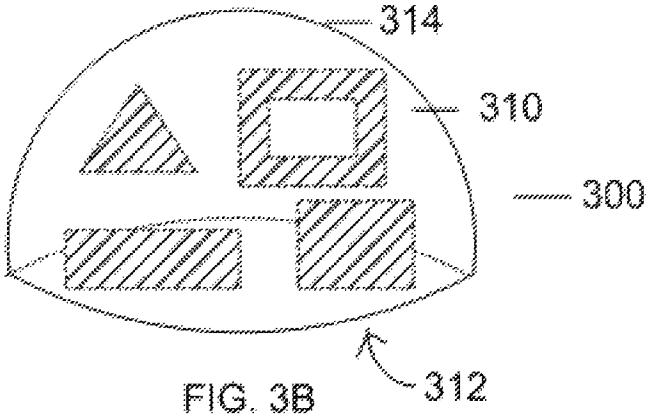
FIGS. 3A-3F illustrates a body protection device according to one embodiment.
Figure 3A:
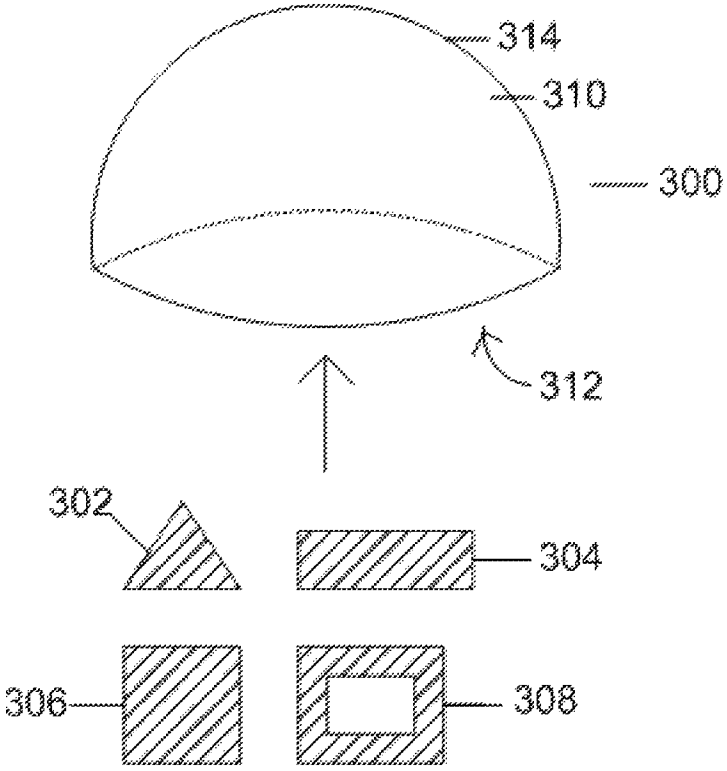

FIGS. 3A-3F illustrate embodiments of a body protection device. FIGS. 3A-3B illustrates a protective hat 300 according to one embodiment. The protective hat 300 may have a plurality of thin force absorbing materials 302, 304, 306, 308. Each of the plurality of thin force absorbing materials 302, 304, 306, 308 may be formed of different shapes. The protective hat 300 may be formed by coupling the plurality of thin force absorbing materials 302, 304, 306, 308 to fabric 310.

The protective hat 300 may have an interior surface 312 and an exterior surface 314. The protective hat 300 may be any known hat such as a beanie, a knitted hat, woven hat, a cap, skullcap, and the like. The fabric 310 may be formed from any woven fabric material such as polyester, cotton, rayon, wool, spandex, plastic, any combination of the above, and the like. The fabric material may be breathable, durable, stretchable, machine washable, water resistant, or any combination of characteristics.

In one embodiment, the protective hat 310 may be construed to fully enclose the thin force absorbing member 302, 304, 306, 308, thus concealing the thin force absorbing member 302, 304, 306, 308 from view. This feature may encourage style minded persons or young children to wear the protective hat 300 because it has a more fashionable looking than a regular safety helmet.

Any number, size or assembly may be utilized in the construction of the thin force absorbing member 302, 304, 306, 308, so long as the thin force absorbing member adequately protect the user's head from injuries caused by falls against hard objects. In one embodiment, the plurality of the thin force absorbing member 302, 304, 306, 308 may be positioned such that they cover multiple portions of the protective hat 300.

The thin force absorbing member 302, 304, 306, 308 may have various thicknesses. In one embodiment, the thin force absorbing member 302, 304, 306, 308 may have a thickness of approximately 0.5 to 20 millimeters (mm). In another embodiment, the thin force absorbing member 302, 304, 306, 308 may have a thickness of approximately 0.5 to 10 mm. In still another embodiment, the thin force absorbing member 302, 304, 306, 308 may have a thickness of approximately 1 to 5 mm. In another example, the thickness of the thin force absorbing member 302, 304, 306, 308 may be gradient between 0.5 to 20 millimeters (mm). In another example, the thickness of the thin force absorbing material 302, 304, 306, 308 may be the same for each or may be different or may even vary within a given force absorbing member.

The thin force absorbing member 302, 304, 306, 308 may be made from a malleable, elastomeric, durable, pliable material, or a material with any combination of these characteristics. The thin force absorbing member 302, 304, 306, 308 may be any material such as elastomer, polyurethane foam, gel, silicone, and the like.

In one embodiment, the thin force absorbing member 302, 304, 306, 308 are formed of polyurethane foam of 0.5-5 mm thickness which is light weight while still providing significant impact absorption.

The thin force absorbing member 302, 304, 306, 308 may be formed in any shape. In one embodiment, the thin force absorbing member 302, 304, 306, 308 may be formed in a triangle 302, rectangle 304, square 306, hollow rectangle 308, or circle, oval, star, trapezoid, and the like. The thin force absorbing member 302, 304, 306, 308 may also be cylindrical, spherical, conic, and the like. In another embodiment, the thin force absorbing member 302, 304, 306, 308 may be formed in the shape of a gradient wedge.

FIG. 3B illustrates a protective hat 300 according to one embodiment. As illustrated in FIG. 3B, each of the plurality of individual thin force absorbing members 302, 304, 306, 308 may be separately secured to the fabric covering. In another example, such as FIG. 6, the plurality of thin force absorbing material 602 may be interconnected, as opposed to being individually positioned relative to the hat. Still, in another example, the protective hat may comprise a combination of interconnected thin force absorbing material and individual thin force absorbing material.

In one embodiment, the thin force absorbing member 302, 304, 306, 308 may be removably coupled to the hat for versatility. Still, in another embodiment, the thin force absorbing member may have a plurality of openings designed to facilitate ventilation (i.e., the air passage) which can reduce retention of heat while being worn (e.g., FIG. 10E).

In another embodiment, the at least one thin force absorbing member 302, 304, 306, 308 may be coupled between the inner surface 312 and the outer surface 314 of the protective hat 310. The at least one thin force absorbing member 302, 304, 306, 308 may be coupled between the inner surface 312 and the outer surface 314 of the hat 300 via any known securing method such as by sewing, the use of adhesives, snaps, hook and loop fasteners, screws, and the like. The at least one thin force absorbing member 302, 304, 306, 308 may be coupled between the inner surface 312 and the outer surface 314 of the hat 300 yet remaining "floating" therein.

In one embodiment, the force absorbing material, such as the thin force absorbing members can be formed from any number of different shapes. The force absorbing material being used in a given body protection device can be provided as a plurality of force absorbing member that can vary in shape, thickness and size. The shapes can be traditional, non-traditional or arbitrary. The shapes can also participate in providing an ornamental design to the given body protection device.

Figure 3C:
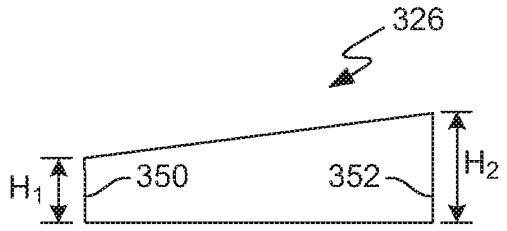
Figure 3D:
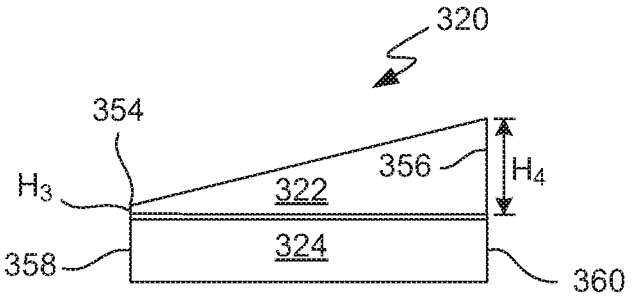
Figure 3E:
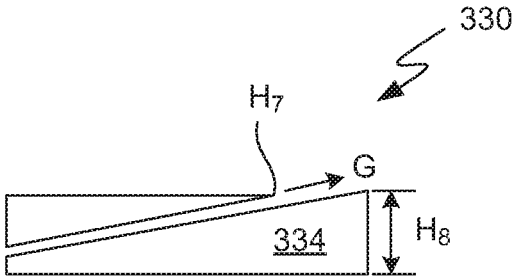

FIGS. 3C-3E illustrate embodiments of a thin force absorbing member, such as the thin force absorbing member 302, 304, 306, and 308.

Referring to FIG. 3C, a thin force absorbing member 326 may be formed as a gradient having one end smaller in length than a second end. In other words, one end is thicker than an opposing end. The thin force absorbing member 326 may have a first end 350 and a second end 352. The first end 350 may have a height of $H_1$ and the second end may have a height of $H_2$. Height $H_1$ may have a thickness that is less than the thickness of height $H_2$. In other words, in this embodiment, the first end 350 is thinner than the second end 352.

FIG. 3D illustrates a thin force absorbing member 320 according to one embodiment. The thin force absorbing member 320 may be formed from two pieces of material, a first thin force absorbing member 322 and a second thin force absorbing member 324. The first thin force absorbing member 322 may be positioned above the second thin force absorbing member 324 such that the first thin force absorbing member 322 is coupled to or positioned above the second thin force absorbing member 324 to form the thin force absorbing member 320. The first thin force absorbing member 322 may be similar to thin force absorbing member 326 shown in FIG. 3C. The first thin force absorbing member 322 may be formed as a gradient having one end smaller in length than a second end. In other words, one end is thicker than an opposing end. The first thin force absorbing member 322 may have a first end 354 and a second end 356. The first end 354 may have a first height of $H_3$ and the second end 356 may have a height of $H_4$. Height $H_4$ may have a thickness that is less than the thickness of height $H_3$. In other words, in this embodiment, the first end 354 is thinner than the second end 356.

The second thin force absorbing member 324 may not have a gradient such that a first end 358 has a same thickness as second end 360. The first thin force absorbing member 322 may be coupled to the second thin force absorbing member 324 by any known means such as the use of adhesives, bonding, hook and loop fasteners, and the like. In another embodiment, the first thin force absorbing member 322 may be coupled to the second thin force absorbing member 324 without the use of adhesives and is coupled to each other when the first thin force absorbing member 322 glides or slides over the second thin force absorbing member 324.

Figure 3F:
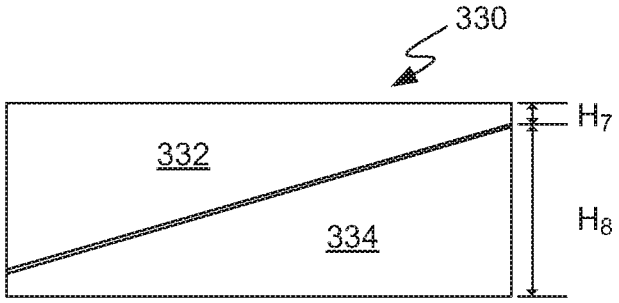

FIGS. 3E and 3F illustrate a thin force absorbing member 330 according to another embodiment. The thin force absorbing member 330 may be formed from two pieces of material, a first thin force absorbing member 332 and a second thin force absorbing member 334. The first thin force absorbing member 332 may be coupled to or positioned above the second thin force absorbing member 334 such that the first thin force absorbing member 332 is able to be stacked above the second thin force absorbing member 334 to form a combined thin force absorbing member 330. The first thin force absorbing member 332 and the second thin force absorbing member 334 may, in one embodiment, both have a gradient similar to the thin force absorbing member 326 illustrated in FIG. 3C. The first thin force absorbing member 332 and the second thin force absorbing member 334 may each both have one end smaller in thickness (i.e., height) than a second end. In other words, one end is thicker than an opposing end.

As illustrated in FIG. 3E, the first thin force absorbing member 332 may be positioned such that it may easily be slid over the second thin force absorbing member 334. This may occur when used within an article of clothing (e.g., hat that expands when being worn). A thin end $H_7$ of the first thin force absorbing member 332 may be slid up to a thick end $H_8$ of the second thin force absorbing member 334. When mated, a thick end $H_9$ of the first thin force absorbing member 332 may be positioned over a thin end $H_{10}$ of the second thin force absorbing member 334 and the thin end $H_7$ may be positioned over the thick end $H_8$. In this embodiment, the overlap can be referred to as a z-axis overlap, where the surface of an article of clothing forms an x-y plane. That is, the overlap in this embodiment serves to increase combined thickness of force absorption material and thus increase force absorption.

The first thin force absorbing member 332 may, but need not, be coupled to the second thin force absorbing member 334. However, if the first thin force absorbing member 332 is coupled to the second thin force absorbing member 334, the first thin force absorbing member 332 may be coupled to second thin force absorbing member 334 by any known means such as the use of adhesives, bonding, hook and loop fasteners, and the like. In another embodiment, the first thin force absorbing member 332 may be coupled to the second thin force absorbing member 334 without the use of adhesives and is coupled to each other when the first thin force absorbing member 332 glides or slides over the second thin force absorbing member 334.

Figure 4:
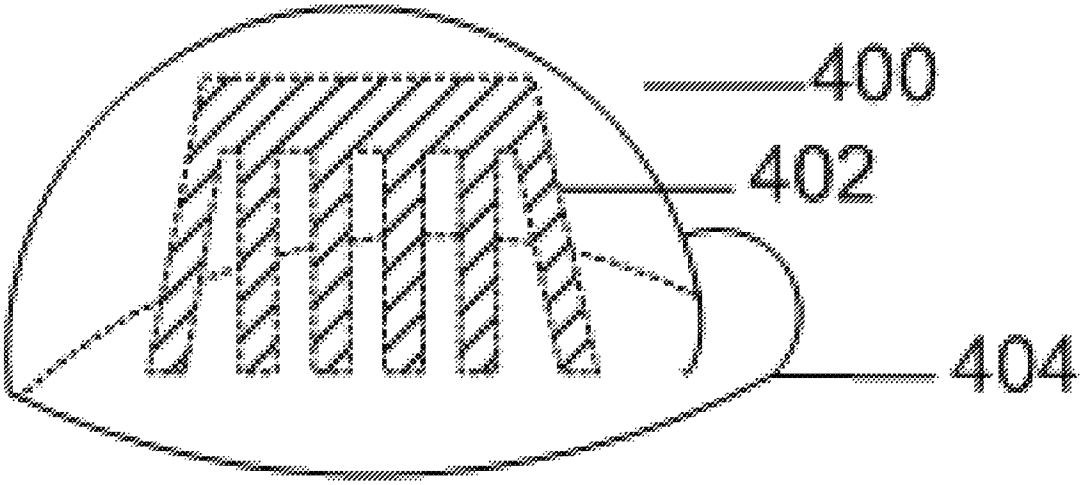
FIG. 4 illustrates one embodiment of a protective hat.

FIG. 4 illustrates one embodiment of a protective hat 400. Referring to FIG. 4, in one embodiment, the protective hat 400 may have a plurality of thin force absorbing materials formed as strips 402. The strips 402 can be separate members or can be commonly joined at a common base. The common base, if provided, offers possibly easier coupling of the strips 402 to the protective hat 400. In one embodiment, the protective hat 400 may have a projecting front brim 404. The projecting front brim 404 may shield the user from direct sunlight or rain.

Figure 5A:
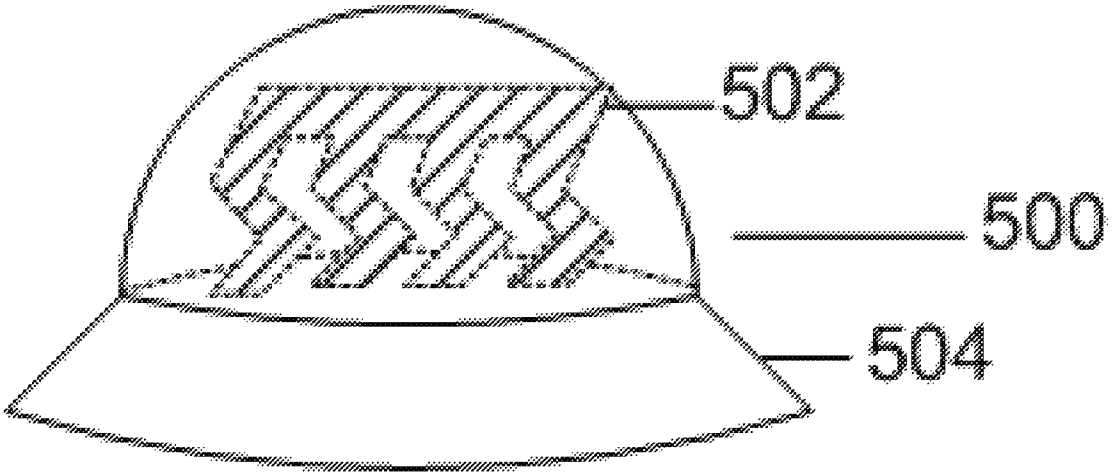
FIGS. 5A-5C illustrate another embodiment of a body protection device.
Figure 5B:
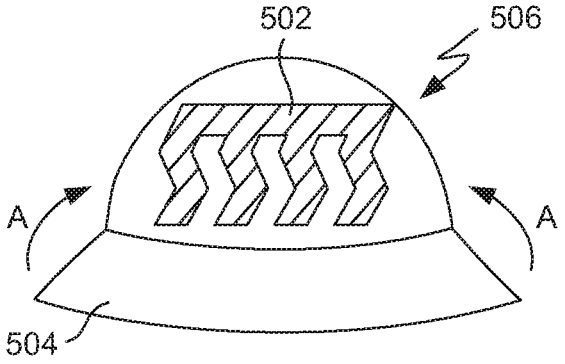
Figure 5C:
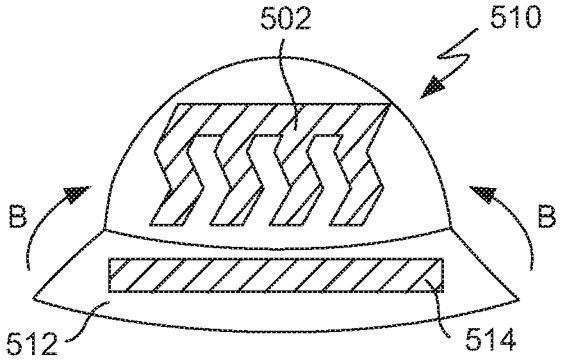

FIGS. 5A-5C illustrate another embodiment of a body protection device. FIG. 5A illustrates a body protection device in the form of a protective hat 500. In one embodiment, the protective hat 500 may have a plurality of thin force absorbing materials formed of bent-shaped members 502. The bent-shaped members 502 can be separate members or can be commonly joined at a common base. The common base, if provided, may assist in the coupling of the bent-shaped members 502 to the protective hat 500. In one embodiment, the protective hat 500 may have a downwards brim 504.

FIG. 5B illustrates the body protection device of FIG. 5A having at least one thin force absorbing member 508 on the brim 504 of a protective hat 506. The at least one thin force absorbing member 508 is illustrated as a long rectangular member. In one embodiment, the brim 504 may have several thin force absorbing members attached to the brim 504. In another embodiment, the thin force absorbing member 508 may be a single piece of material that continually surrounds the brim 504. In use, the brim 504 may be folded outward and upward on the protective hat 506 as illustrated by arrows A. When the protective hat 506 is worn, having the brim 504 folded provides extra protections for the user's head.

FIG. 5C illustrates another embodiment of a body protection device. The body protection device is illustrated as a protective hat 510. The protective hat 510 is similar to the protective hat 500 of FIG. 5A except that a bottom section 512 (e.g., brim) is narrower to fit closer to the user's head. In this embodiment, similar to the thin force absorbing member 508 illustrated in FIG. 5B, a thin force absorbing member 514 may be a long rectangular member. In one embodiment, the bottom section 512 may have several thin force absorbing members attached to the bottom section 514. In another embodiment, the thin force absorbing member 514 may be a single piece of material that continually surrounds the bottom section 512. In use, the bottom section 512 may be folded outward and upward on the protective hat 510 as illustrated by arrows B, or worn as illustrated without being folded. When the protective hat 510 is worn with the bottom section 504 folded, the protective hat 510 offers additional protection for the user's head that is adjacent the bottom section.

Figure 6A:
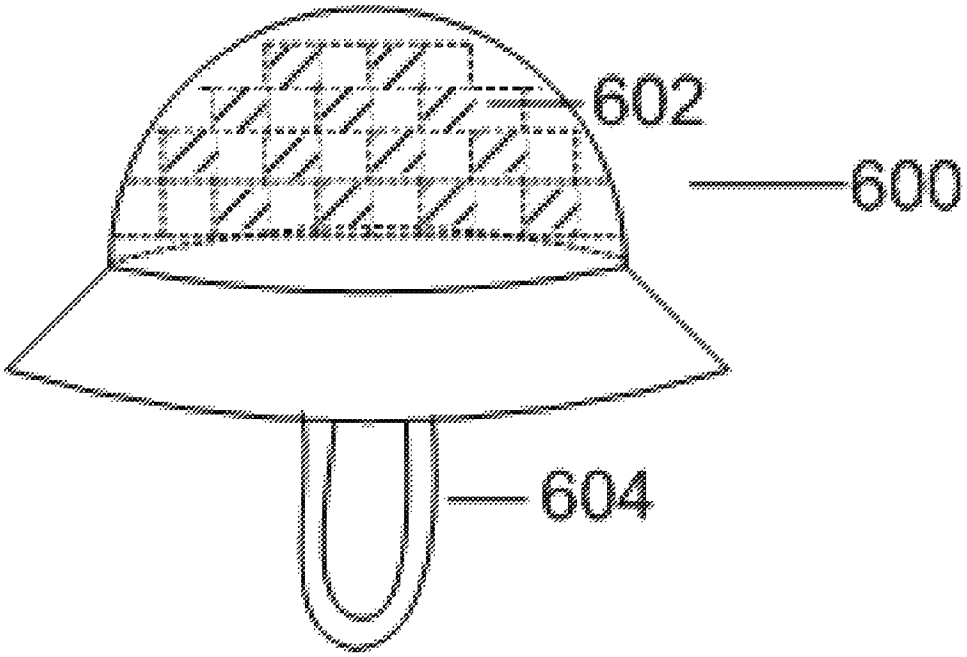
FIGS. 6A-6C illustrate still another embodiment of a body protection device.

FIG. 6A illustrates still another embodiment of a body protection device. FIG. 6A illustrates the body protection device in the form of a protective hat 600. In one embodiment, the protective hat 600 may have a plurality of thin force absorbing materials formed as a mesh 602. In other words, the thin force absorbing materials are overlapped or interlaced thereby having openings therebetween. The mesh 602 can provide a pattern for the force absorbing materials. The mesh 602 can provide good uniform coverage via force absorbing members for user protection while also providing ventilation. The mesh 602 may be a contiguous piece or may be a plurality of force absorbing members arranged in a mesh. The mesh 602 may vary in shape and size, so long as it provides both protection and comfort to the user's head.

In one embodiment, the protective hat 600 may have a chin strap 604 for securing the protective hat to the user. The chin strap 604 may be elastic and removable. The chin strap 604 may be formed from any woven fabric material such as polyester, cotton, rayon, wool, spandex, plastic, any combination of the above, and the like. The chin strap 604 may be coupled to the protective hat 600 via any known securing method such as sewn, the use of adhesives, snaps, hook and loop fastener, and the like.

Figure 6B:
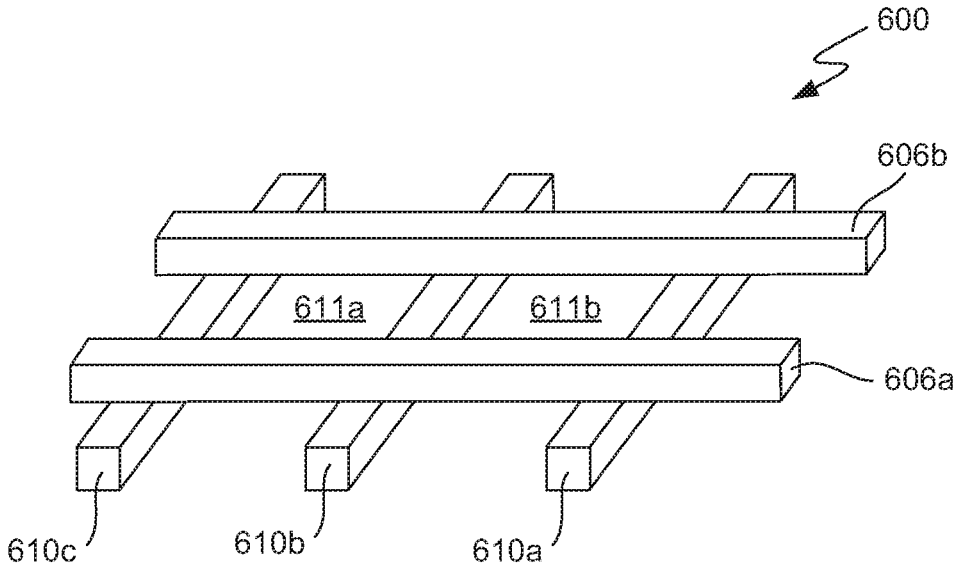
Figure 6C:
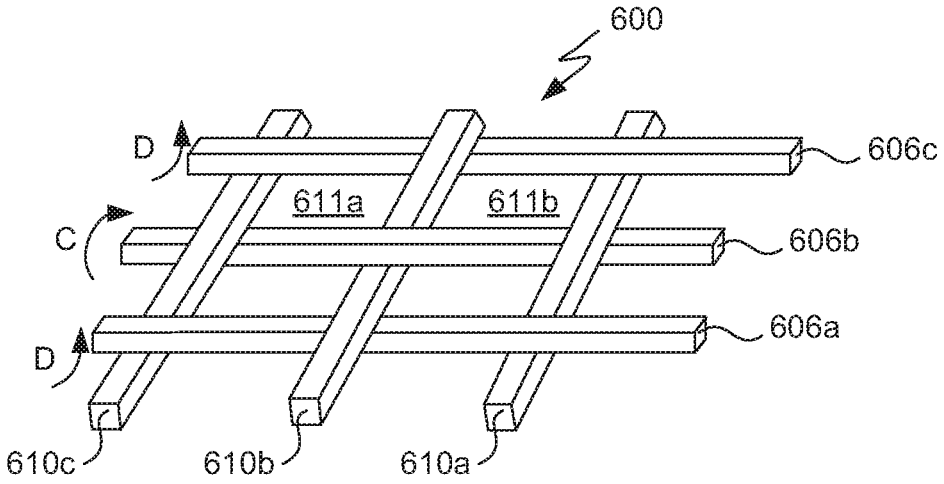

FIGS. 6B and 6C illustrates embodiments of arrangements of thin force absorbing materials. The arrangements shown in FIGS. 6B and 6C are suitable for use for the thin force absorbing material of FIG. 6A. In one embodiment, such as shown in FIG. 6B, the thin force absorbing materials may overlap each other to form the mesh 600. Vertical thin force absorbing members 610*a*, 610*b*, 610*c* may be overlapped by horizontal thin force absorbing members 606*a*, 606*b* to form a mesh. In another embodiment, as illustrated in FIG. 6C, vertical thin force absorbing members 606*a*, 606*b*, 606*c* may alternate and be underlapped (as illustrated by arrows D) and overlapped (as illustrated by arrows C) by horizontal thin force absorbing members 610*a*, 610*b*, 610*c* to form a mesh. In both embodiments illustrated in FIGS. 6B and 6C, the mesh allows for and forms openings 611*a*, 611*b* to provide for ventilation. As discussed above with reference to FIGS. 3C-3F, in one embodiment, the vertical thin force absorbing members 610*a*, 610*b*, 610*c* and/or the horizontal thin force absorbing members 606*a* 606*b*, 606*c* may have a gradient.

In some embodiments, the thin force absorbing members themselves can have a plurality of openings (or holes) for ventilation and/or weight reduction for the productive device. Also, the configuration of thin force absorbing members and/or the arrangement of thin force absorbing members on a body protection device, including spacing, gaps, positioning, etc., can contribute to ventilation and/or weight reduction.

Figure 7:
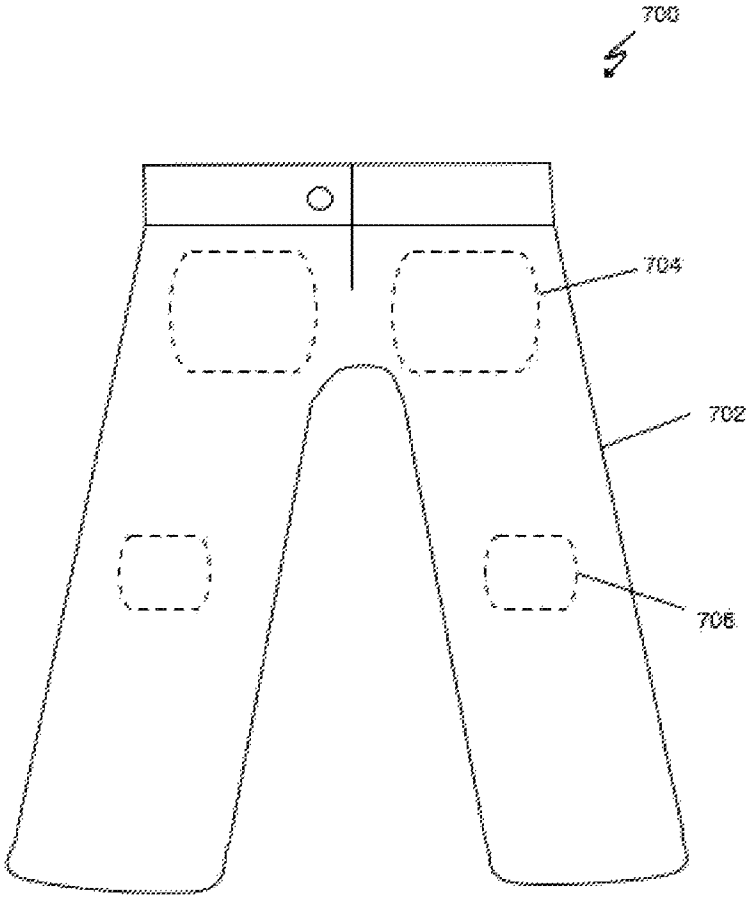
FIG. 7 illustrates one embodiment of a protective clothing device as a protective pair of pants.

FIG. 7 illustrates one embodiment of a protective clothing device as a protective pair of pants 700. The protective pair of pants 700 comprises a pair of pants 702 and at least one thin force absorbing member 704, 706.

The pair of pants 702 may be any known pair of pants such as denim jeans, khaki slacks, cotton, fleece, and the like. At least a portion of the pair of pants 702 may have an interior layer and an exterior layer. The pair of pants 702 may be made from a fabric material. The fabric material may be any woven material made from any material such as polyester, cotton, rayon, wool, spandex, plastic, and the like. The fabric material may be breathable, durable, stretchable, machine washable, or water resistant.

The at least one thin force absorbing member 704, 706 may be coupled to the pair of pants 702. The at least one thin force absorbing member 704, 706 may be coupled to any area of the pair of pants 702. For example, the at least one thin force absorbing member 706 may be coupled to the pair of pants to provide knee protection. As another example, the at least one thin force absorbing member 704 may be coupled to the pair the pants 702 to provide gluteus maximus protection. The at least one thin force absorbing member 704, 706 may be secured to the interior surface of the pair of pants 702 to form the protective pair of pants 700. In one embodiment, the at least one thin force absorbing member 704, 706 may be secured between the interior surface and the exterior surface of the pair of pants 702. The at least one thin force absorbing member 704, 706 may be coupled between the interior surface and the exterior surface of the pants via any known securing method. For example, the at least one thin force absorbing material 704, 706 may be coupled between the inner surface and the outer surface of the pair of pants 702 via any known securing method such as by stitching, adhesives, snaps, hook and loop fasteners, screws, and the like.

FIGS. 8A-8D illustrate some embodiments of protective clothing devices having low-profile force absorbing members coupled to articles of clothing.

Figure 8A:
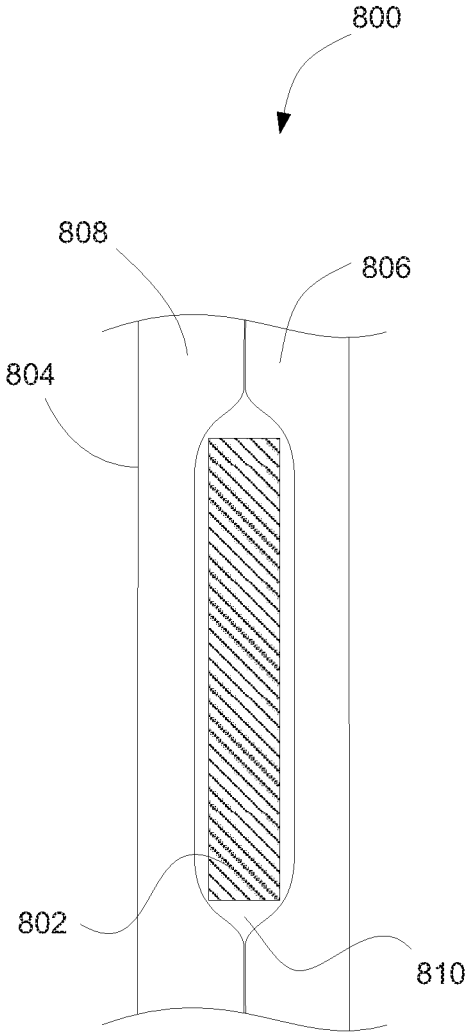
FIGS. 8A-8D illustrate some of the methods of coupling a thin force absorbing member to an article of clothing to form a protective clothing device.

FIG. 8A illustrates one arrangement 800 for coupling a thin force absorbing member 802 to an article of clothing 804, according to one embodiment. The article of clothing 804 may have an interior surface 806 and an exterior surface 808. The article of clothing 804 may have an opening 810 between the interior 806 and the exterior surface 808. The opening 810 may be designed to receive the thin force absorbing member 802, or the opening 810 may just be a space that can be interposed between the interior surface 806 and the exterior surface. The article of clothing 804 may be made from a fabric material. The opening 810 may be formed by obtaining an article of clothing, placing the thin force absorbing member 802 in or at the opening 810, and securing the thin force absorbing member 802 in place. The thin force absorbing member 802 may be secured within the opening 810 by any known securing method such as by sewing the thin force absorbing member between the interior surface 806 and the exterior surface 808 of the hat. Alternatively, the thin force absorbing materials can be secured to the article of clothing 804 through the use of adhesives, snaps, hook and loop fasteners, screws, and the like. The article of clothing 804 may be any known article of clothing such as a pair of pants, shirt, head gear (e.g., hat, headband), foot wear (e.g., sock), and the like. The fabric material may be any woven material made from any material such as any one or more of polyester, cotton, rayon, wool, spandex, plastic, and the like. The fabric material may be breathable, durable, stretchable, machine washable, and/or water resistant. In one embodiment, the opening 810 is an enclosure, and the thin force absorbing member 802 can be inserted into the enclosure. The enclosure can be formed between the interior surface 806 and the exterior surface 808 of the article of clothing 804.

Figure 8C:
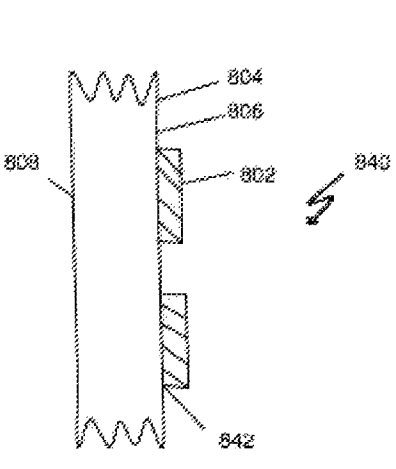
Figure 8B:
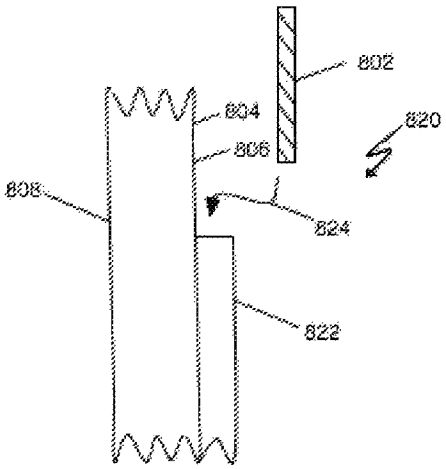

FIG. 8B illustrates one arrangement 820 for coupling a thin force absorbing member 802 to an article of clothing 804, according to another embodiment. The article of clothing 804 may have a sleeve 822 (or pocket) on the interior surface 806 (or in an alternative embodiment on the exterior surface 808 of the article of clothing 804). The sleeve 822 can be made from the same fabric material as the article of clothing 804. In one embodiment, the sleeve 822 may be configured to receive 824 the at least one thin force absorbing member 802. The sleeve 822 may be any known woven material made from any material such as any one or more of polyester, cotton, rayon, wool, spandex, plastic, and the like. The sleeve 822 may be coupled to the article of clothing 804 by any known securing method such as by stitches (sewn), adhesives, snaps, hook and loop fasteners, screws and the like. Once the thin force absorbing member 802 is inserted into the sleeve 822, the thin force absorbing member 802 may be secured within the sleeve 822 via any known securing method such as by sewing, adhesives, snaps, hook and loop fasteners, screws, and the like. The sleeve 822 may be configured to removably receive and conceal the thin force absorbing member 802, thus allowing easy removal or insertion of the thin force absorbing member 802 with respect to the sleeve 822.

FIG. 8C illustrates one arrangement 840 for coupling multiple thin force absorbing members 802, 842 to an article of clothing 804, according to another embodiment. The thin force absorbing members 802, 842 may be coupled to the interior surface 806 or the exterior surface 808 of the article of clothing 804. The thin force absorbing members 802, 842 may be secured to the interior surface 806 or the exterior surface 808 of the article of clothing 804 via any known securing method such as by stitches (sewn), adhesives, snaps, hook and loop fasteners, screws, and the like.

Figure 8D:
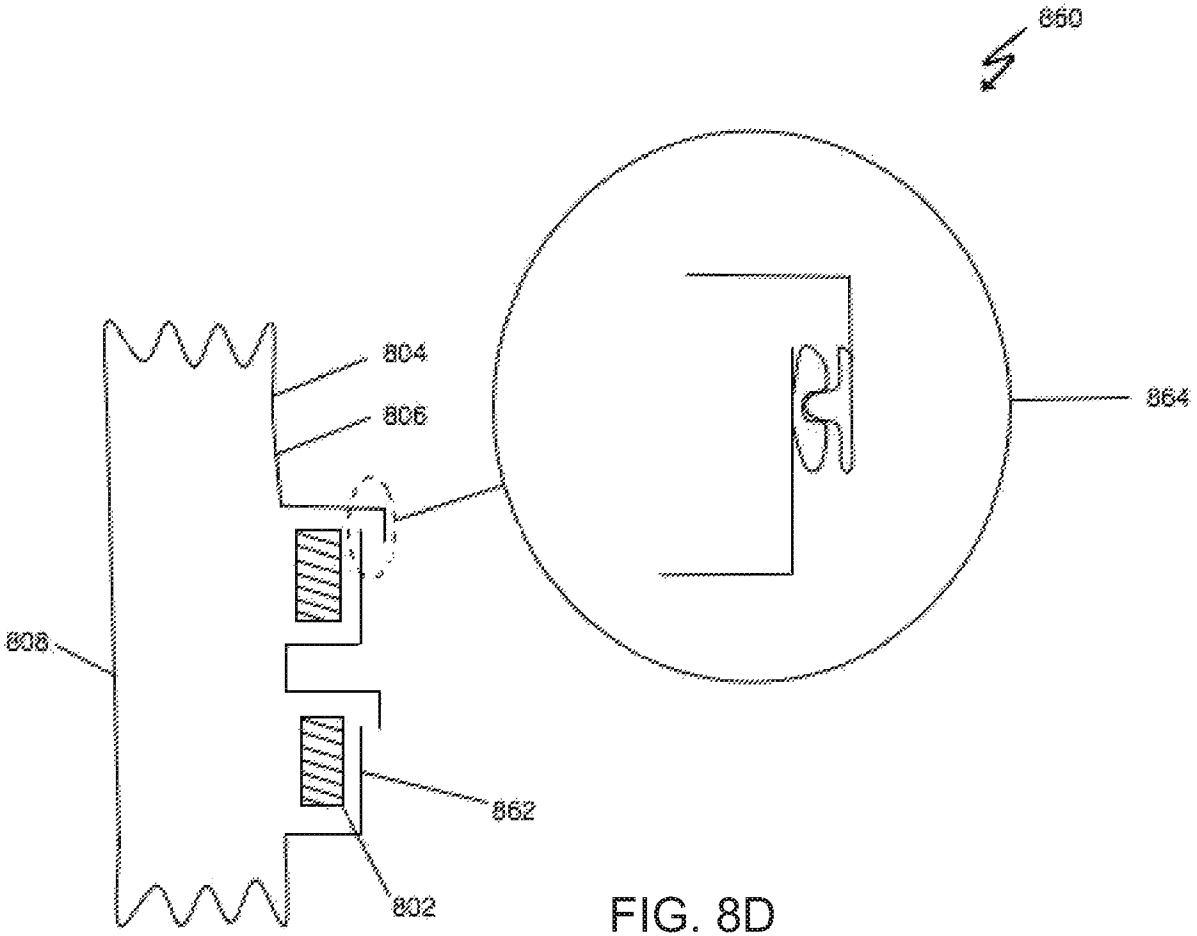

FIG. 8D illustrates one arrangement 860 for coupling a thin force absorbing member 802 to an article of clothing 804, according to another embodiment. The article of clothing 804 may have pockets 862 on the interior surface 806 (or in an alternative embodiment on the exterior surface 808 of the article of clothing 804). The pockets 862 can be made from the same fabric material as the article of clothing 804. In one embodiment, each of the pockets 862 may be configured to receive the at least one thin force absorbing member 802. The pockets 862 may be made from any material (e.g., woven material) such as any one or more of polyester, cotton, rayon, wool, spandex, plastic, and the like. The pockets 862 may be coupled to the article of clothing 804 by any known securing method such as by stitches (sewn), adhesives, snaps, hook and loop fasteners, screws and the like. Once the thin force absorbing member 802 may be inserted into the pocket 862, the thin force absorbing member 802 may be secured within the pocket 862 via a flap (see blow-up section 864). Optionally, the flap can be secured to the pocket 862 via any known securing method such as by stitches (sewn), adhesives, snaps, buttons, hook and loop fasteners, screws, and the like. The pockets 862 may be configured to removably receive and conceal one or more of the thin force absorbing members 802, thus allowing easy removal or insertion of the thin force absorbing members 802 with respect to the pockets 862.

In everyday life, people experience forces to the body. These forces to the body come from bumping into objects, falling down, scrapping against objects, and the like. The forces to the body that people experience generally can result in scrapes, bruises, abrasions, and the like. The body protection device can protect the person's body from these forces to the body, minimizing the infliction, extent, or severity of these forces to the body.

The body protection device is especially important for young children. Young children, while learning to crawl, walk and interact with their environment often fall, crash, bump, scratch, run in to, and stub their body into objects and surfaces in their environment. Young children's heads are especially vulnerable to these forces to the body, and can often result in concussions. The body protection device can protect the young child from these forces to the body during their everyday activities. The body protection device when embodied as a protective hat, may be able to prevent the likelihood of young children sustaining concussions. The body protection device appears to be a piece of regular clothing. Since the body protection device looks and feels like any other article of clothing, the child will be encouraged to wear the body protection device in their everyday activities. Similarly, older people can also become more prone to falling, crashing, or bumping their head and thus the wearing of a protective hat is also advantageous for older people.

When the body protection device is made of lightweight or breathable fabric, it is well suited for indoor usage.

Figure 9A:
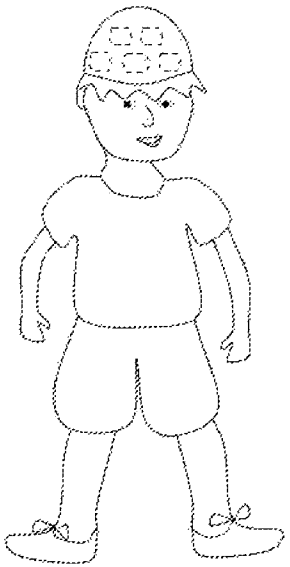
FIGS. 9A and 9B illustrates one use of a body protection device embodied in a protective hat.
Figure 9B:
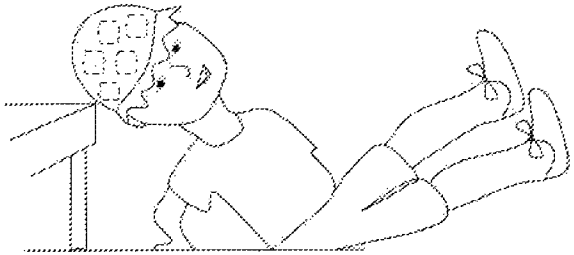

FIGS. 9A and 9B illustrates one use of a body protection device embodied in a protective hat. This application generally relates to protective clothing, and more particularly to a protective hat for a child. While learning to walk, the child frequently falls into hard objects, inflicting harm to the vulnerable head (see FIG. 9B). Since the protective hat is suitable for everyday wear, the protective hat provides a means for protection of the child's head while maximizing the likelihood of use through comfort, wearability and appearance (see FIG. 9A). However, as noted above, protection offered by wearable protective devices (e.g., protective clothing devices) can, in other embodiments, be provided in other types of clothing, such as a pair of pants, headband, shirt, and the like.

FIG. 9A illustrates an exemplary use of a protective hat according to one embodiment. A child is wearing the protective hat during daily life. The hat may be worn in everyday use such as while learning to crawl, learning to walk, playing, running, and the like. The protective hat may be thin, breathable, stylish, comfortable so as to promote everyday use. Since the protective hat can have the appearance of a normal hat and is comfortable to wear, the child is more likely to wear the protective hat.

FIG. 9B illustrates a child falling and the protective hat operating to protect the child's head against a sharp object (e.g., edge of a table). Since children are prone to falling, the protective hat through the at least one thin force absorbing member helps shield the child's head from objects encountered in everyday play such as floors, furniture, toys, rocks, and the like.

Figure 10A:
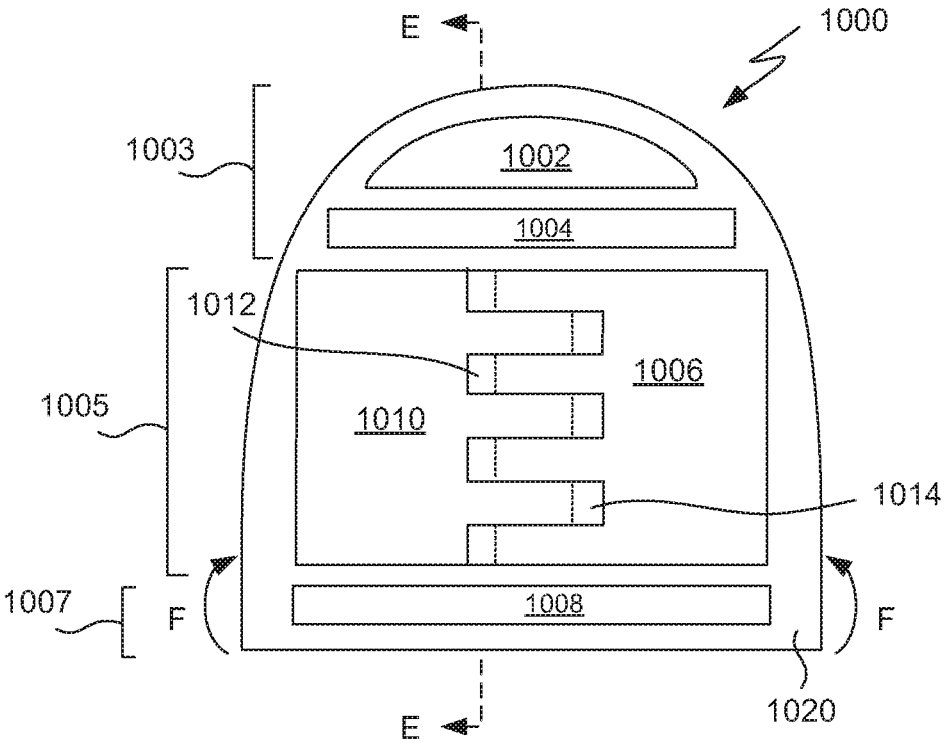
FIGS. 10A-10J illustrate yet another embodiments of body protection devices.
Figure 10B:
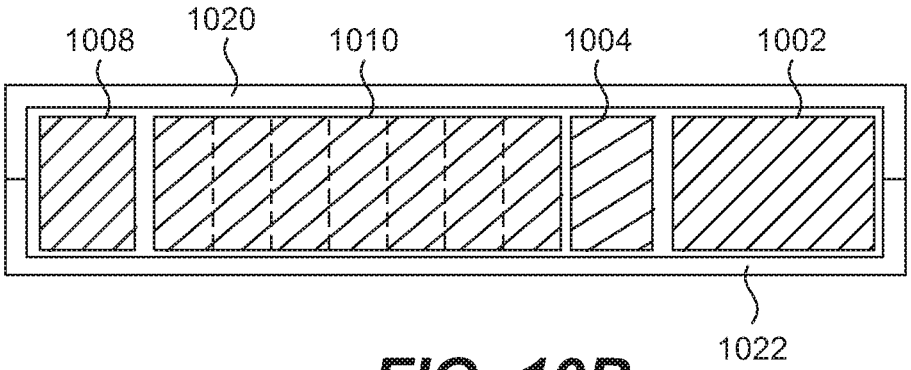

FIGS. 10A and 10B illustrate yet another embodiment of a body protection device. FIG. 10A illustrates a side view of a body protection device in the form of a protective hat 1000. The protective hat 1000 also has an opposing side (not shown) having a like configuration. FIG. 10B illustrates a cross sectional view of the protective hat 1000 across section E.

The protective hat 1000 may have a top section 1003, middle section 1005, and bottom section 1007. The protective hat 1000 may have at least one top thin force absorbing member 1002, 1004 positioned at a top section 1003 of the protective hat 1000. At least one top thin force absorbing member 1002, 1004 is illustrated as rounded (e.g., a semicircle) designed to enclose at least an upper portion of the top section 1003 of the protective hat 1000. Although the top thin force absorbing member 1002 is illustrated as a semicircle, this is not intended to be limiting as the top thin force absorbing member 1002 may be any shape desired to provide coverage on the top section 1003 of the protective hat 1000. In one embodiment, the protective hat 1000 may have at least two or more top thin force absorbing members 1002 to provide protection at the upper portion of the top section 1003 of the protective hat 1000. This may provide protection for the top of a user's head.

The top section 1003 may also have at least one top thin force absorbing member 1004 positioned at a lower portion of top section 1003 of the protective hat 1000. The top thin force absorbing member 1004 may be a rectangular member. Although the top thin force absorbing member 1004 is illustrated as a rectangular member, this is not intended to be limiting as top thin force absorbing member 1004 may be any other shape. In one embodiment, the top thin force absorbing member 1004 may be several thin force absorbing members attached to the protective hat 1000. In another embodiment, the top thin force absorbing member 1004 may be a single piece of material that continually surrounds the circumference of the lower portion of the top section 1003 of the protective hat 1000.

The middle section 1005 of hat 1000 may have a plurality of middle thin force absorbing members 1006, 1010 that mate in an unexpanded form. The middle thin force absorbing members 1006, 1010 are illustrated in FIG. 10A in an unexpanded form. The first middle thin force absorbing member 1006 may have a plurality of extensions 1012 extending outwardly from one side. The second middle thin force absorbing member 1010 may also have a plurality of extensions 1014 extending outwardly from one side. Extensions may be uniform in length (and/or width) or may vary in length depending on implementation. When in the unexpanded form, extensions 1012 and 1014 may overlap or interlace. For example, as shown in FIG. 10A, the extensions 1012 of the middle thin force absorbing member 1006 may overlap or interface with the extensions 1014 of the middle thin force absorbing member 1010.

When the protective hat 1000 is in use, the hat 1000 typically expands about the user's head. In such case, the middle thin force absorbing members 1006, 1010 can expand to provide the maximum protection for the user's head. If the extensions 1012 and 1014 do not overlap, there may be significant gaps between the first middle thin force absorbing member 1006 and the second middle thin force absorbing member 1010 which leave the user's head unprotected in certain regions. As such, with expansion of the associated article (e.g., protective hat), the overlapped or interlaced portions of the force absorbing members allow for impact protection even at interface regions where expansion occurs.

Although illustrated with one pair of the middle thin force absorbing members 1006, 1010, there may be any number of middle thin force absorbing members to ensure coverage around the middle section 1005 of hat 1000. For example, there may be at least two pairs (or sets) of the middle thin force absorbing members that overlap or interlace.

The bottom section 1007 of hat 1000 may have at least one bottom thin force absorbing member 1008. The at least one bottom thin force absorbing member 1008 is illustrated as a long rectangular member. In one embodiment, the bottom section 1007 may have several bottom thin force absorbing members attached to ensure coverage around the bottom section 1007 of the protective hat 1000. In another embodiment, the bottom thin force absorbing member 1008 may be a single piece of material that continually surrounds the bottom section 1007. In use, the bottom section 1007 may be folded outward and upward on the protective hat 1000 as illustrated by arrows F. When the protective hat 1000 has the bottom section 1007 folded outward and upward, the protective hat 1000 offers extra protection for a portion of the user's head. When the bottom section 1007 is so folded, the lower portion of the middle section 1005 provides increased impact protection since the combined thickness of the bottom thin force absorbing member 1008 and the lower portion of the plurality of middle thin force absorbing members 1006, 1010.

As illustrated in FIG. 10B, the thin force absorbing members 1002, 1004, 1006, 1010, and 1008 may be encased in a material 1020, 1022. The material 1020, 1022 may be a fabric of any type of material, such as fabric used to make clothes, hats, purses, and the like. Material 1020, 1022 may be, for example, leather, rayon, polyester, cotton, velvet, and any other type of material. In one embodiment, the material 1022 may be a liner to conceal the thin force absorbing members 1002, 1004, 1006, 1010, and 1008, and the material 1020 may be a fabric layer of the protective hat 1000, or vice versa. In another embodiment, the material 1022 may be a layer of fabric of the protective hat 1000, which may have a single layer of fabric or dual layers of fabric. For example, the material 1020, 10222, as fabric layers, can enclose and conceal the thin force absorbing members 1002, 1004, 1006, 1010, and 1008.

Figure 10C:
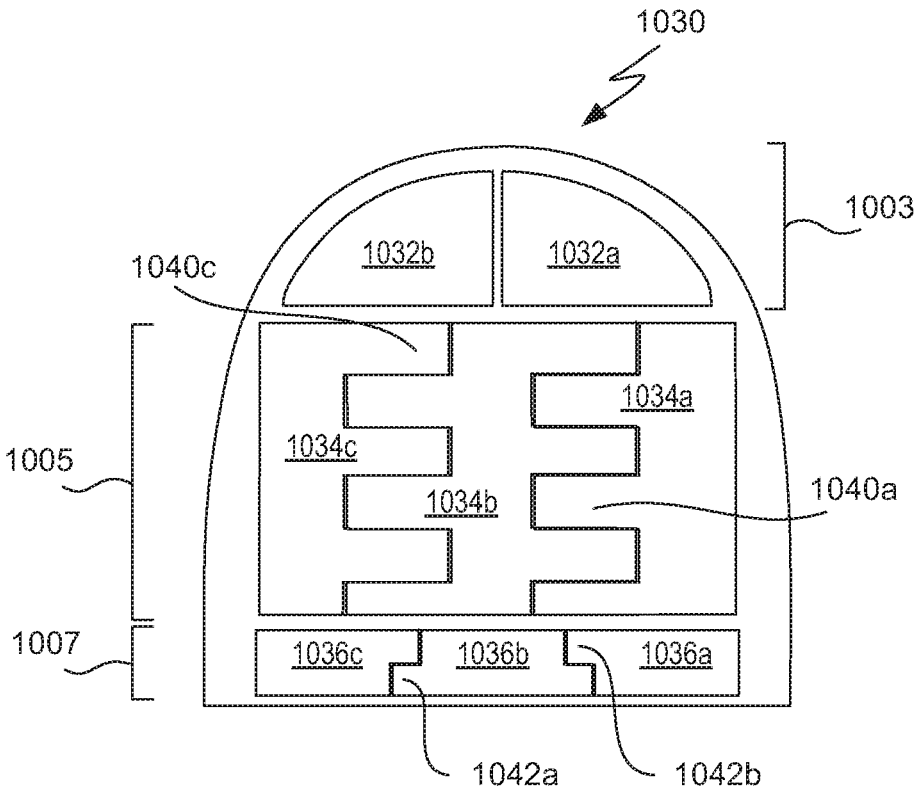

FIG. 10C illustrates another embodiment of a body protection device in the form of a protective hat 1030. FIG. 10C illustrates a side view of the protective hat 1030. FIG. 10C depicts one side of the protective hat 1030. The protective hat 1030 also has an opposing side (not shown) having a like configuration and thus can similarly include force absorbing members.

The protective hat 1030 may have a plurality of top thin force absorbing members 1032*a*, 1032*b* positioned to cover a top section 1033 of the protective hat 1030. The top thin force absorbing members 1032*a*, 1032*b* may be rounded, such as quarter-circle shaped. In one embodiment, each of the top thin force absorbing members 1032*a*, 1032*b* are separate and distinct pieces, and each is individually coupled to the protective hat 1030. In another embodiment, the top thin force absorbing members 1032*a*, 1032*b* can be a single circular or semi-circular piece of material having a plurality of cuts into the center of the circle thereby forming members 1032*a*, 1032*b*. The top thin force absorbing members 1032*a*, 1032*b* in this embodiment need not include overlapping regions for expansion as the top section of the protective hat 1030 in this embodiment tends not to expand substantially when being worn by a user.

A middle section 1035 of the protective hat 1030 may have a plurality of middle thin force absorbing members 1034*a*, 1034*b*, 1034*c*. Although illustrated with three middle thin force absorbing members 1034*a*, 1034*b*, 1034*c*, this is not intended to be limiting as any number of middle thin force absorbing members may be used to provide coverage for the protective hat 1030. Similar to middle thin force absorbing members 1006, 1010 illustrated in FIG. 10A, middle thin force absorbing members 1034*a*, 1034*b*, 1034*c* each may have a plurality of extensions 1040*a*, 1040*b*, 1040*c* extending outwardly from one or both sides. The extensions 1040*a*, 1040*b*, 1040*c* may be uniform in length (and/or width) or may vary in length depending on the user's desires. Although illustrated with three middle thin force absorbing members 1034*a*, 1034*b*, 1034*c*, this is not intended to be limiting as any number of middle thin force absorbing members may be used to provide coverage for a body protection device. The extensions 1040*a*, 1040*b*, 1040*c* can also be referred to as "teeth."

The middle thin force absorbing members 1034*a*, 1034*b*, 1034*c* are illustrated in an unexpanded form. In one embodiment, when in the unexpanded form, extensions 1040*a*, 1040*b*, 1040*c* may closely overlap similar to extensions 1012 and 1014 illustrated in FIG. 10A.

A bottom section 1037 of the protective hat 1030 may have a plurality of bottom thin force absorbing members 1036*a*, 1036*b*, 1036*c*. Each of the plurality of bottom thin force absorbing members 1036*a*, 1036*b*, 1036*c* may have a notch 1042*a*, 1042*b* at each side. A notch can also be referred to as an extension or a counterpart to an extension. The notches 1042*a*, 1042*b* may be formed at the bottom or top portion of the side as illustrated in FIG. 10C, but this is not intended to be limiting as notches may be formed in the middle of the side of the bottom thin force absorbing members 1036*a*, 1036*b*, 1036*c*.

The bottom thin force absorbing members 1036*a*, 1036*b*, 1036*c* are illustrated in an unexpanded form. In one embodiment, when in the unexpanded form, notches 1042*a*, 1042*b* may overlap similar to extensions 1012 and 1014 illustrated in FIG. 10A. In use, the bottom section 1007 may be folded outward and upward on the protective hat 1030. When the protective hat 1030 is worn, having the bottom section 1007 folded upward provides extra protection for the user's head at the lower region of the protective hat 1030.

Figure 10D:
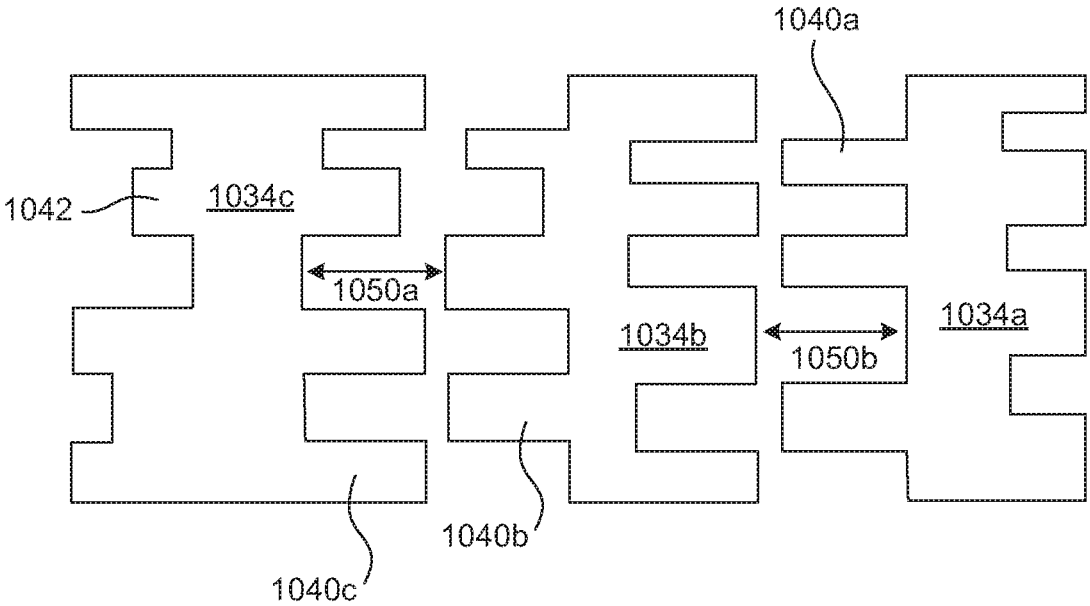

FIG. 10D illustrates the middle thin force absorbing members 1034*a*, 1034*b*, 1034*c* from the middle section 1035 of FIG. 10C in expanded form. Each of the middle thin force absorbing members 1034*a*, 1034*b*, 1034*c* may have the plurality of extensions 1040*a*, 1040*b*, 1040*c* extending outwardly from sides of the middle thin force absorbing members 1034*a*, 1034*b*, 1034*c*. In one embodiment, the length of the plurality of extensions 1040*a*, 1040*b*, 1040*c* may vary as illustrated by extension 1042. In another embodiment, the extensions 1040*a*, 1040*b*, 1040*c* may be of similar lengths. In one embodiment, the width of the plurality of extensions 1040*a*, 1040*b*, 1040*c* may also be similar or vary.

When in use, the middle thin force absorbing members 1034*a*, 1034*b*, 1034*c* may expand to conform to the user's head. In expanded form, gaps 1050*a*, 1050*b* may form between each of the plurality of middle thin force absorbing members 1034*a*, 1034*b*, 1034*c*. The area of the gaps shown in FIG. 10D are dependent upon how much overlap the plurality of extensions 1040*a*, 1040*b*, 1040*c* have with the opposing middle thin force absorbing member 1034*a*, 1034*b*, 1034*c*, and how much the protective hat 1030 is being expanded (e.g., when being worn). There may not be any gaps if the extensions are longer that the amount of expansion.

In the middle section 1035 when expanded, as shown in the embodiment of FIG. 10D, there can be formed regions of differing amounts of impact protection by way of the middle thin force absorbing member 1034*a*, 1034*b*, 1034*c*. In particular, as depicted in FIG. 10D, there are (i) fully protected regions 1052 where the force absorbing material is provided, (ii) partially protected regions 1054 where the force absorbing material is partially provided, and (iii) unprotected regions where there is no force absorbing material. When the amount of expansion (horizontal) exceed the length of the extensions, there is a gap 1056 which corresponds to an unprotected region. Alternatively, when the amount of expansion (horizontal) does not exceed the length of the extensions, there is no gap in protection since the extensions remain overlapped vertically. The use of extensions advantageously serves to reduce, or even minimize or prevent, any gaps that may be formed on expansion of the protective hat 1030.

Figure 10E:
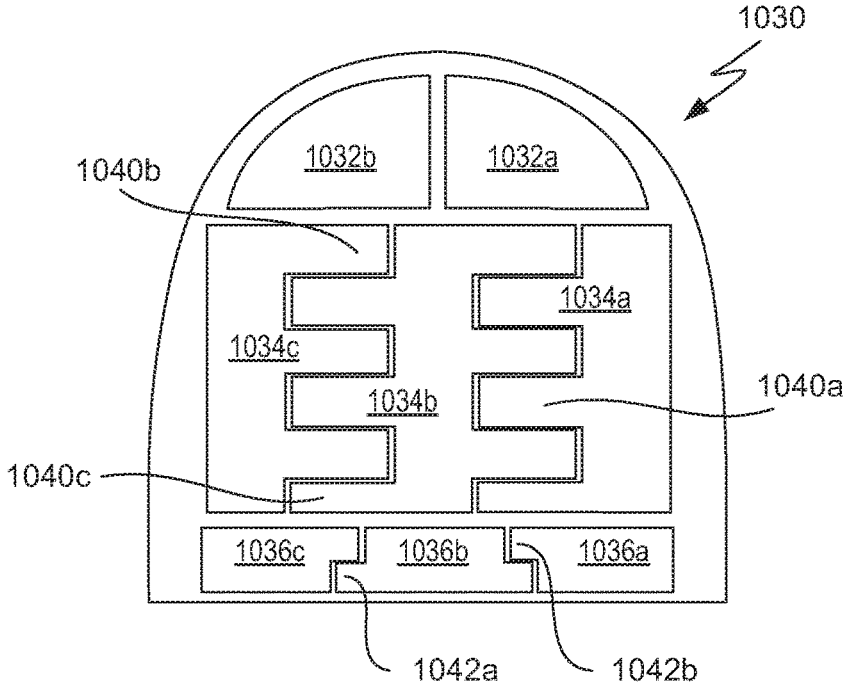

FIG. 10E illustrates the side view of the protective hat 1030 shown in FIG. 10C when expanded, in accordance with one embodiment. The various extensions and/or notches serve to serves to reduce, or even minimize or prevent, any gaps that may be formed on expansion of the protective hat 1030.

Figure 10F:
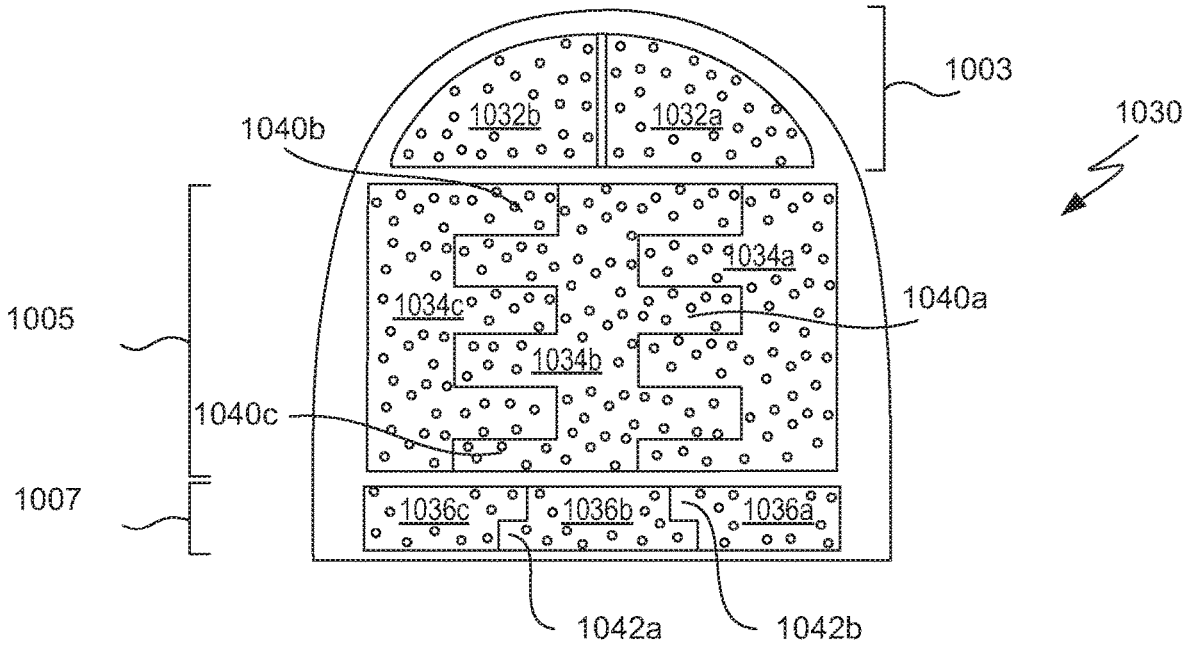

FIG. 10F illustrates the side view of the protective hat 1030 shown in FIG. 10C in accordance with another embodiment. In the embodiment shown in FIG. 10F, the various force absorbing members can include openings (e.g., holes). Advantageously, the openings can permit greater ventilation and reduce weight, while not substantially compromising the available impact protection. The openings can be relatively small, such as a diameter of 1-5 mm, in one embodiment. In another embodiment, the openings can be smaller, such as a diameter of less than 1 mm, which can include micro-perforations. The configuration of the openings can have any shape, including round/circle, square, triangle, rectangle, oval, star, trapezoid, complex, irregular or the like. The various openings for a given protective has can have the same configuration or can have multiple different configurations.

Figure 10G:
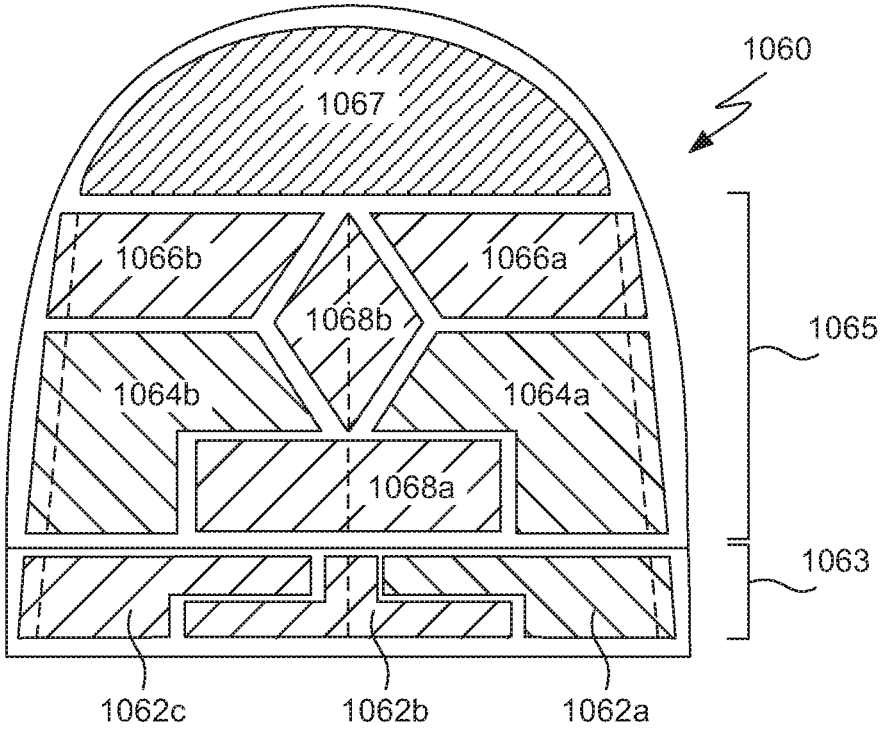

FIG. 10G illustrates another embodiment of a body protection device in the form of a protective hat 1060. FIG. 10G illustrates a side view of one side of the protective hat 1060. The protective hat 1060 also has an opposing side (not shown) having a like configuration and thus can similarly include force absorbing members.

The protective hat 1060 includes a bottom section 1063 and a middle section 1065. The bottom section 1063 includes a plurality of thin force absorbing members 1062*a*, 1062*b*, 1062*c*. The thin force absorbing members 1062*a*, 1062*b*, 1062*c* are configured and arranged on the protective hat 1060 to have overlapped portions. The middle section 1065 includes a plurality of thin force absorbing members 1064*a*, 1064*b*, 1066*a*, 1066*b*, 1068*a*, 1068*b*. The thin force absorbing members 1064*a*, 1064*b*, 1066*a*, 1066*b*, 1068*a*, 1068*b* are configured and arranged on the protective hat 1060 to have overlapped portions. The thin force absorbing member 1068*a* partially overlaps vertically with portions of the thin force absorbing members 1064*a* and 1064*b*. The thin force absorbing member 1068*b* has angled surfaces that permit expansion and overlap with respect to adjacent angled surfaces of thin force absorbing members 1064*a*, 1064*b*, 1066*a*, 1066*b*. The protective hat 1060 can also include a top section that can include one or more thin force absorbing members, such as thin force absorbing member 1067.

Figure 10H:
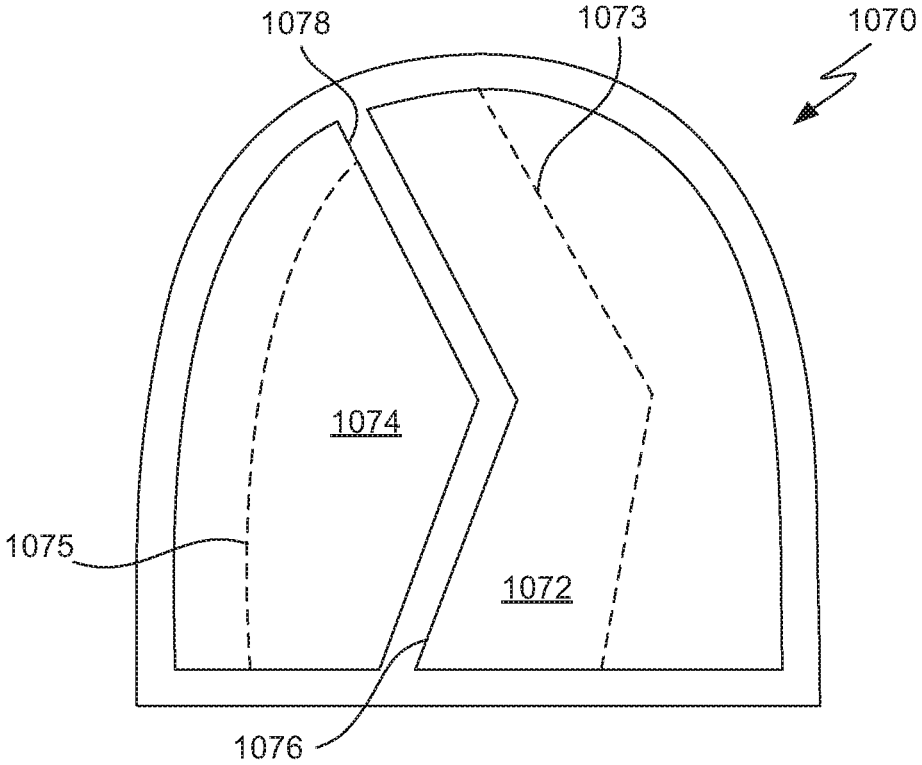

FIG. 10H illustrates another embodiment of a body protection device in the form of a protective hat 1070. FIG. 10H illustrates a side view of one side of the protective hat 1070. The protective hat 1070 also has an opposing side (not shown) having a like configuration and thus can similarly include force absorbing members. The protective hat 1070 includes a plurality of thin force absorbing members 1072, 1074. Adjacent side surfaces 1076, 1078 of the thin force absorbing members 1072, 1074 are angled to permit expansion and overlap with respect to adjacent angled side surfaces 1076, 1078 of the thin force absorbing members 1072, 1074, respectively. The opposing angled surfaces serve to reduce unprotected areas when the protective hat 1070 is expanded. In one embodiment, the thin force absorbing member 1072 can be stitched 1073 to the fabric of the protective hat 1070, and the thin force absorbing member 1074 can be stitched 1075 to the fabric of the protective hat 1070. In alternative embodiments, the thin force absorbing member 1072 and/or the thin force absorbing member 1074 can be secured relative to the fabric of the protective hat 1070 by other means (e.g., enclosure, pocket, adhesive, snaps, hook and loop fasteners, screws, etc.). The opposing angled surface can also be referred to as opposing V-shaped portions.

Figure 10I:
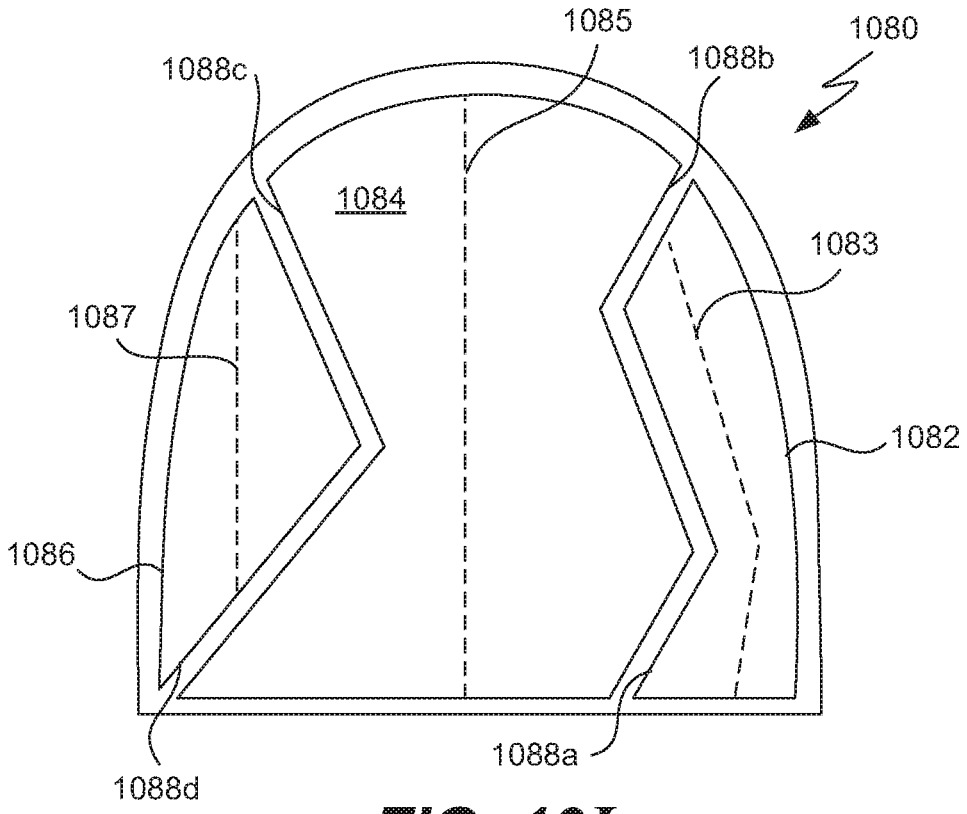

FIG. 10I illustrates another embodiment of a body protection device in the form of a protective hat 1080. FIG. 101 illustrates a side view of one side of the protective hat 1080. The protective hat 1080 also has an opposing side (not shown) having a like configuration and thus can similarly include force absorbing members. The protective hat 1080 includes a plurality of thin force absorbing members 1082, 1084, 1086. Adjacent side surfaces 1088*a*, 1088*b*, 1088*c*, 1088*d* of the thin force absorbing members 1082, 1084, 1086 are angled to permit expansion and overlap with respect to adjacent angled surfaces 1088*a*, 1088*b*, 1088*c*, 1088*d* of the thin force absorbing members 1082, 1084, 1086. The opposing angled side surfaces serve to reduce unprotected areas when the protective hat 1080 is expanded. The thin force absorbing member 1082 can be stitched 1083 to the fabric of the protective hat 1080. In one embodiment, the thin force absorbing member 1084 can be stitched 1085 to the fabric of the protective hat 1080, and the thin force absorbing member 1086 can be stitched 1087 to the fabric of the protective hat 1080. In alternative embodiments, the thin force absorbing member 1084 and/or the thin force absorbing member 1086 can be secured relative to the fabric of the protective hat 1080 by other means (e.g., enclosure, pocket, adhesive, snaps, hook and loop fasteners, screws, etc.).

Figure 10J:
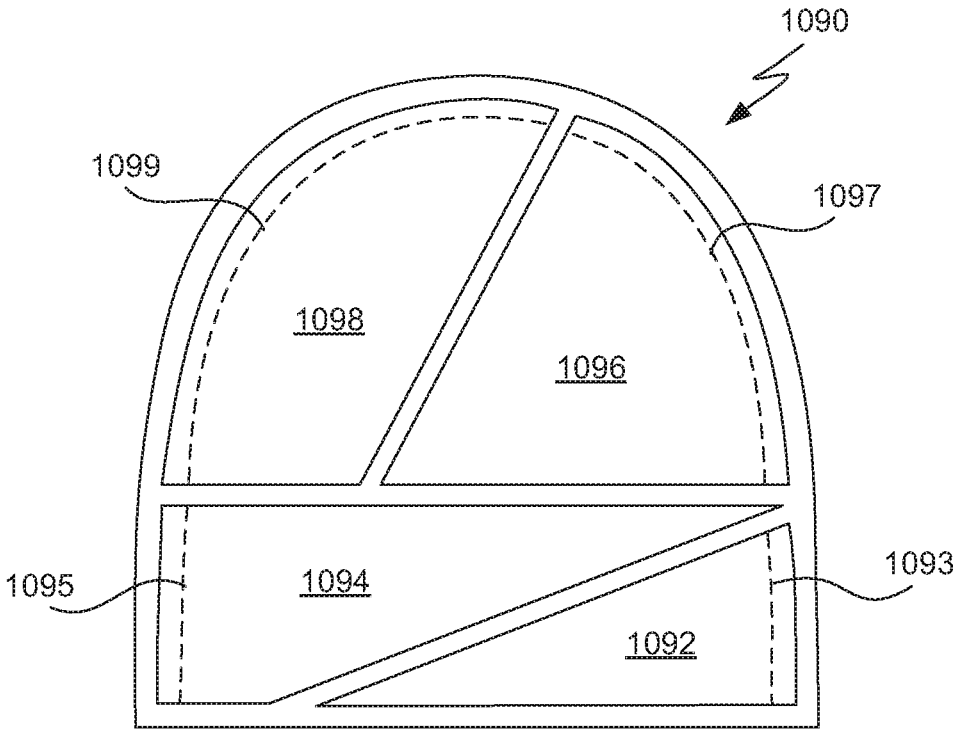

FIG. 10J illustrates another embodiment of a body protection device in the form of a protective hat 1090. FIG. 10H illustrates a side view of one side of the protective hat 1090. The protective hat 1090 also has an opposing side (not shown) having a like configuration and thus can similarly include force absorbing members. The protective hat 1090 includes a plurality of thin force absorbing members 1092, 1094, 1096, 1098 secured to the protective hat 1090 in an arrangement that facilitates expansion horizontally when the protective hat 1090 is being worn. Various side surfaces of the thin force absorbing members 1092, 1094, 1096, 1098 are angled to permit expansion and overlap with respect to adjacent angled side surfaces of the thin force absorbing members 1092, 1094, 1096, 1098. The opposing angled surfaces serve to reduce unprotected areas when the protective hat 1090 is expanded. In one embodiment, the thin force absorbing member 1092 can be stitched 1093 to the fabric of the protective hat 1090. The thin force absorbing member 1094 can be stitched 1095 to the fabric of the protective hat 1090. The thin force absorbing member 1096 can be stitched 1097 to the fabric of the protective hat 1090. The thin force absorbing member 1098 can be stitched 1099 to the fabric of the protective hat 1090.

In this embodiment shown in FIG. 10J, the stitching is relatively close to the side boundaries. In other embodiments, such as FIG. 10G, the stitching is generally vertical and may be inward from the side boundaries. In other embodiments, the stitching can be somewhat angled, such as shown in certain stitches in FIGS. 10H and 101 (e.g., stitches 1073, 1083, 1085). The stitching can be placed where appropriate given the design and can use one or a combination of these difference embodiments. Vertical stitching is limited to once seam per force absorbing member does not impede expansion of the corresponding protective hat. Stitching at the side boundaries may also not impede expansion if the embodiment does not encourage, or even seeks to reduce, expansion at the side boundaries themselves.

FIGS. 11A-11D illustrate arrangements of force absorbing members that permit expansion according to various embodiments. The embodiments are designed to permit horizontal expansion yet reduce areas of no protection once expanded through use of vertically overlapping or interlacing configurations.

Figure 11A:
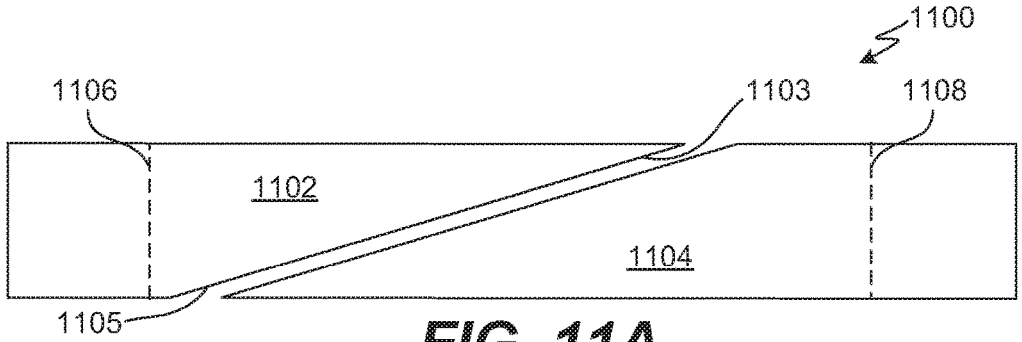
FIGS. 11A-11D illustrate arrangements of force absorbing members that permit expansion according to various embodiments.

FIG. 11A illustrates an arrangement 1100 in which horizontally adjacent force absorbing members 1102, 1104 having opposing angled surfaces 1103, 1105, respectively. The force absorbing member 1102 is secured to a body protection device (e.g., protective hat) with an attachment 1106. The force absorbing member 1104 is secured to a body protection device (e.g., protective hat) with an attachment 1108. The attachments 1106, 1108 can be implemented by stitches, adhesives, snaps, hook and loop fasteners, etc. As the body protection device expands horizontally, such as typically occurs when a protective hat is worn, the gap between the opposing angled surfaces 1103, 1105 increases, but the angled nature of the opposing angled surfaces 1103, 1105 reduce the area of a gap in protection.

Figure 11B:
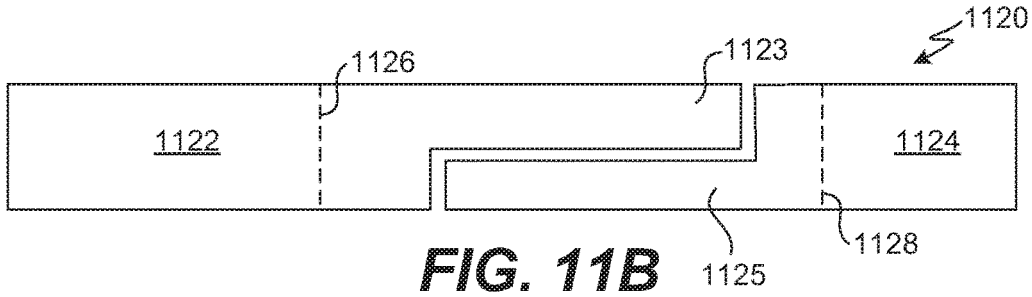

FIG. 11B illustrates an arrangement 1120 in which horizontally adjacent force absorbing members 1122, 1124 having extensions 1123, 1125, respectively. The force absorbing member 1122 is secured to a body protection device (e.g., protective hat) with an attachment 1126. The force absorbing member 1124 is secured to a body protection device (e.g., protective hat) with an attachment 1128. The attachments 1126, 1108 can be implemented by stitches, adhesives, snaps, hook and loop fasteners, etc. As the body protection device expands horizontally, such as typically occurs when a protective hat is worn, the gap between the extensions 1123, 1125 increases, but the overlapping or interlaced nature of the extensions 1123, 1125 reduce the area of a gap in protection.

Figure 11C:
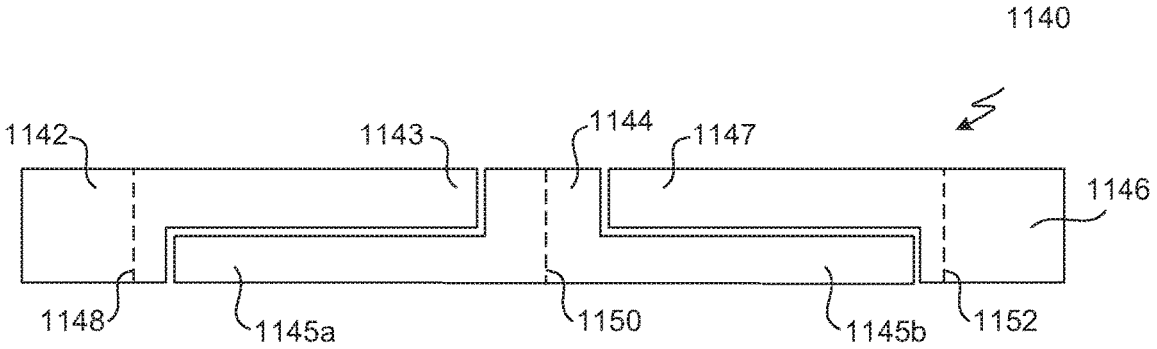

FIG. 11C illustrates an arrangement 1140 in which horizontally adjacent force absorbing members 1142, 1144, 1146 having extensions 1143, 1145, 1147, respectively. The force absorbing member 1142 is secured to a body protection device (e.g., protective hat) with an attachment 1148. The force absorbing member 1144 is secured to a body protection device (e.g., protective hat) with an attachment 1150. The force absorbing member 1146 is secured to a body protection device (e.g., protective hat) with an attachment 1152. The attachments 1148, 1150, 1152 can be implemented by stitches, adhesives, snaps, hook and loop fasteners, etc. As the body protection device expands horizontally, such as typically occurs when a protective hat is worn, the gap between the extensions 1143, 1145, 1147 increases, but the overlapping or interlaced nature of the extensions 1143, 1145, 1147 reduces the area of a gap in protection.

Figure 11D:
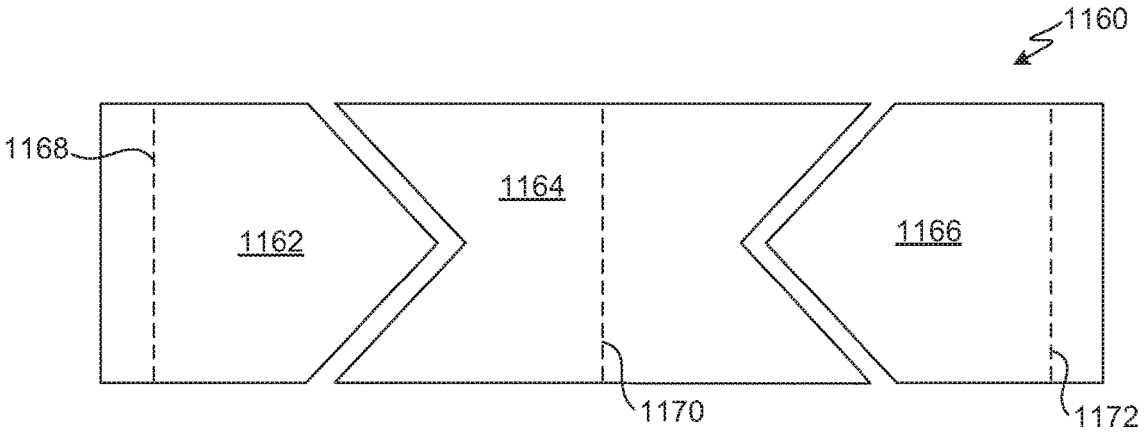

FIG. 11D illustrates an arrangement 1160 in which horizontally adjacent force absorbing members 1162, 1164, 1166 having opposing angled surfaces. The force absorbing member 1162 is secured to a body protection device (e.g., protective hat) with an attachment 1168. The force absorbing member 1144 is secured to a body protection device (e.g., protective hat) with an attachment 1170. The force absorbing member 1146 is secured to a body protection device (e.g., protective hat) with an attachment 1172. The attachments 1168, 1170, 1172 can be implemented by stitches, adhesives, snaps, hook and loop fasteners, etc. As the body protection device expands horizontally, such as typically occurs when a protective hat is worn, the gap between the opposing angled surfaces increases, but the overlapping or interlaced nature of the extensions opposing angled surfaces reduces the area of a gap in protection.

In alternative embodiments, the various force absorbing members can be secured to a body protection device (e.g., protective hat) by an enclosure (e.g., pocket).

Figure 12A:
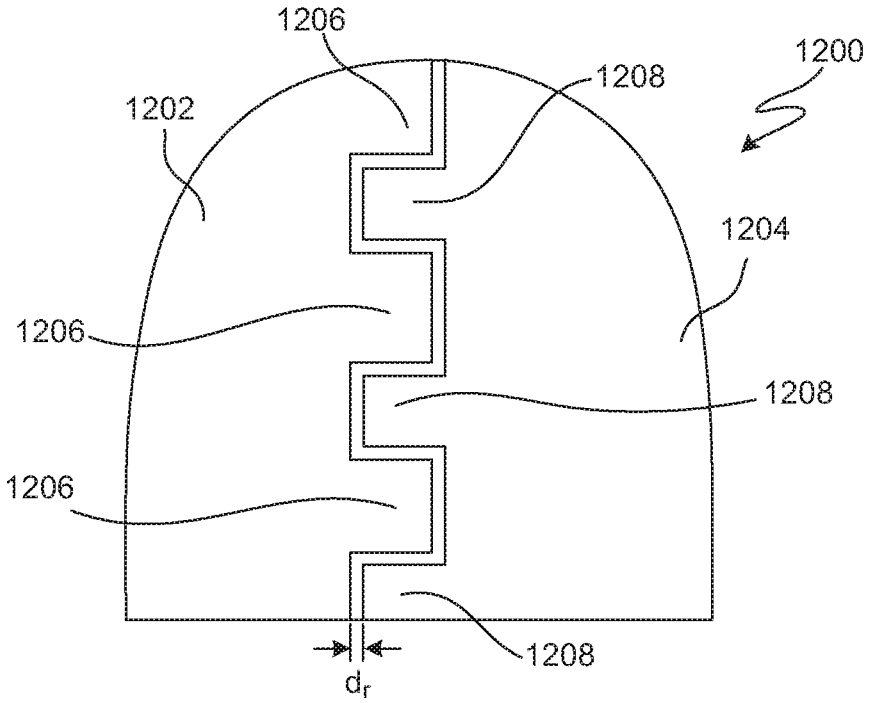
FIGS. 12A and 12B illustrate arrangements of force absorbing members that permit expansion according to an embodiment.
Figure 12B:
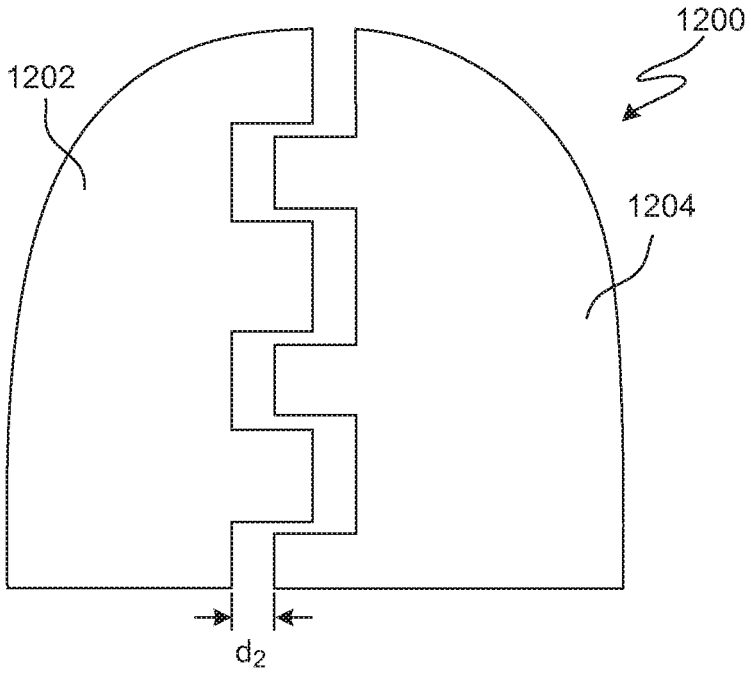

FIGS. 12A and 12B illustrate arrangements of force absorbing members that permit expansion according to an embodiment. The embodiment is designed to permit horizontal expansion yet reduce areas of no protection once expanded through use of vertically overlapping or interlacing extensions.

FIG. 12A illustrates one side of a protective hat 1200 is an unexpanded position. The protective hat 1200 has a first force absorbing member 1202 and a second force absorbing member 1204. The first and second force absorbing members 1202, 1204 each have a side that is adjacent one another. The adjacent side of the first force absorbing member 1202 has protruding extensions 1206. The adjacent side of the second force absorbing member 1204 has protruding extensions 1208. The extensions 1206, 1208 overlap or interlace vertically so as to provide protection when the protective hat 1200 is expanded. As shown, in the unexpanded position, a small distance dl separates the adjacent sides of the first and second force absorbing members 1202, 1204. As one example, the distance dl is typically less than 5 mm (e.g., $0 \leq d \leq 5$).

FIG. 12B illustrates the one side of the protective hat 1200 is an expanded position. As shown, in the expanded position, a distance d2 separates the adjacent sides of the first and second force absorbing members 1202, 1204. The distance d2 is greater than the distance d1. In this example, the horizontal expansion was a length of d2−d1.

In one embodiment, extensions for force absorbing members that overlap or interlace can have exposed corners rounded or chamfered to facilitate expansion and contraction without interference amongst adjacent extensions. Alternatively or additionally, the vertical height of an extension can be thinned to facilitate expansion and contraction without interference amongst adjacent extensions.

The body protection devices (e.g., protective hats) discussed herein can be worn in different environments, including indoors or outdoors, or different seasons, including winter, summer, spring, or fall, or for different activities. As a result, an article of clothing and/or a force absorbing member of the body protection device may be made of different fabric materials with various thicknesses to provide comfort with protection. In one embodiment, an article of clothing for winter outdoor usage may be made of thick wool. In another embodiment, an article of clothing for summer outdoor activity may be made of thin cotton. In some cases, an article of clothing for outdoor sports, such as skiing, soccer, rugby, touch/flag football, basketball, ice skating, swimming, may be made of thicker material than an article of clothing for indoor activity or summer activity. The force absorbing members may have various thicknesses according to environmental temperature/climate or the wear's activity. In one embodiment, the force absorbing member for an outdoor sport, such as skiing, soccer, basketball, ice skating, swimming, may be made of thicker material to provide the wearer more force absorbing protection during colder environmental conditions. In another embodiment, the force absorbing member for an outdoor sport, such as skiing, soccer, rugby, touch/flag football, basketball, ice skating, swimming, may be made of thinner material (or at least more ventilated or breathable) to provide the wearer with some force absorbing protection without overheating the wearer during warmer environmental conditions. In still another embodiment, the force absorbing member for an indoor activity, such as a children's play room, may be made of thin material that provides adequate protection for its wearer without being uncomfortable bulky or providing too much heat retention. In yet another embodiment, the body protection device having force absorbing materials can be used by adults, such as senior citizens, that may be prone to falling.

The body protection devices are useful to reduce concussive effects. In other words, the body protection devices, namely protective hats, can be worn by users and can thus serve to reduce concussions or concussion damage. It is known that concussion damage is the result of successive concussive impacts to a user's head. By wearing the body protection devices (namely, the protection hats), users are able to mitigate head trauma due to undesired impact to the users' heads due to falls, accidents, or bumps.

In one embodiment, the body protection device which is in the form of a protective hat, such as the protective hat 1030 shown in FIG. 10C, can be configured to fold flat at the major seam. For example, the side view of the protective hat 1030 shown in FIG. 10C can illustrate the side view of the protective hat 1030 in the folded position. The arrangement of force absorbing members and/or their configuration are such as to facilitate folding of a protective hat at its major seam. Also, when folded, the protective has its first side is substantially planar and over the top of a second side (not shown) which is also substantially planar.

Figure 13A:
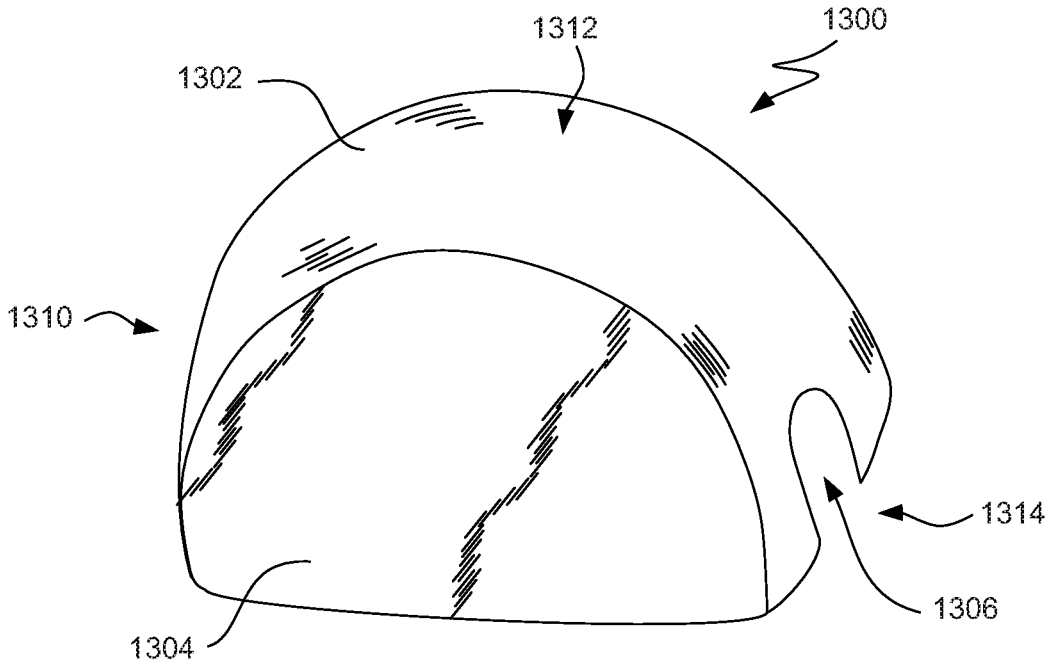
FIGS. 13A and 13B illustrate a perspective view of another embodiment of a body protection device in the form of a protective hat.
Figure 13B:
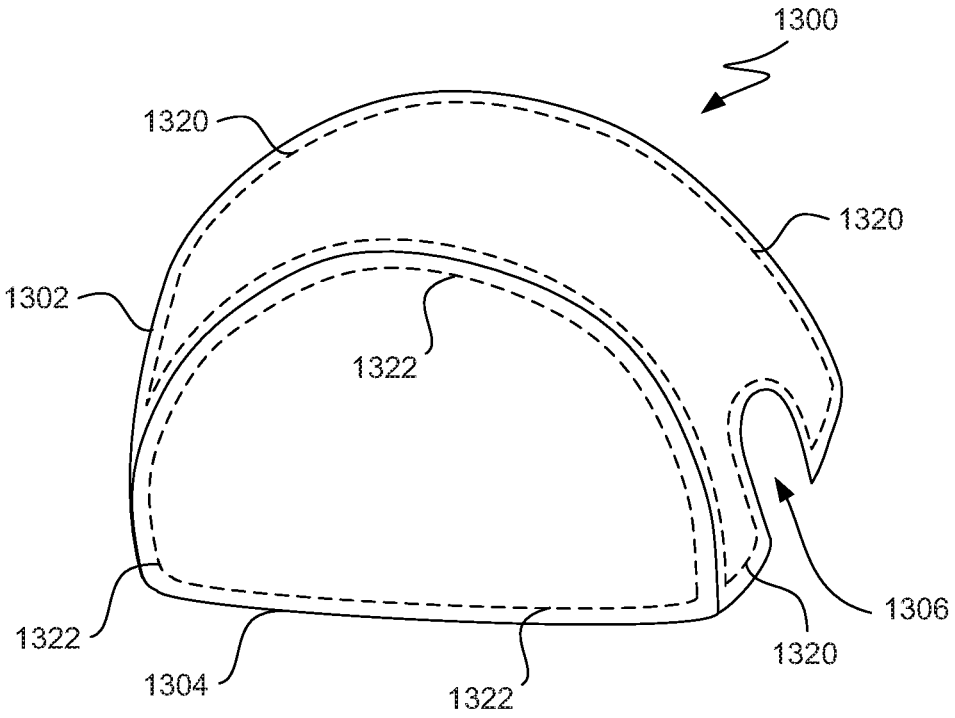

FIGS. 13A and 13B illustrate a perspective view of another embodiment of a body protection device in the form of a protective hat 1300. In one implementation, the protective hat 1300 can be formed of a three-piece construction. The three-piece construction can include a central piece 1302, a first side piece 1304 and a second side piece (not shown) positioned approximately opposite the first side piece 1304. The central piece 1302 can provide for the front 1310, top 1312 and rear portion 1314 of the protective hat 1300. Optionally, the rear portion 1314 of the central piece 1302 can include a cut-out 1306. The cut-out 1306 in the rear portion can facilitate tensioning of the protective hat 1300 to a user's head (when being worn) for a tight or snug fit.

Additionally, as shown in FIG. 13B, internal to each of the central piece 1302, the first side piece 1302, and the second side piece are one or more force absorbing members. In one implementation, the central piece 1302 includes a central force absorbing member 1320, the first side piece 1304 includes a first side force absorbing member 1322, and the second side piece includes a second side force absorbing member (not shown).

The body protection device, such as the protective hat 1300 illustrated in FIGS. 13A and 13B, can include a tensioner. The tensioner can serve to induce a compression force along a base or lower portion of the protective hat to assist in securing a protective hat (e.g., the protective hat 1300) on a user (i.e., on the user's head). FIGS. 14A-14D illustrate application of a tensioner to a protective hat, such as the protective hat 1300.

Figure 14A:
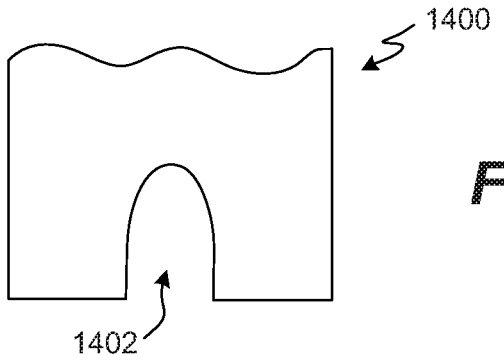
FIG. 14A illustrates a partial rear portion of a protective hat according to one embodiment.

FIG. 14A illustrates a partial rear portion 1400 of a protective hat according to one embodiment. The protective hat includes a cut-out 1402 in the partial rear portion 1400. The cut-out 1402 in the rear portion can facilitate tensioning of the protective hat. Although the cut-out 1402 is illustrated as having a semi-oval shape, this is not intended to be limiting as the cut-out 1402 may be any shape, such as a semi-circle, semi-square, triangle, complex shape, and the like.

Figure 14B:
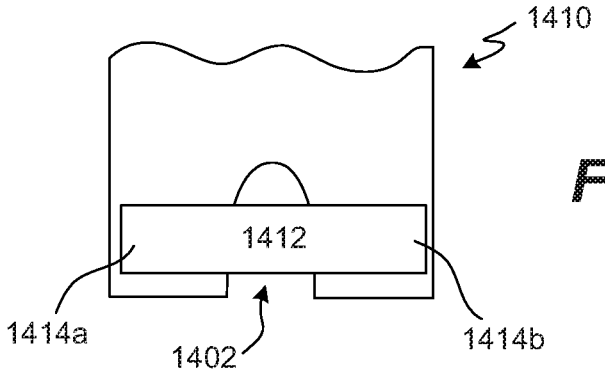
FIG. 14B illustrates a partial rear portion of a protective hat according to one embodiment.

Referring now to FIG. 14B, an elastic member 1412 may be coupled to the partial rear portion 1410 across the cut-out 1402, according to one embodiment. The elastic member 1412 may be positioned proximate a base portion of the partial rear portion 1410 or the cut-out 1402. In another embodiment, the elastic member 1412 may be positioned along a central or middle portion of the partial rear portion 1410 or the cut-out 1402. Prior to being coupled to the partial rear portion 1410, the elastic member 1412 may be pulled to a first position resulting in a tensioned elastic member 1412. The elastic member 1412 may then be coupled to the partial rear portion 1410 by any known means such as through the use of adhesives, hook and loop fasteners, clips, sewed on, and the like.

Thus, when coupled to the partial rear portion 1410 in a tensioned phase, the elastic member 1412 may facilitate tensioning of the protective hat by applying a tightening tension force from each opposing end 1414*a, b* of the elastic member 1412. When the tension is applied from each opposing end 1408*a,b*, this may cause the base or lower portion of the protective hat to tighten against the user's body. For example, the tensioning from the elastic member 1412 pulls the base or lower portion of the protective hat resulting in a tightening (e.g., compressive force) of the protective hat about the user's head.

In another embodiment, elastic member may be coupled to the periphery of protective hat at the base or lower portion. In other words, elastic member may be coupled to the entire base portion 1404 of protective hat thereby providing a tensioning throughout the base portion 1404 of hat to provide an even tighter (e.g., compressive) fit around the user's head.

Figure 14C:
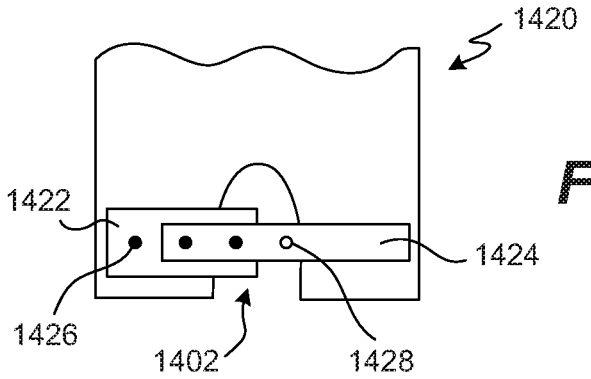
FIG. 14C illustrates a partial rear portion of a protective hat according to one embodiment.

FIG. 14C illustrates a partial rear portion 1420 of a protective hat according to one embodiment. The protective hat includes a cut-out 1402 in the partial rear portion 1420. In one embodiment an adjustable tensioner, having a first part 1422 and a second part 1424, may be coupled proximate to the base portion of the partial rear portion 1420 of the cut-out 1402. In another embodiment, the first part 1422 and second part 1424 of the adjustable tensioner may be coupled to a central or middle portion of the partial rear portion 1420 or the cut-out 1402. The second part 1424 may be coupled to the partial rear portion 1420 at one end and first part 1422 may be coupled to the partial rear portion 1420 at one end. In one embodiment, the second part 1424 may have a plurality of tabs 1426 positioned on the first part 1422. The second part 1424 may be configured to have a plurality of receivers 1428(e.g., holes) to receive and interlock with corresponding ones of the tabs 1426 of the first part 1422. The plurality of tabs 1426 and receivers 1428 may be any known tabs and receivers configured to inter-lock with one another. In one example, the plurality of tabs 1426 may extend outwardly from first part 1422 and have a circular knob at the end of the tab 1426. The plurality of receivers 1428 may be a slit or small opening such that when a tab 1426 is inserted into the slit or small opening the tab will be inter-locked in the slit or small opening and the circular knob will prevent the tab 1426 from releasing. However, the tab 1426 may be released from the receiver 1428 when pressure to separate the tab from the receiver is applied.

In another example, the tab 1426 may be a male member configured to be received by a female member receiver 1428. To adjust the tensioner, the male member tab may be pressed into the female member receiver and secured by snapping them together. Pressure to separate the female member from the male member may be applied to release the female member from the male member to allow for repositioning of the adjustable tensioner to comfortably fit the protective hat on the user's body (e.g., head).

Figure 14D:
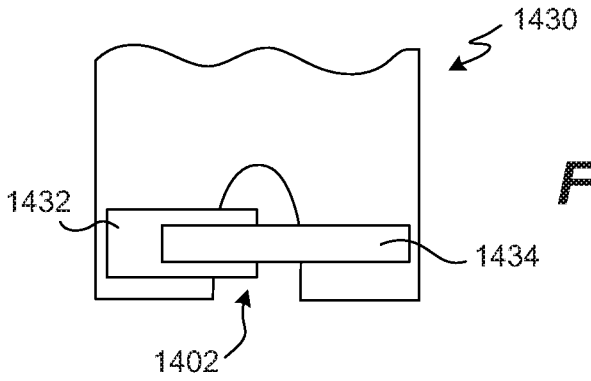
FIG. 14D illustrates a partial rear portion of a protective hat according to one embodiment.

FIG. 14D illustrates a partial rear portion 1430 of a protective hat according to one embodiment. The protective hat includes a cut-out 1402 in the partial rear portion 1430. An adjustable tensioner having a first part 1432 and a second part 1434. The second part 1434 can be secured to the first part 1432 using one or more hook-and-loop pieces, which can be inter-locked. The first part 1432 and the second part 1434 are also secured to respective sides of the partial rear portion 1430.

Figure 14E:
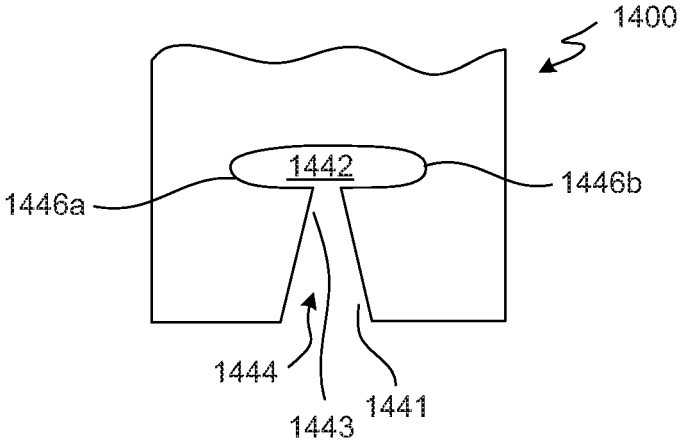
FIG. 14E illustrates a partial rear portion of a protective hat according to one embodiment.

FIG. 14E illustrates a partial rear portion 1440 of a protective hat according to one embodiment. The protective hat may have a slot 1442 and a channel 1444 in the partial rear portion 1440. The channel 1444 provides access to the slot 1442. In one embodiment, as illustrated, channel 1444 is wider at a first end 1441 than at a second end 1443 thereby forming a wider channel at the first end 1441 and a narrower channel at the second end 1443. In another embodiment, channel 1444 may have a consistent or constant width throughout the channel 1444 as illustrated in FIG. 16F. In still another embodiment, the width at first end 1441 may be narrower than the width at second end 1443. In yet another embodiment, the channel 1444 may be used with a tensioner such as the tensioners described and illustrated in FIGS. 14B-14D. Furthermore, in another embodiment, the channel 1444 may alternatively be formed similar to the shape of cut-out 1402 shown in FIG. 14A.

The slot 1442 may have opposing ends 1446*a* and 1446*b* that are horizontally opposing. In one usage, the slot 1442 can serve to retain a user's hair, such as a pony tail, that is passed-through the slot 1442 when the protective hat is being worn by a user. For example, the user's hair can be pulled through the channel 1444 into the slot 1442. The retention of the hair within the slot 1442 can be facilitated by the configuration of the channel 1444 and the slot 1442. The narrower width at second end 1443 may assist to retain the user's hair in slot 1442. As such, the width of slot 1442 may be greater than the width of channel's second end 1443 and/or the width of channel's first end 1441 to facilitate retention of the user's hair in the slot 1442.

In another embodiment, although channel 1444 is illustrated with straight edges, this is not intended to be limiting as the channel 1444 may have ragged edges to facilitate support retention of the user's hair in the slot 1442. For example, the channel 1444 edges may be a sharp, jagged, triangular, wavy, or any other design or shape desired to help support the user's hair in the slot 1442. In an alternative embodiment, the channel 1444 can be eliminated and just the slot 1442 provided.

As illustrated in FIG. 14E, the opposing ends 1446*a* and 1446*b* are rounded. However, this is not intended to be limiting as the slot may be any shape desired. For example, the opposing ends 1446*a* and 1446*b* may be squared, dovetailed, angled, and the like.

Figure 14F:
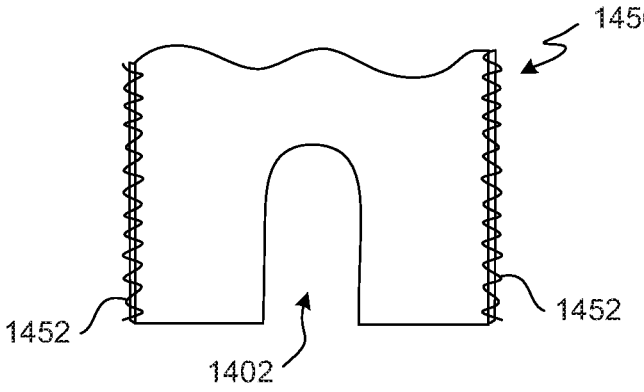
FIG. 14F illustrates a partial rear portion of a protective hat according to one embodiment.

FIG. 14F illustrates a partial rear portion 1450 of a protective hat according to one embodiment. The protective hat includes a cut-out 1402 in the partial rear portion 1450. FIG. 14F illustrates the inside surface that is in contact with the user's body. As discussed above with reference to FIGS. 13A and 13B, the protective hat can includes a central piece, a first side piece and a second side piece. Thus, the partial rear portion 1450 is secured to first and second side portion of the protective hat with stitching 1452. For example, for the protective hat 1300 shown in FIGS. 13A and 13B, the stitching 1452 can be used to couple together the central piece 1302 to the first side piece 1302 and the second side piece.

Figure 15A:
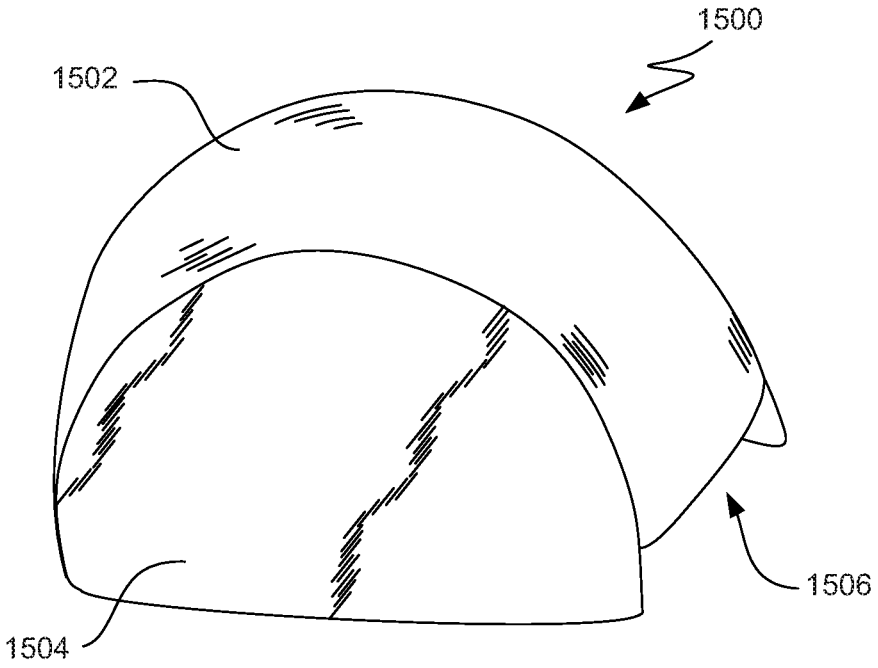
FIGS. 15A and 15B illustrate a perspective view of another embodiment of a body protection device in the form of a protective hat.
Figure 15B:
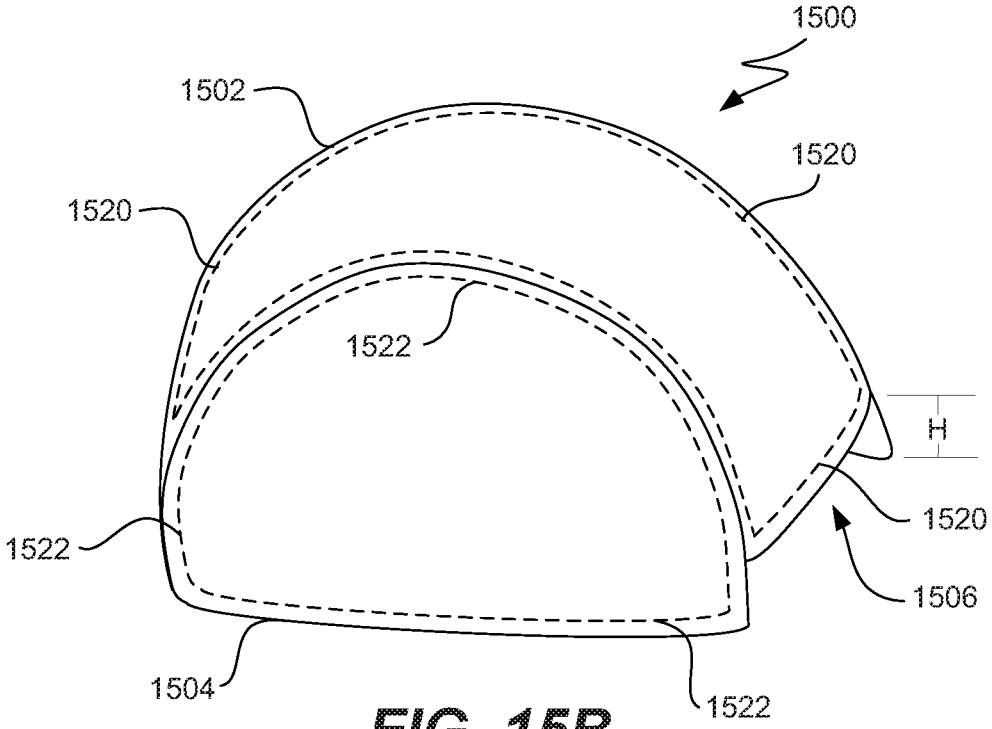

FIGS. 15A and 15B illustrate a perspective view of another embodiment of a body protection device in the form of a protective hat 1500. In one implementation, the protective hat 1500 can be formed of a three-piece construction. The three-piece construction can include a central piece 1502, a first side piece 1502 and a second side piece (not shown). The central piece 1502 can provide front, top and rear portions of the protective hat 1300. Optionally, a rear portion of the central piece 1502 can include an opening 1506. The opening 1506 in the rear portion can facilitate tensioning of the protective hat 1300 to a user's head (when being worn). Opening 1506 may have a height H of between 0.5-1.5 inches, In another embodiment, the height H may be between 0.5-3 inches.

Additionally, as shown in FIG. 15B, internal to each of the central piece 1502, the first side piece 1502 and the second side piece are one or more force absorbing members. In one implementation, the central piece 1502 includes a central force absorbing member 1520, the first side piece 1504 includes a first side force absorbing member 1522, and the second side piece includes a second side force absorbing member.

The body protection device, such as the protective hat 1500 illustrated in FIGS. 15A and 15B, can include a tensioner. The tensioner can serve to induce a compression force that assists in securing a protective hat (e.g., the protective hat 1500) on a user (i.e., on the user's head).

FIGS. 16A-16D illustrate exemplary embodiments of a tensioner to a protective hat, such as the protective hat 1500 illustrated in FIGS. 15A and 15B. As depicted, the tensioner can be positioned in the rear portion of the protective hat by being coupled to rear portions of the first side piece (e.g., the first side piece 1502 illustrated in FIGS. 15A and 15B) as well as the second side piece.

Figure 16A:
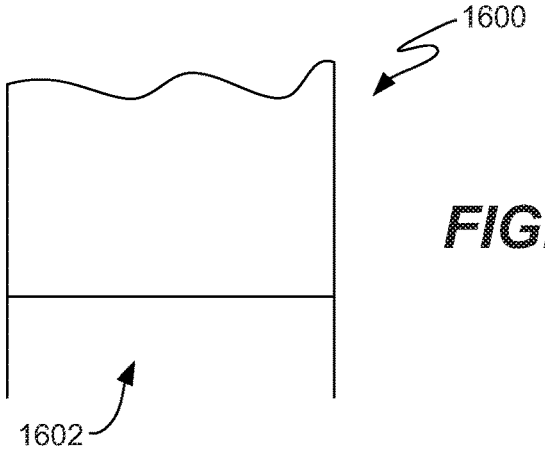
FIG. 16A illustrates a partial rear portion of a protective hat according to one embodiment.

FIG. 16A illustrates a partial rear portion 1600 of a protective hat according to one embodiment. The protective hat includes an opening 1602 in the partial rear portion 1600. The opening 1602 in the rear portion can facilitate tensioning of the protective hat.

Figure 16B:
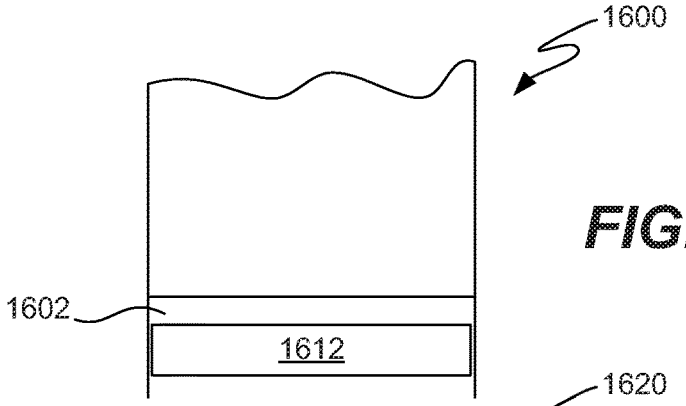
FIG. 16B illustrates a partial rear portion of a protective hat according to one embodiment.

FIG. 16B illustrates a partial rear portion 1610 of a protective hat according to one embodiment. The protective hat includes an opening 1602 in the partial rear portion 1610. An elastic member 1612 may be provided in the partial rear portion 1610 across the opening 1602. A fist end 1614 of the elastic member 1612 may be coupled to a first side piece 1616, and a second end 1617 of the elastic member 1612 may be coupled to a second side piece 1618. Prior to being coupled to the partial rear portion 1610, the elastic member 1612 may be pulled to a first position resulting in a tensioned elastic member 1612. The elastic member 1612 may then be coupled to the first side piece 1616 and the second side piece 1618. The elastic member 1612 may be coupled to the first side piece 1614 and the second side piece 1617 by any known means such as through the use of adhesives, hook and loop fasteners, clips, sewed on, and the like.

Thus, when coupled to the partial rear portion 1610 in a tensioned phase, the elastic member 1612 may facilitate tensioning of the protective hat by applying a tightening tension force from the first end 1614 to the second end 1617. When the tension force is applied, this may cause the base or lower portion of the protective hat to tighten against the user's head. For example, the tensioning from the elastic member 1612 pulls the base or lower portion of the protective hat (namely, via the first side piece 1614 and the second side piece 1618) resulting in a tightening (e.g., compressive force) of the protective hat against the user's head when being worn. In another embodiment, elastic member may be coupled to the periphery of protective hat at a base or lower portion. In other words, elastic member may be coupled to the entire base portion of protective hat thereby providing a tensioning throughout the base portion of hat to provide an even tighter (e.g., compressive) fit around the user's head.

Figure 16C:
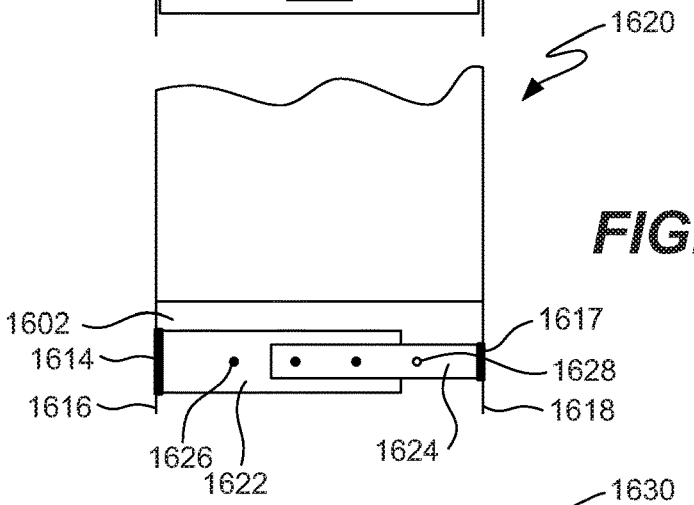
FIG. 16C illustrates a partial rear portion of a protective hat according to one embodiment.

FIG. 16C illustrates a partial rear portion 1620 of a protective hat according to one embodiment. The protective hat includes a cut-out 1602 in the partial rear portion 1620. In one embodiment an adjustable tensioner, having a first part 1622 and a second part 1624, may be coupled proximate to the base portion of the partial rear portion 1620 of the cut-out 1602. In another embodiment, the first part 1622 and second part 1624 of the adjustable tensioner may be coupled to a central or middle portion of the partial rear portion 1620 or the cut-out 1602. The second part 1624 may be coupled to the partial rear portion 1620 at one end and first part 1622 may be coupled to the partial rear portion 1620 at one end. In one embodiment, the second part 1624 may have a plurality of tabs 1626 positioned on the first part 1622. The second part 1624 may be configured to have a plurality of receivers 1628 (e.g., holes) to received and interlock with corresponding ones of the tabs 1626 of the first part 1622.

The plurality of tabs 1626 and receivers 1628 may be any known tabs and receivers configured to inter-lock with one another. In one example, the plurality of tabs 1626 may extend outwardly from first part 1622 and have a circular knob at the end of the tab 1626. The plurality of receivers 1628 may be a slit or small opening such that when a tab 1626 is inserted into the slit or small opening the tab will be inter-locked in the slit or small opening and the circular knob will prevent the tab 1626 from releasing. However, the tab 1626 may be released from the receiver 1628 when pressure to separate the tab from the receiver is applied.

In another example, the tab 1626 may be a male member configured to be received by a female member receiver 1628. To adjust the tensioner, the male member tab may be pressed into the female member receiver and secured by snapping them together. Pressure to separate the female member from the male member may be applied to release the female member from the male member to allow for repositioning of the adjustable tensioner to comfortably fit the protective hat on the user's body (e.g., head).

Figure 16D:
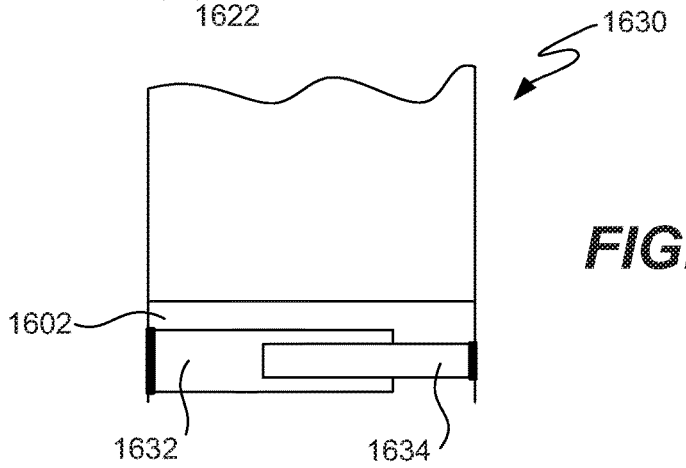
FIG. 16D illustrates a partial rear portion of a protective hat according to one embodiment.

FIG. 16D illustrates a partial rear portion 1630 of a protective hat according to one embodiment. The protective hat includes an opening 1602 in the partial rear portion 1630. An adjustable tensioner may have a first part 1632 and a second part 1634. The second part 1634 can be secured to the first part 1632 using one or more hook-and-loop fasteners, which can be inter-locked. The first part 1632 and the second part 1634 are also secured to respective first and second sides of the protective hat.

Figure 16E:
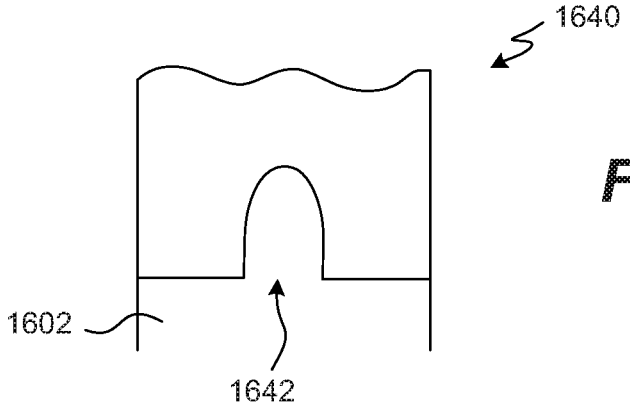
FIG. 16E illustrates a partial rear portion of a protective hat according to one embodiment.
Figure 16F:
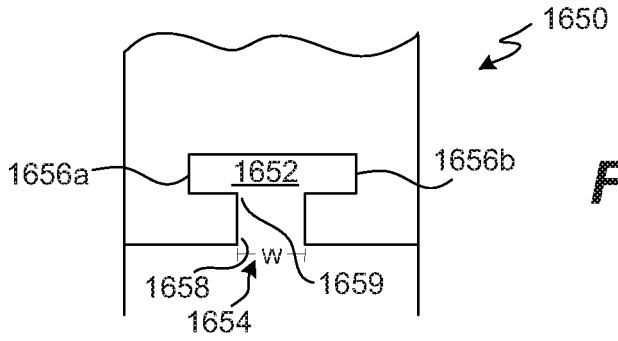
FIG. 16F illustrates a partial rear portion of a protective hat according to one embodiment.

FIG. 16E illustrates a partial rear portion 1640 of a protective hat according to one embodiment. The protective hat includes a first opening 1642 in the partial rear portion 1640. The partial rear portion 1640 also includes a second opening 1642. In one embodiment, as illustrated, the second opening 1642 is positioned at the center of first opening 1602. In another embodiment, placement of the second opening 1642 may be in any position or location desired, such as to the right or left side of the first opening 1642. The second opening 1642 can facilitate tensioning of the protective hat and/or facilitate a secure placement of the user's hair in the second opening 1642.

FIG. 16F illustrates a partial rear portion 1650 of a protective hat according to one embodiment. The protective hat includes a slot 1652 and a channel 1654 in the partial rear portion 1650. The channel 1654 provides access to the slot 1652. The slot 1652 has opposing ends 1656 that are horizontally opposing. In one usage, the slot 1652 can serve to retain a user's hair when the protective hat is being worn by a user with long hair. For example, the user's hair can be pulled through the channel 1654 into the slot 1652. The retention of the hair within the slot 1652 can be facilitated by the configuration of the channel 1654 and the slot 1652.

In one embodiment, as illustrated, the channel 1654 may have a constant width W. However, this is not intended to be limiting as the channel 1654 may have any width desired. For example, width W may be wider at a first end 1658 than at a second end 1659 thereby forming a wider channel at the first end 1658 and a narrower channel at the second end 1659. In still another embodiment, the width at the first end 1658 may be narrower than the width at the second end 1659. In yet another embodiment, the channel 1654 may be used with a tensioner such as the tensioners described and illustrated in FIGS. 16B-16D.

The slot 1652 may have opposing ends 1656, and 1656*b* that are horizontally opposing. In one usage, the slot 1652 can serve to retain a user's hair, such as a pony tail, that is passed-through the slot 1652 when the protective hat is being worn by a user. For example, the user's hair can be pulled through the channel 1654 into the slot 1652. The retention of the hair within the slot 1652 can be facilitated by the configuration of the channel 1654 and/or the slot 1652.

In another embodiment, although the channel 1654 is illustrated with straight edges, this is not intended to be limiting as the channel 1654 may have ragged edges to facilitate support of the user's hair in the slot 1652. For example, the channel 1654 edges may be a sharp, jagged, triangular, wavy, or any other design or shape desired to help support (e.g., retain) the user's hair in slot 1652.

As illustrated in FIG. 16F, the opposing ends 1656*a* and 1656*b* are squared. However, this is not intended to be limiting as the slot may be any shape desired. For example, the opposing ends 11656*a* and 1656*b* may be rounded, circular, dovetailed, angled, and the like.

Figure 16G:
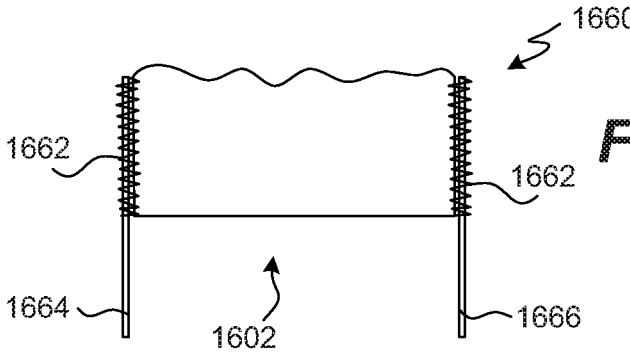
FIG. 16G illustrates a partial rear portion of a protective hat according to one embodiment.

FIG. 16G illustrates a partial rear portion 1660 of a protective hat according to one embodiment. The protective hat includes the opening 1602 in the partial rear portion 1660. In FIG. 16G, the inside surface of the partial rear portion 1660 is depicted. Typically, the inner surface is provided adjacent the user's head when the protective hat is being worn. As illustrated, the partial rear portion 1660 is secured to first side piece 1664 and second side piece 1666 of the protective hat with stitching 1662. As described above with reference to FIGS. 15A and 15B, the protective hat includes a central piece, a first side piece and a second side piece, and the stitching (e.g., stitching 1662) can be used to couple together the central piece to first and second sides. For example, for the protective hat 1300 shown in FIGS. 13A and 13B, the stitching (such as the stitching 1662) can be used to couple together the central piece 1302 to the first side piece 1302 and the second side piece.

Figure 16H:
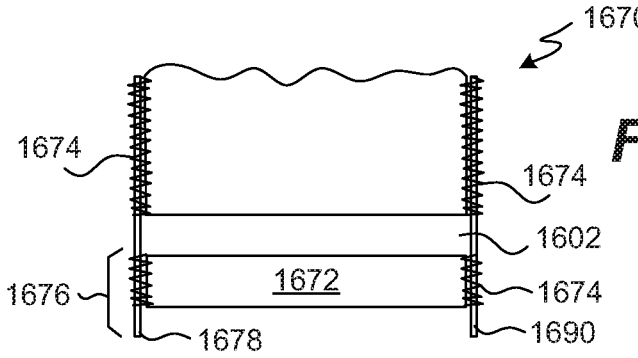
FIG. 16H illustrates a partial rear portion of a protective hat according to one embodiment.

FIG. 16H illustrates a partial rear portion 1670 of a protective hat according to one embodiment. In FIG. 16H, the inside surface of the partial rear portion 1670 is depicted. Typically, the inner surface is provided adjacent the user's head when the protective hat is being worn. The protective hat includes the opening 1602 in the partial rear portion 1670. Similar to FIG. 16B, an elastic member 1672 may be provided across the opening 1602 at a base portion 1676 of the partial rear portion 1670. A first side of the elastic member 1672 is secured to a first side piece 1678 and a second side of the elastic member 1672 is secured to a second side piece 1670 of the protective hat with stitching 1674. More generally, the protective hat includes a central piece, a first side piece and a second side piece, and the stitching (e.g., stitching 1674) can be used to couple together the central piece to first and second sides. For example, for the protective hat 1500 shown in FIGS. 15A and 15B, the stitching (such as the stitching 1674) can be used to couple together the central piece 1502 to the first side piece 1504 and the second side piece.

Although not indicated in FIGS. 16A-16H, these embodiment may also have one or more force absorbing members, such as the internal central force absorbing member 1520 shown in FIG. 15B. Any of the one or more force absorbing members can be configured to provide an overlapped or interleaved portion.

In another aspect, a head protection device can be a headband. The headband can include one or more force absorbing members. In some embodiments, the force absorbing members can include one or more overlapping portions, such as one or more overlapping force absorbing members. The headband can have any shape or configuration that is desired and/or suitable for its intended use. The thickness and material used as the force absorbing members is discussed above, according to various embodiments. In one embodiment, the force absorbing members are formed of polyurethane foam of 0.5-5 mm thickness which is light weight while still providing significant impact absorption.

Figure 17A:
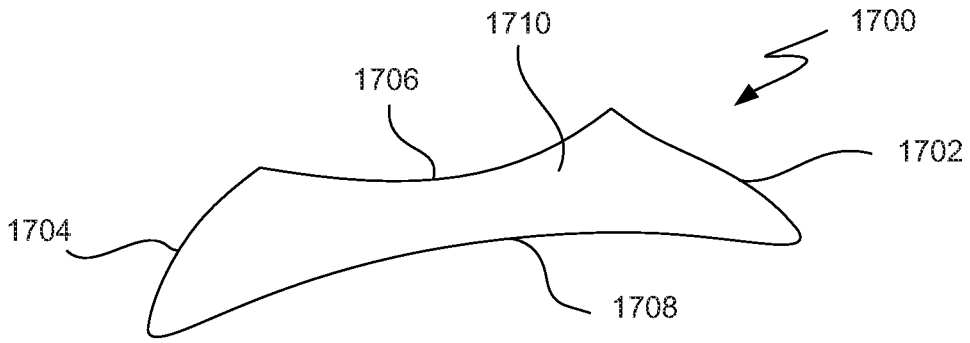
FIG. 17A illustrates a side prospective view of a headband according to one embodiment.

FIG. 17A illustrates a side prospective view of a headband 1700 according to one embodiment. The headband 1700 can include a front portion 1702, a rear portion 1704, a top portion 1706, and a bottom portion 1708. The headband 1700 may have an outer material 1710 that may be formed from any desired material such as cotton, rayon, polyester, velvet, leather, and any other woven fabric material such as wool, Spandex, LYCRA, latex, plastic, or any combination of the above. The fabric material may be breathable, durable, stretchable, machine washable, and/or water resistant.

The outer material 1702 can also include at least some an elastic material. For example, a percentage of the outer material 1710 can be an elastic material, such as LYCRA or Spandex. Alternatively or additionally, the headband 1700 can include one or more elastic members (e.g., an elastic bands), not shown, coupled to a portion of the headband 1700 or around a periphery of the headband 1700.

In one embodiment, the outer material 1702 may have an inner layer and an outer layer thereby forming an opening between the inner layer and the outer layer. One or more thin force absorbing members (such as thin force absorbing members 1320, 1322 illustrated in FIG. 13B or the thin force absorbing members 1520, 1522 illustrated in FIG. 15B) may be positioned in the opening between the inner layer and the outer layer. The at least one thin force absorbing members can be formed of a material that may be selected from a group of high-density and elastic materials, such as elastomer, polyurethane foam, gel, silicone, and the like. In one embodiment, the thin force absorbing members may be coupled to a surface of either the inner layer or the outer layer to be securely retained within the opening formed by the inner layer and outer layer. The thin force absorbing members may be coupled to a surface of either the inner layer or outer layer by any known means such as via adhesives, hook and loop members, snaps, sewed on, and the like.

Figure 17B:
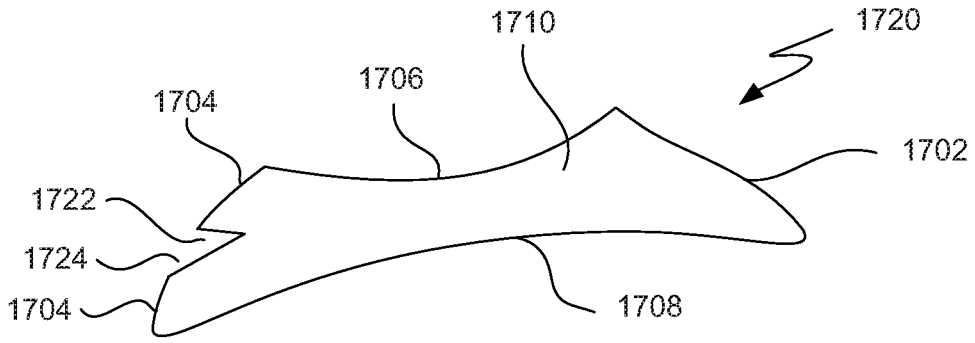
FIG. 17B illustrates a side prospective view of a headband according to another embodiment.

FIG. 17B illustrates a side prospective view of a headband 1720 according to another embodiment. The headband 1720 is similar to the headband 1700 illustrated in FIG. 17A, but further includes a slot 1722 or alternatively, a channel 1724 and a slot 1722. The slot 1722 and/or the slot 1722 and the channel 1724 can serve to retain a user's hair that is passed through the slot 1722. Additional features of the slot 1722 and the channel 1724 are similar to those discussed above with reference to FIGS. 14E and 16F.

Figure 17C:
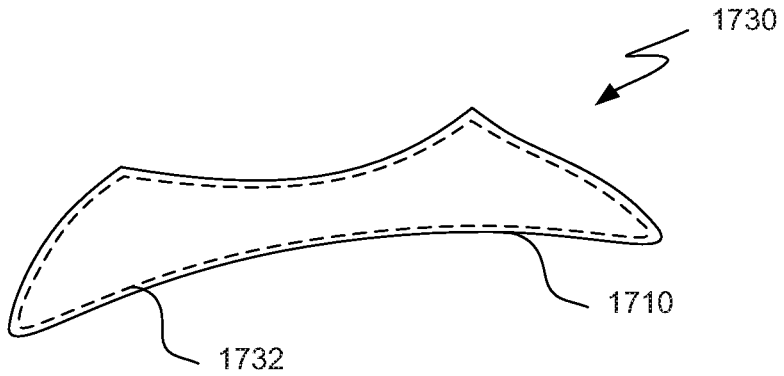
FIG. 17C illustrates a side prospective view of a headband according to one embodiment.
Figure 17D:
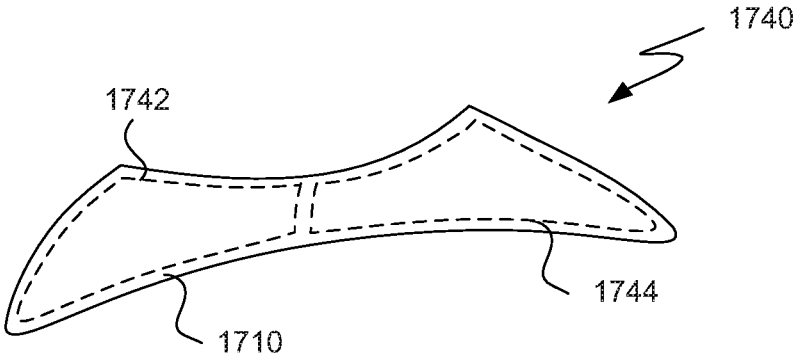
FIG. 17D illustrates a side prospective view of a headband according to one embodiment.

FIG. 17C illustrates a side prospective view of a headband 1730 according to one embodiment. The headband 1730 is similar to the headband 1700 illustrated in FIG. 17A, but further illustrates that the headband 1730 includes at least one thin force absorbing member 1732. In this embodiment, the at least one thin force absorbing member 1732 conforms to the shape of the headband 1730. The at least one thin force absorbing member 1732 may be coupled to at least one surface of outer material 1710, such as its inner layer, of the headband 1730. Although the at least one thin force absorbing member is illustrated as a single piece of material in FIG. 17C, this is not intended to be limiting, as is further discussed with reference to FIG. 17D. FIG. 17D illustrates a side prospective view of a headband 1740 according to one embodiment. The headband 1740 is similar to the headband 1700 illustrated in FIG. 17D, but further illustrates that the headband 1740 may have at least two thin force absorbing members 1742 and 1744. In this embodiment, the two thin force absorbing members 1742 and 1744 conform to the shape of the headband 1740. The at least two thin force absorbing members 1742 and 1744 are typically retained within the outer material 1710 of the headband 1740. For example, the outer material 1710 can include an inner layer and an outer layer of material, and the at least two thin force absorbing members 1742 and 1744 can be provided between the inner and outer layers of material. The at least two thin force absorbing members may be securely retained within the outer material 1710 by being secured to a surface of the inner layer or the outer layer or by fitting within a pocket or opening therein. The at least two thin force absorbing members may be coupled to or retained to a surface of either the inner layer or outer layer by any known means such as via adhesives, snaps, hook and loop members, sewed on, and the like. Alternatively, the at least two thin force absorbing members may be securely retained within the outer material 1710 by being retain or fitted within a pocket or opening therein.

Figure 17E:
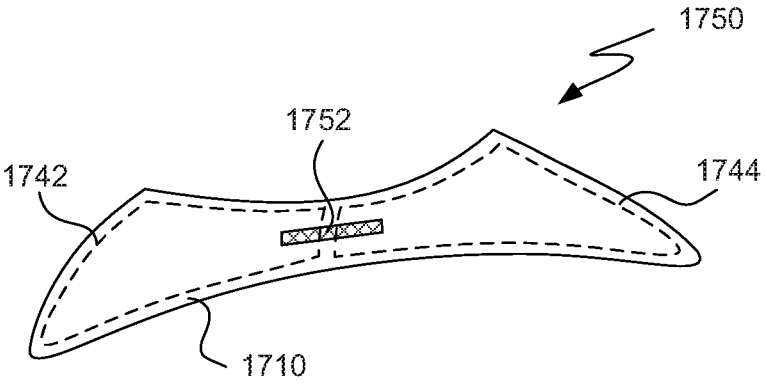
FIG. 17E illustrates a side prospective view of a headband according to one embodiment.

FIG. 17E illustrates a side prospective view of a headband 1750 according to one embodiment. The headband 1750 is similar to the headband 1740 shown in FIG. 17D, but further illustrates that the headband 1750 includes at least one tensioner 1752. The tensioner 1752 may be an elastic member coupled to or secured to thin force absorbing members 1742 and 1744. The tensioner 1752 may be secured to the thin force absorbing members 1742, 1744 via any known securing means such as with the use of adhesives, snaps, hook and loop fasteners, sewing, and the like. The tensioner 1752 can serve to elastically bias the two thin force absorbing members 1742 and 1744 together. Further, in one embodiment, by using the tensioner 1752 applied to the two thin force absorbing members 1742 and 1744, the headband 1750 can be elastically secured to the user's head when the headband 1750 is being worn. In other words, the at least one tensioner 1752 can impose a compression force to help secure the headband 1750 to the user's head when the headband 1750 is being worn.

Figure 17F:
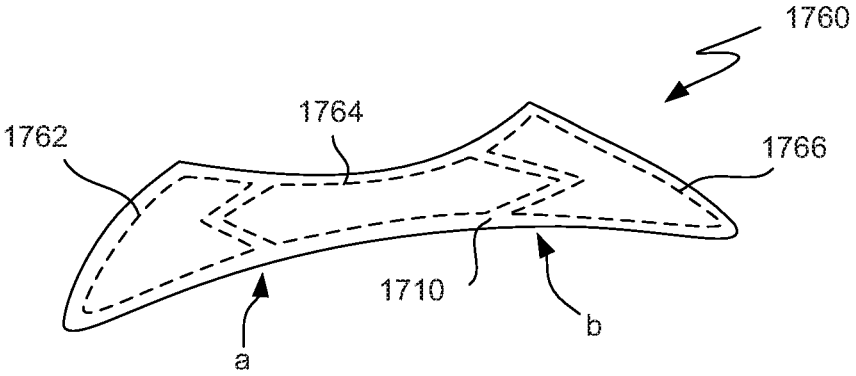
FIG. 17F illustrates a side prospective view of a headband according to one embodiment.

FIG. 17F illustrates a side prospective view of a headband 1760 according to one embodiment. This embodiment is designed to permit horizontal expansion of the headband 1760, yet reduce areas of no protection zones when the headband is expanded. The headband 1760 is similar to the headband 1700, but further illustrates that the headband 1760 includes at least three thin force absorbing members 1762, 1764 and 1766. In this embodiment, the three thin force absorbing members 1762, 1764 and 1766 conform to the shape of the headband 1760. The at least three thin force absorbing members 1762, 1764 and 1766 are typically retained within the outer material 1710 of the headband 1760. For example, the outer material 1710 can include an inner layer and an outer layer of material, and the at least three thin force absorbing members 1762, 1764 and 1766 can be provided between the inner and outer layers of material. Additionally, it should be noted that the thin force absorbing members may have overlapping portions, such as at regions a and b of the headband 1760. When the headband 1760 is expanded, such as when worn on a user's head, the overlapping portions of the thin force absorbing members can separate but remain partially overlapped, at regions a and b, so that unprotected zones or areas of the headband 1760 are limited. Although the opposing overlapping portions are V-shaped in this embodiment, in other embodiments the shape of the opposing overlapping portions can vary. For example, in another embodiment, the opposing overlapping portions can be "teeth-shaped," such as shown in FIG. 10E, wavy, squared, rounded, or any other desired shape. Additionally, the headband 1760 may be used with tensioners, such as similar to the tensioner discussed in FIG. 17E to connect the thin force absorbing members. For example, tensioners may be used to connect the thin force absorbing members 1762 and 1764 and/or the thin force absorbing members 1764 and 1766.

Figure 18A:
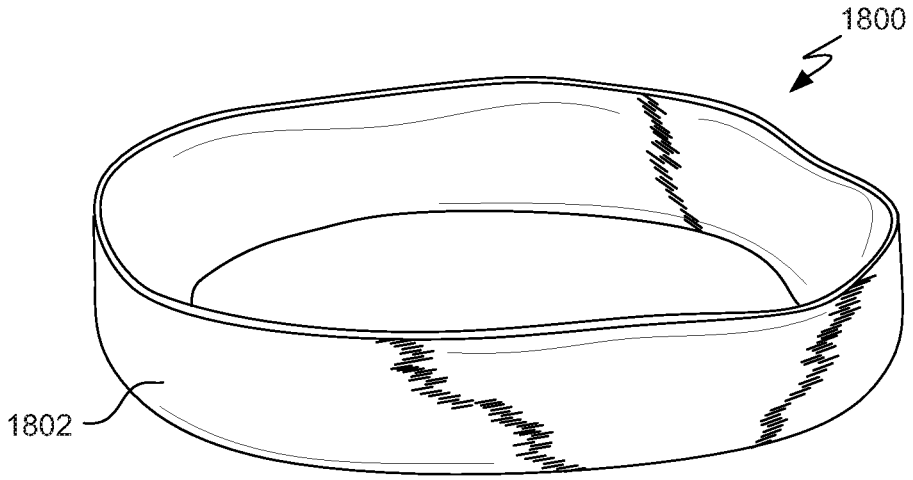
FIG. 18A illustrates a prospective view of a headband according to one embodiment.

FIG. 18A illustrates a prospective view of a headband 1800 according to one embodiment. The headband 1800 is illustrated as having a ring-shaped. However, this is not intended to be limiting as the headband can be any desired shape. For example, the headband may be ring-shaped with bunny ears, wavy, contoured, and the like. The headband 1800 may have an outer material 1802 that is suitable for containing one or more thin force absorbing members. The at least one thin force absorbing members can be formed of a material that may be selected from a group of high-density and elastic materials, such as elastomer, polyurethane foam, gel, silicone, and the like. The at least one thin force absorbing members may be similar to the thin force absorbing members as discussed above, such as, for example, in FIGS. 17D-17F.

The outer material 1802 can may be formed from any desired material such as cotton, rayon, polyester, velvet, leather, and any other woven fabric material such as wool, Spandex, Lycra, LYCRA, plastic, or any combination of the above. The fabric material may be breathable, durable, stretchable, machine washable, and/or water resistant. The outer material 1802 can also include at least some an elastic material. For example, a percentage of the outer material 1802 can be an elastic material, such as LYCRA or Spandex. Alternatively or additionally, the headband 1800 can include an elastic member (e.g., an elastic band). The headband 1800 may be any known article of clothing such as a head gear (e.g., hat, headband), pair of pants, shirt, foot wear (e.g., sock) and the like.

In one embodiment, the headband 1800 may have an inner layer and an outer layer. The at least one thin force absorbing members can be provided between the inner and outer layers of material.

Figure 18B:
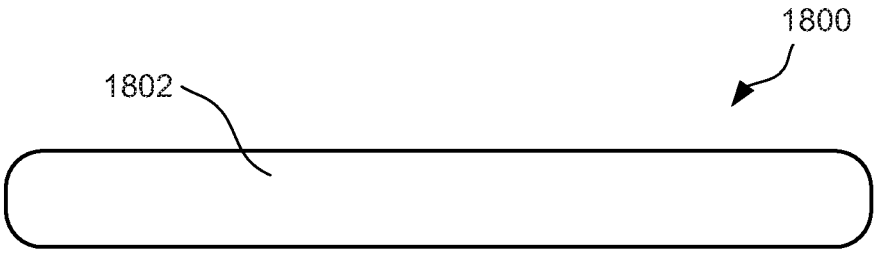
FIG. 18B illustrates a side prospective view of a headband shown in FIG. 18A.
Figure 18C:
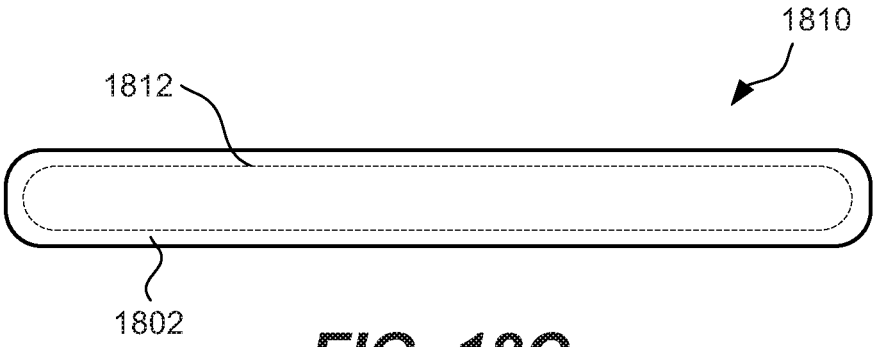
FIG. 18C illustrates a side prospective view of a headband according to one embodiment.

FIGS. 18B and 18C illustrates a side prospective view of the headband 1800 shown in FIG. 18A according to one embodiment. Referring to FIG. 18C, the headband 1810 is similar to the headband 1800 illustrated in FIG. 18A, but further illustrates that the headband 1810 includes at least one thin force absorbing member 1812. In this embodiment, the thin force absorbing member 1812 conforms to the shape of the headband 1810. The at least one thin force absorbing member 1812 is typically retained within the outer material 1802 of the headband 1810. For example, the outer material 1802 can include an inner layer and an outer layer of material, and the at least one thin force absorbing members can be provided between the inner and outer layers of material. The at least one thin force absorbing member 1812 can be coupled to a surface of either the inner layer or outer layer. The at least one thin force absorbing member can be coupled to the inner layer or outer layer by any known securing means such as through the use of adhesives, snaps, hook and loop fasteners, and the like. Alternatively, the at least one thin force absorbing member may be securely retained within the outer material 1802 by being retain or fitted within a pocket or opening therein.

Figure 18D:
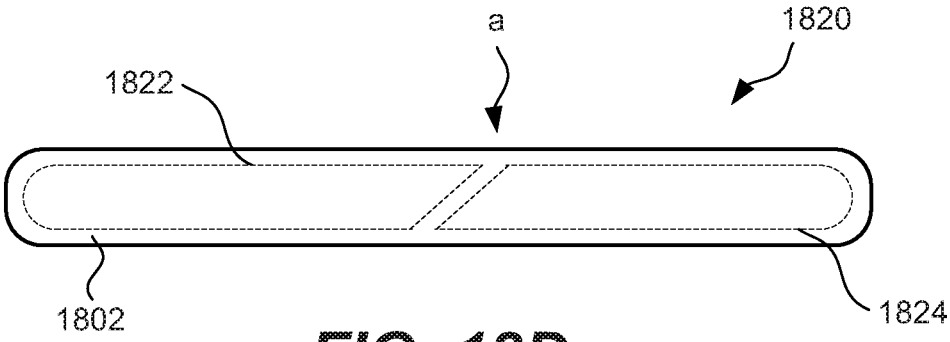
FIG. 18D illustrates a side prospective view of a headband according to one embodiment.
Figure 18E:
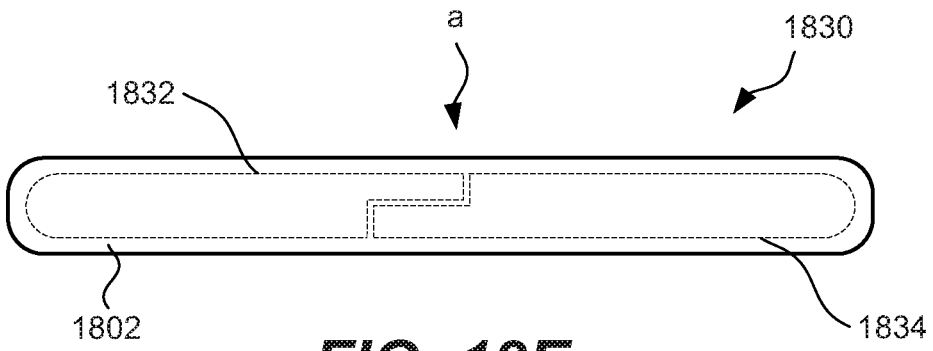
FIG. 18E illustrates a side prospective view of a headband according to one embodiment.

FIG. 18D illustrates a side prospective view of a headband 1820 according to one embodiment. The headband 1820 is similar to the headband 1800 illustrated in FIG. 18A, but further illustrates that the headband 1820 includes at least two thin force absorbing members 1822 and 1824. In this embodiment, the two thin force absorbing members 1822 and 1824 conform to the shape of the headband 1820. The at least two thin force absorbing members 1822 and 1824 may be retained within the outer material 1802 of the headband 1820. For example, the outer material 1802 can include an inner layer and an outer layer of material, and the at least two thin force absorbing members 1822 and 1824 can be provided between the inner and outer layers of material. Alternatively, the at least two thin force absorbing members 1822 and 1824 may be securely retained within the outer material 1802 by being retain or fitted within a pocket or opening therein. Additionally, it should be noted that the thin force absorbing members may have overlapping portions such that when the headband 1820 is expanded, such as when worn on a user's head, the overlapping portions of the thin force absorbing members can separate but remain partially overlapped (e.g., at region a). By overlapping portions of the thin force absorbing members 1822 and 1824, unprotected areas of the headband 1820 may be limited or decreased. Although the opposing overlapping portions are angled in this embodiment, in other embodiment the shape of the opposing overlapping portion can vary as illustrated in FIG. 18E. For example, in another embodiment, the opposing overlapping portions can be "teeth-shaped," as shown in FIG. 10E.

FIG. 18E illustrates a side prospective view of a headband 1830 according to one embodiment. The headband 1830 is similar to the headband 1800, but further illustrates that the headband 1830 includes at least two thin force absorbing members 1832 and 1834. In this embodiment, the two thin force absorbing members 1832 and 1834 conform to the shape of the headband 1830. The at least two thin force absorbing members 1832 and 1834 may be retained within the outer material 1802 of the headband 1830. For example, the outer material 1802 can include an inner layer and an outer layer of material, and the at least two thin force absorbing members 1832 and 1834 can be provided between the inner and outer layers of material. At least one of the at least two thin force absorbing members 1832 and/or 1834 may be coupled to or secured to a surface of the inner layer or outer layer of outer material 1802. The at least two thin force absorbing members 1832 and 1834 may be coupled to the outer material 1802. Alternatively, the at least two thin force absorbing members 1832 and 1834 may be securely retained within the outer material 1802 by being retain or fitted within a pocket or opening therein.

Additionally, it should be noted that the thin force absorbing members may have overlapping portions, whereby when the headband 1830 is expanded, such as when worn on a user's head, the overlapping portions of the thin force absorbing members can separate but remain partially overlapped, at region a. By having partially overlapped regions, the unprotected areas or zones of the headband 1830 may be limited. Although the opposing overlapping portions are "stepped-shaped" in this embodiment, in other embodiment the shape of the opposing overlapping portion can vary, such as wave shaped, teeth shaped, triangular shaped, and the like.

Figure 18F:
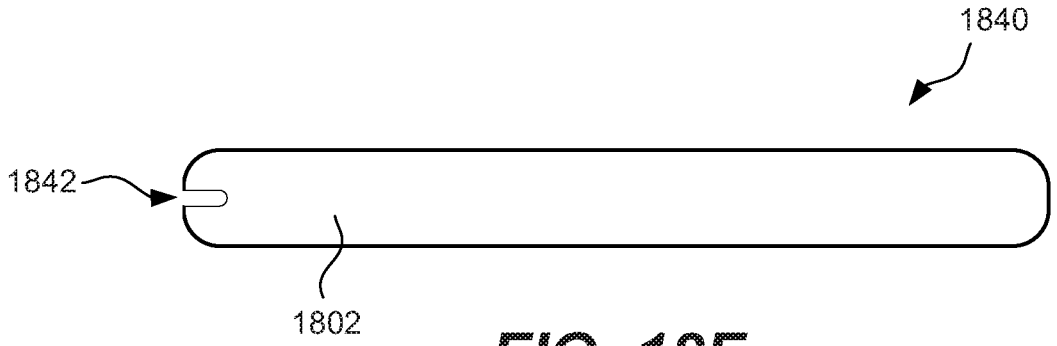
FIG. 18F illustrates a side prospective view of a headband according to one embodiment.

FIG. 18F illustrates a side prospective view of a headband 1840 according to one embodiment. The headband 1840 is similar to the headband 1800, but further includes a slot 1842. The slot 1842 can serve to retain a user's hair that is passed through the slot 1842. Additional features of the slot 1842 are similar to those discussed above with reference to FIGS. 14E and 16F. In one embodiment, headband 1840 may also have a channel (not shown) in addition to slot 1842. The channel may be similar to a channel discussed above with reference to FIG. 14E or 16F.

Figure 18G:
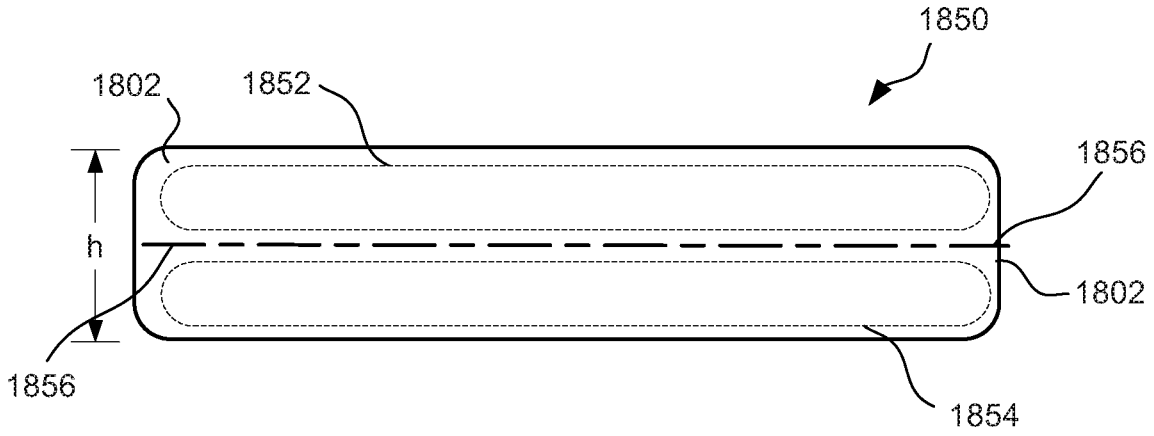
FIG. 18G illustrates a side prospective view of a headband according to another embodiment.

FIG. 18G illustrates a side prospective view of a headband 1850 according to another embodiment. The headband 1850 may have a height H that is greater than the height of the headband 1800 illustrated in FIG. 18A. For example, the height of the headband 1850 can be approximately between 50-200% greater than the height of the headband 1810. The headband 1850 includes at least a first thin force absorbing member 1852, and a second thin force absorbing member 1854. In this embodiment, the first and second thin force absorbing members 1852 and 1854 may conform to the shape of the headband 1850. In an alternative embodiment, the shape of the first and second thin force absorbing members 1852, 1854 may be any desired shape such as squares, circle, complex shapes, and the like. The first thin force absorbing member 1852 may be retained within an upper portion of the outer material 1802 of the headband 1850. For example, the outer material 1802 can include an inner layer and an outer layer of material, and the first thin force absorbing material 1852 can be provided between the inner and outer layers of material. The second thin force absorbing member 1854 may be retained within a lower portion of the outer material 1802 of the headband 1850. For example, the outer material 1802 can include an inner layer and an outer layer of material, and the second thin force absorbing material 1854 can be provided between the inner and outer layers of material.

The first thin force absorbing member 1852 and the second thin force absorbing member 1854 may be secured or retained to one surface of either the upper portion of the outer material 1802 or the lower portion of the outer material 1802, respectively. The first thin force absorbing members 1852 and the second thin force absorbing members 1854 may be secured to the outer material 1802 by any known means such as with the use of adhesives, snaps, hook and loop fasteners, sewn, and the like. Alternatively, the first and second thin force absorbing members 1842, 1854 may be securely retained within the outer material 1802 by being retain or fitted within one or more pockets or openings therein.

In one embodiment, the headband 1850 can also include a seam 1856. The seam 1856 can be provided horizontally around the headband 1850. The seam 1856 can serve to assist in separately retaining the first and second thin force absorbing member 1852 and 1854 within the outer material 1802. Alternatively or additionally, the seam 1856 can also facilitated folding the headband 1850, such that the headband 1850 can be folded over itself. A user thus has the option of using the headband 1850 as a wider headband or as a thinner but thicker headband. With the headband 1850 unfolded, the headband 1850 can provide greater area of coverage, such as additional forehead protection. With the headband 1850 folded, the headband 1850 offers increased impact protection since the combined thickness of the first and second thin force absorbing members 1852 and 1854.

Figure 18H:
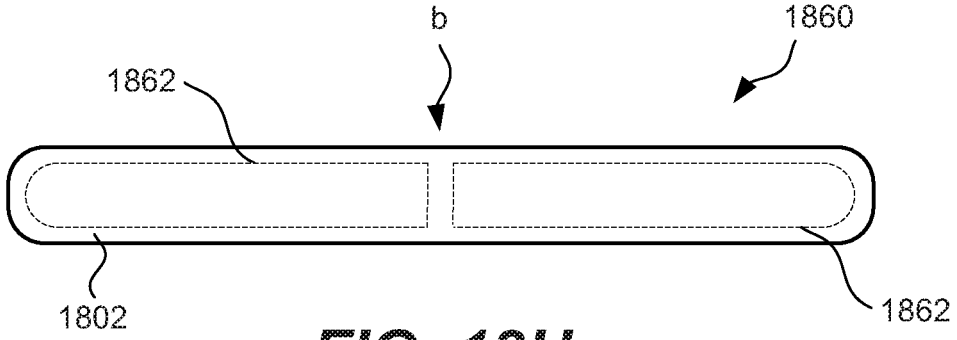
FIG. 18H illustrates a side prospective view of a headband according to one embodiment.

FIG. 18H illustrates a side prospective view of a headband 1860 according to one embodiment. The headband 1860 is similar to the headband 1800 illustrated in FIG. 18A or the headband 1810 illustrated in FIG. 18C. The headband 1860 includes a single thin force absorbing member 1862. In this embodiment, the thin force absorbing member 1862 is one continuous piece of material that is sized to correspond to the height of the headband 1860. The thin force absorbing member 1862 may be retained within the outer material 1802 of the headband 1820. For example, the outer material 1802 can include an inner layer and an outer layer of material, and the thin force absorbing members 1862 can be provided between (and thus retained within) the inner and outer layers of material. The thin force absorbing member 1862 may have an opening or gap, see region b. Typically, region b of the headband 1860 would be positioned at the rear portion of the headband 1860 and correspond to the end portions of thin force absorbing member 1862. The use of the single thin force absorbing member 1862 allows for a uniform appearance for the headband 1860 that would not need need an opening in a front or side portion of the headband 1860. As a result, unprotected or exposed areas of the headband 1860 are minimized. Also, the use of the continuous single thin force absorbing member 1862 provides for enhanced structural integrity.

Figure 18I:
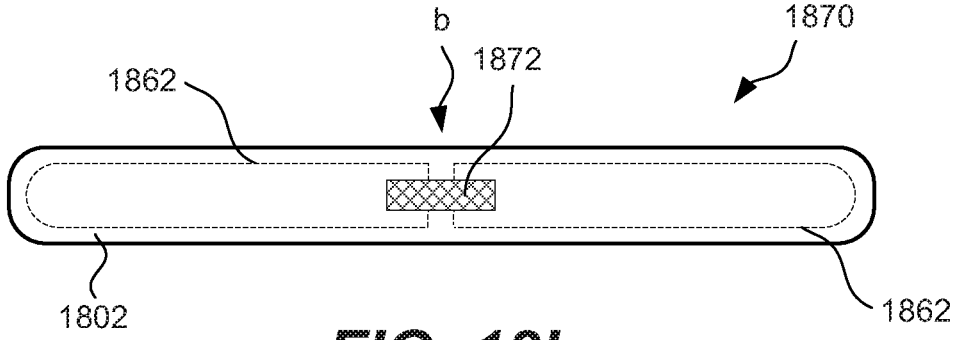
FIG. 18I illustrates a side prospective view of a headband according to one embodiment.

FIG. 18I illustrates a side prospective view of a headband 1870 according to one embodiment. The headband 1870 is similar to the headband 1860 illustrated in FIG. 18H. However, the headband 1870 includes at least one tensioner 1872. The tensioner 1872 may be an elastic member coupled to or secured to opposing ends 1874*a*, 1874*b* of the thin force absorbing member 1862. The tensioner 1872 may be secured to opposing ends of the thin force absorbing member 1862 via any known securing means such as with the use of adhesives, snaps, hook and loop fasteners, sewing, and the like. The tensioner 1862 can serve to elastically bias opposing ends 1847*a*, 1874*b* (e.g., at region b) of the thin force absorbing member 1862 together. Further, in one embodiment, tensioner 1872 applies pressure or tension to opposing ends of the thin force absorbing member 1862 so that headband 1870 can be elastically held to the user's head when the headband 1870 is being worn. In other words, the at least one tensioner 1872 can impose a compression force to help secure the headband 1870 to the user's head when the headband 1870 is being worn. Here, the thin force absorbing member 1862, together with the at least one tensioner 1872, are providing most of the compression force, as the structural rigidity of the thin force absorbing member 1862 is more rigid and less deformable or elastic than the outer material 1802.

Figure 18J:
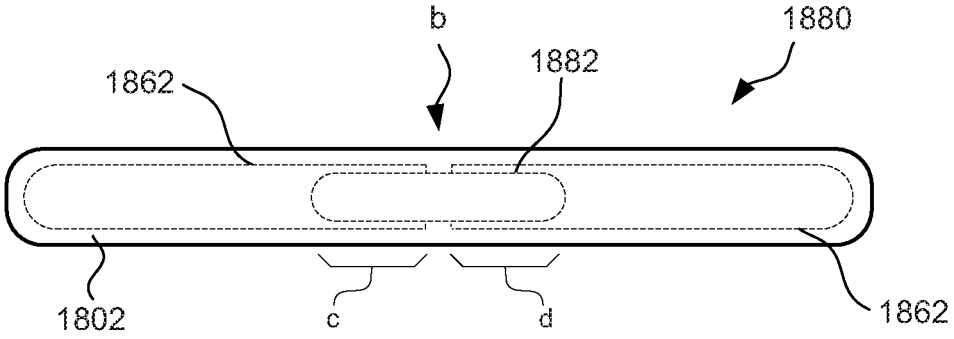
FIG. 18J illustrates a side prospective view of a headband according to one embodiment.

FIG. 18J illustrates a side prospective view of a headband 1880 according to one embodiment. The headband 1880 is similar to the headband 1860 illustrated in FIG. 18H or the headband 1870 illustrated in FIG. 18I. The headband 1880 further includes an additional thin force absorbing member 1882. The additional thin absorbing member 1882 is positioned over region b to cover the opening (at region b) formed by opposing ends 1874*a*, 1874*b* of the thin force absorbing member 1862. As a result, the opening of opposing ends of the thin force absorbing member 1862 is not a region that lacks force absorbing protection for a user's head. In one embodiment, the additional thin force absorbing member 1882 extends over and thus overlaps a portion of the thin force absorbing member 1862. Exemplary overlapping portions are shown in FIG. 18J as regions c and d. At region c, one side of the additional thin force absorbing member 1882 can slide over a corresponding end portion 1874*a* of the thin force absorbing member 1862. Likewise, at region d, another side of the additional thin force absorbing member 1882 can slide over another corresponding end portion 1874*b* of the thin force absorbing member 1862. Further, if the headband 1880 includes a tensioner, such as the tensioner 1872 shown in FIG. 18I, the additional thin absorbing member 1882 can be positioned over or cover a rear side of the tensioner 1872. Optionally, the additional thin absorbing member 1882 could be secured in place relative to the outer material 1802 and/or the tensioner 1872. For example, the additional thin absorbing member 1882 may be secured to the outer material 1802, thin force absorbing member 1882, and/or the tensioner 1872 via any known securing means such as with the use of adhesives, snaps, hook and loop fasteners, sewing, and the like.

Figure 18K:
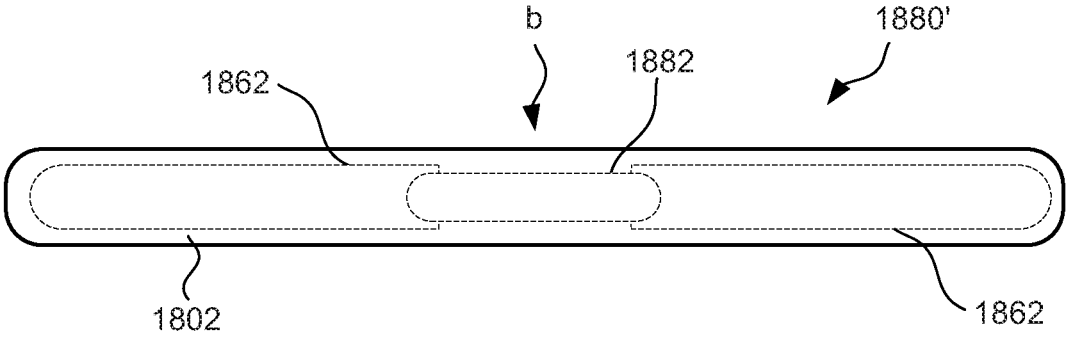
FIG. 18K illustrates a side prospective view of a headband according to one embodiment.

FIG. 18K illustrates a side prospective view of a headband 1880' according to one embodiment. The headband 1880' is the same as the headband 1880 illustrated in FIG. 18J, but in an expanded position, such as when worn on a user's head. Here, pressure is applied to stretch headband 1880' and opposing ends 1874*a*, 1874*b* of the thin force absorbing member 1862 are now separated by a larger opening at region b. Advantageously, however, the additional thin force absorbing member 1882 is still positioned and is of sufficient length to substantially cover the larger opening at region b which now exists between opposing ends 1874*a*, 1874*b* of the thin force absorbing member 1862. Hence, the headband 1880, 1880' can be expanded to different widths as needed by the user to fit snuggly or tightly around the user's head. However, the additional thin force absorbing member 1882 ensures that there are no exposed and unprotected regions of the headband 1880, 1880' even when fully expanded.

In addition, it should be noted that the features described in FIGS. 18H-18K can likewise be applied to other embodiment of headwear, such as headbands shown in FIGS. 17D-17F.

Additionally, any of the embodiments of the head protection devices described above can use a sweat absorbing or sweat wicking material. For example, the sweat absorbing or wicking material can be provided on an inner layer of an outer material. In one example, the sweat absorbing or wicking material can be provided at a front portion of the inner layer of the outer material. The sweat absorbing or wicking material can be a part of the inner layer or can be a separate material that is coupled to the front portion of the inner layer of the outer material. In another example, the sweat absorbing or wicking material can be provided as the entire inner layer of outer material, or as an additional layer coupled to the inner layer of outer material. The sweat absorbing or wicking material can also be used as the material for the head protection devices (e.g., inner and outer layers). The sweat absorbing or wicking material can be any of a variety of material, often a combination of materials, such as Dryline or Dryflex fabrics. Often, such sweat absorbing or wicking materials have a stretch component provided by LYCRA or Spandex. One example of such a composite material is 92% Polyester and 8% LYCRA/Spandex. Another example of such a composite material is 90% polyester and 10% LYCRA/Spandex. Still another example of such a composite material is 80% tactel nylon and 20% LYCRA/Spandex. The polyester or nylon can be high-wicking microfibre. The material used, or a component thereof, can also have an antimicrobial treatment to help prevent the growth of bacteria and reduce odors. In such embodiments, any sweat released from the user's head may be wicked away or absorbed away from the user's eyes. In other words, sweat released from the user's forehead may be impeded from reaching the user's eyes. When a user is exercising and produces sweat, it is undesirable for the sweat to enter the user's eyes as it may sting and be bothersome to the user. Still further, any of the embodiments of the head protection devices described above, can further include a sweat guide. For example, the sweat guide can be provided on or in an inner layer of an outer material. In one example, the sweat guide can be provided at a front portion of the outer material. The sweat guide can be a part of the inner layer or can be a separate material that is coupled to the front portion of the inner layer of the outer material. For example, the sweat guide can be a molded plastic piece. In such embodiments, any sweat released from the user's head may be wicked away or absorbed away from the user's eyes. In other words, sweat released from the user's forehead may be impeded from reaching the user's eyes. When a user is exercising and produces sweat, it is undesirable for the sweat to enter the user's eyes as it may sting and be bothersome to the user.

Additionally, any of the embodiments of the head protection devices described above can use a thin force absorbing material made of urethane foams or polyurethane foams, such as microcellular urethane foams.

This application also incorporates by reference (i) U.S. patent application Ser. No. 13/342,872, filed Jan. 3, 2012, entitled "LOW PROFILE BODY PROTECTION DEVICE," which is herein incorporated by reference, and (ii) U.S. Provisional Patent Application No. 61/429,051, filed Dec. 31, 2010, entitled "LOW PROFILE BODY PROTECTION DEVICE," which is herein incorporated by reference.

The various aspects, features, embodiments or implementations of the invention described above can be used alone or in various combinations.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A protective hat, comprising:

a fabric covering having at least an exterior surface; and a plurality of force absorbing members provided internal to the fabric covering, the plurality of force absorbing members including at least a first force absorbing member and a second force absorbing member, the first force absorbing member having a least a first side with a first set of extensions that extend outward, and the second force absorbing member having a least a second side with a second set of extensions that extend outward, wherein the first side of the first force absorbing member is adjacent the second side of the second force absorbing member, and the first set of extensions are interlaced with the second set of extensions, wherein an unexpanded distance between the first side of the first force absorbing member and an adjacent end portion of the second set of extensions of the second force absorbing member when the protective hat is in an unexpanded configuration is less than an expanded distance between the first side of the first force absorbing member and the adjacent end portion of the second set of extensions when the hat is in an expanded configuration, and wherein the plurality of force absorbing members comprise polyurethane foam, and wherein each of the plurality of force absorbing members has a thickness of approximately 1 to 5 millimeters.

2. A protective hat as recited in claim 1, wherein the first set of extensions are interlaced to a first degree with the second set of extensions when in the unexpanded configuration, and wherein the first set of extensions are interlaced to a second degree with the second set of extensions when in the expanded configuration, the second degree being less interlacing than the first degree.

3. A protective hat as recited in claim 1, wherein the first set of extensions are interlaced with the second set of extensions to a first interlace depth when in the unexpanded configuration, and wherein the first set of extensions are interlaced with the second set of extensions to a second interlace depth when in the expanded configuration.

4. A protective hat as recited in claim 1, wherein at least one of the first set of extensions is interlaced with at least one of the second set of extensions to a first interlace depth when in the unexpanded configuration, wherein at least one of the first set of extensions is interlaced with at least one of the second set of extensions to a second interlace depth when in the expanded configuration, and wherein the second interlace depth is different than the first interlace depth.

5. A protective hat of claim 4, wherein the at least one of the plurality of force absorbing members has a thickness that varies and includes a thinner region and a thicker region, both the thinner region and the thicker region are within the thickness range of approximately 1 to 5 millimeters.

6. A protective hat as recited in claim 1, wherein the protective hat has an expanded configuration and an unexpanded configuration, and wherein at least one of the first set of extensions is interlaced with at least one of the second set of extensions to a first interlace depth when in the unexpanded configuration.

7. A protective hat as recited in claim 1, wherein the fabric covering is made of a woven fabric.

8. A protective hat as recited in claim 1, wherein the fabric covering has an interior surface, and wherein the first force absorbing member is at least partially coupled to the interior surface of the fabric covering.

9. A protective hat of claim 1, wherein the fabric covering has an interior surface, and wherein one or more of the plurality of force absorbing members are sewn to the interior surface of the fabric covering.

10. A protective hat in claim 1, wherein the plurality of force absorbing members are concealed by the fabric covering.

11. A protective hat in claim 1, wherein the plurality of force absorbing members combine to provide impact force protection to a wearer of the protective hat.

12. A protective hat of claim 1, wherein the plurality of force absorbing members are separately secured to or within the fabric covering and combine to provide impact force protection to a wearer of the protective hat.

13. A protective hat, comprising:

a fabric covering having at least an exterior surface; and a plurality of force absorbing members provided internal to the fabric covering, the plurality of force absorbing members including at least a first force absorbing member and a second force absorbing member, wherein the protective hat has an expanded configuration and an unexpanded configuration, wherein the first force absorbing member has a least a first side, and the second force absorbing member has a least a second side, wherein the first side of the first force absorbing member is adjacent the second side of the second force absorbing member, and the first side of the first force absorbing member is at least partially overlapping with the second side of the second force absorbing member when in the unexpanded configuration, and wherein the plurality of force absorbing members comprise polyurethane foam, and wherein each of the plurality of force absorbing members has a thickness of approximately 1 to 5 millimeters.

14. A protective hat of claim 13, wherein a portion of the first side of the first force absorbing member has a thickness that varies.

15. A protective hat of claim 13, wherein an edge of the first side is thinner that a central portion of the first force absorbing member.

16. A protective hat of claim 13, wherein an edge of the first side is rounded or tapered.

17. A protective hat of claim 13, wherein the first side of the first force absorbing member has a first set of extensions that extend outward in a direction of the first side, the second side of the second force absorbing member has a second set of extensions that extend outward in a direction of the second side.

18. A protective hat of claim 13, wherein the protective hat is configured to be foldable to a flat shape, and wherein when the protective hat is folded to the flat shape the first side is planar and adjacent and on top of the second side which is planar.

19. A protective hat, comprising:

a fabric covering having at least an exterior surface; and a plurality of force absorbing members provided internal to the fabric covering, the plurality of force absorbing members including at least a first force absorbing member and a second force absorbing member, wherein the protective hat has an expanded configuration and an unexpanded configuration, wherein the first force absorbing member has a least a first side, and the second force absorbing member has a least a second side, wherein the first side of the first force absorbing member is adjacent the second side of the second force absorbing member, and the first side of the first force absorbing member is at least partially overlapping with the second side of the second force absorbing member when in the unexpanded configuration, wherein the plurality of force absorbing members comprise polyurethane foam, and wherein each of the plurality of force absorbing members has a thickness of approximately 1 to 5 millimeters, wherein the protective hat has a main portion and a lower portion, wherein the first force absorbing member and the second force absorbing member are provided in the main portion of the protective hat, wherein the protective hat comprises one or more additional force absorbing members provided in the lower portion of the protective hat, and wherein the protective hat is configured to facilitate folding the lower portion of the protective hat up and over a lower section of the main portion, whereby at least a portion of the one or more additional force absorbing members overlaps with at least a portion of one or both of the first and second force absorbing members.

20. A protective hat of claim 19, wherein a horizontal gap is provided between the first and second force absorbing members in the main portion and the one or more additional force absorbing members in the lower portion, whereby the horizontal gap facilitates folding of the lower portion upward over a lower section of the main portion.

21. A protective hat of claim 19, wherein the plurality of force absorbing members are concealed by the fabric covering, and wherein the plurality of force absorbing members combine to provide impact force protection to a wearer of the protective hat.

22. A protective hat of claim 19, wherein the fabric covering has an interior surface, wherein one or more of the plurality of force absorbing members are provided in the interior surface of the fabric covering, and wherein the plurality of force absorbing members are concealed by the fabric covering.

* * * * *